US008562228B2

(12) United States Patent
Yamaguchi et al.

(10) Patent No.: US 8,562,228 B2
(45) Date of Patent: Oct. 22, 2013

(54) TAPE PRINTER

(75) Inventors: Koshiro Yamaguchi, Kakamigahara (JP); Tsuyoshi Nagae, Kasugai (JP); Masato Kato, Kasugai (JP); Teruo Imamaki, Nissin (JP); Takashi Horiuchi, Kariya (JP); Akira Sago, Seto (JP); Yasuhiro Iriyama, Mie (JP); Yasuhiro Shibata, Okazaki (JP)

(73) Assignee: Brother Kogyo Kabushiki Kaisha, Nagoya-Shi, Aichi (JP)

( * ) Notice: Subject to any disclaimer, the term of this patent is extended or adjusted under 35 U.S.C. 154(b) by 431 days.

(21) Appl. No.: 12/644,481

(22) Filed: Dec. 22, 2009

(65) Prior Publication Data

US 2010/0166475 A1 Jul. 1, 2010

(30) Foreign Application Priority Data

| | | |
|---|---|---|
| Dec. 25, 2008 | (JP) | 2008-331634 |
| Dec. 25, 2008 | (JP) | 2008-331635 |
| Dec. 25, 2008 | (JP) | 2008-331638 |
| Dec. 25, 2008 | (JP) | 2008-331639 |
| Dec. 25, 2008 | (JP) | 2008-331641 |
| Dec. 25, 2008 | (JP) | 2008-331642 |
| Dec. 25, 2008 | (JP) | 2008-331643 |
| Mar. 31, 2009 | (JP) | 2009-088440 |
| Mar. 31, 2009 | (JP) | 2009-088441 |
| Mar. 31, 2009 | (JP) | 2009-088456 |
| Mar. 31, 2009 | (JP) | 2009-088460 |
| Mar. 31, 2009 | (JP) | 2009-088468 |

(51) Int. Cl.
*B41J 11/44* (2006.01)
*B41J 15/00* (2006.01)

(52) U.S. Cl.
USPC ..... 400/76; 400/613; 400/611; 400/207; 400/208; 400/242

(58) Field of Classification Search
USPC ..... 400/611, 613, 207, 208, 242; 347/214
See application file for complete search history.

(56) References Cited

U.S. PATENT DOCUMENTS

| | | | |
|---|---|---|---|
| 4,127,883 | A | 11/1978 | Mestdagh |
| 4,567,488 | A | 1/1986 | Moriguchi et al. |

(Continued)

FOREIGN PATENT DOCUMENTS

| | | | |
|---|---|---|---|
| EP | 0329369 | A2 | 8/1989 |
| EP | 0511602 | A1 | 11/1992 |

(Continued)

OTHER PUBLICATIONS

Notification of reasons for rejection issued in the related Japanese Application No. 2009-088241, Nov. 15, 2011, JPO, Japan.

(Continued)

*Primary Examiner* — Matthew G Marini
(74) *Attorney, Agent, or Firm* — McCarter & English, LLP

(57) ABSTRACT

A tape printer includes a tape cassette including a housing, a cassette housing portion, a feeding device, a printing device, a plurality of detecting switches that protrude toward a side surface of the housing of the tape cassette installed in the cassette housing portion, a first determining device that, if a part of the detecting switches is pressed, determines that the tape cassette is installed, and a second determining device that, if a specific detecting switch among the detecting switches is pressed, determines that the tape cassette is not installed at a proper position. The tape cassette includes a first pressing portion that, if the tape cassette is installed at the proper position, presses a part of the detecting switches, and a second pressing portion that, if the tape cassette is not installed at the proper position, presses the specific detecting switch.

9 Claims, 42 Drawing Sheets

(56) References Cited

U.S. PATENT DOCUMENTS

| | | | | |
|---|---|---|---|---|
| 4,880,325 | A | | 11/1989 | Ueda et al. |
| 4,892,425 | A | | 1/1990 | Shimizu et al. |
| 4,915,516 | A | | 4/1990 | Shimizu et al. |
| 4,927,278 | A | | 5/1990 | Kuzuya et al. |
| 4,983,058 | A | | 1/1991 | Nagae |
| 5,188,469 | A | | 2/1993 | Nagao et al. |
| 5,193,949 | A | | 3/1993 | Marantette et al. |
| 5,203,951 | A | | 4/1993 | Hattori et al. |
| 5,223,939 | A | | 6/1993 | Imaizumi et al. |
| RE34,521 | E | | 1/1994 | Shimizu et al. |
| 5,277,503 | A | | 1/1994 | Nagao |
| 5,348,406 | A | | 9/1994 | Yoshiaki et al. |
| 5,350,243 | A | | 9/1994 | Ichinomiya et al. |
| 5,374,132 | A | * | 12/1994 | Kimura ..... 400/586 |
| 5,411,339 | A | | 5/1995 | Bahrabadi et al. |
| 5,419,648 | A | | 5/1995 | Nagao et al. |
| 5,429,443 | A | | 7/1995 | Kobayashi et al. |
| 5,466,076 | A | | 11/1995 | Kobayashi et al. |
| 5,494,362 | A | | 2/1996 | Kobayashi et al. |
| 5,536,092 | A | | 7/1996 | Yamaguchi |
| 5,538,352 | A | | 7/1996 | Sugiura |
| 5,540,510 | A | | 7/1996 | Sims et al. |
| 5,564,843 | A | | 10/1996 | Kawaguchi |
| 5,593,237 | A | | 1/1997 | Nozaki et al. |
| 5,620,268 | A | | 4/1997 | Yamaguchi et al. |
| 5,653,542 | A | | 8/1997 | Sugimoto et al. |
| 5,659,441 | A | | 8/1997 | Eckberg et al. |
| 5,727,888 | A | | 3/1998 | Sugimoto et al. |
| 5,730,536 | A | | 3/1998 | Yamaguchi |
| 5,771,803 | A | | 6/1998 | Takami |
| 5,813,773 | A | | 9/1998 | Kawai |
| 5,813,779 | A | | 9/1998 | Palmer et al. |
| 5,825,724 | A | | 10/1998 | Matsumoto et al. |
| 5,964,539 | A | | 10/1999 | Yamaguchi et al. |
| 6,042,280 | A | | 3/2000 | Yamaguchi et al. |
| 6,048,118 | A | | 4/2000 | Martinez et al. |
| 6,059,469 | A | | 5/2000 | Hirumi |
| 6,116,796 | A | | 9/2000 | Yamaguchi et al. |
| 6,132,120 | A | | 10/2000 | Yamaguchi et al. |
| 6,168,328 | B1 | | 1/2001 | Ueda et al. |
| 6,190,069 | B1 | | 2/2001 | Yamaguchi et al. |
| 6,196,740 | B1 | | 3/2001 | Yamaguchi et al. |
| 6,317,156 | B1 | | 11/2001 | Nagasaki et al. |
| 6,334,724 | B2 | | 1/2002 | Yamaguchi et al. |
| 6,406,202 | B1 | | 6/2002 | Unno et al. |
| 6,435,744 | B1 | | 8/2002 | Dunn et al. |
| 6,476,838 | B1 | | 11/2002 | Italiano |
| 6,485,206 | B1 | | 11/2002 | Takahashi |
| 6,520,696 | B2 | | 2/2003 | Huss et al. |
| 6,709,179 | B2 | | 3/2004 | Yamaguchi et al. |
| 6,955,318 | B2 | | 10/2005 | Nonomura et al. |
| 7,121,751 | B2 | | 10/2006 | Harada et al. |
| 7,128,483 | B2 | | 10/2006 | Harada et al. |
| D534,203 | S | | 12/2006 | Harada et al. |
| D542,334 | S | | 5/2007 | Harada et al. |
| 7,965,308 | B2 | | 6/2011 | Jauert et al. |
| 8,045,288 | B2 | | 10/2011 | Ota et al. |
| 8,109,684 | B2 | | 2/2012 | Yamaguchi |
| 8,162,553 | B2 | | 4/2012 | Vandermeulen |
| 8,164,609 | B2 | | 4/2012 | Liu et al. |
| 2002/0006303 | A1 | | 1/2002 | Yamaguchi et al. |
| 2002/0012558 | A1 | | 1/2002 | Huss et al. |
| 2002/0047063 | A1 | | 4/2002 | Kaneda et al. |
| 2004/0233269 | A1 | | 11/2004 | Tsubota |
| 2005/0172981 | A1 | | 8/2005 | Byun |
| 2006/0204304 | A1 | | 9/2006 | Hioki et al. |
| 2006/0233582 | A1 | | 10/2006 | Horiuchi |
| 2006/0239743 | A1 | | 10/2006 | Naito |
| 2007/0009306 | A1 | | 1/2007 | Harada et al. |
| 2007/0041772 | A1 | | 2/2007 | Harada et al. |
| 2007/0070168 | A1 | | 3/2007 | Mindler et al. |
| 2007/0237562 | A1 | | 10/2007 | Kato et al. |
| 2008/0050160 | A1 | | 2/2008 | Yamaguchi et al. |
| 2008/0080922 | A1 | | 4/2008 | Vandermeulen |
| 2008/0181708 | A1 | | 7/2008 | Yamaguchi et al. |
| 2008/0226373 | A1 | | 9/2008 | Yamaguchi et al. |
| 2008/0232886 | A1 | | 9/2008 | Kato et al. |
| 2008/0310904 | A1 | | 12/2008 | Yamaguchi et al. |
| 2009/0016795 | A1 | | 1/2009 | Caveney et al. |
| 2009/0202283 | A1 | | 8/2009 | Kumazaki et al. |
| 2011/0058884 | A1 | | 3/2011 | Kato et al. |

FOREIGN PATENT DOCUMENTS

| | | | |
|---|---|---|---|
| EP | 0629509 | | 12/1994 |
| EP | 0644506 | | 3/1995 |
| EP | 0684143 | | 11/1995 |
| EP | 734878 | | 10/1996 |
| EP | 0760291 | | 3/1997 |
| EP | 1199179 | | 4/2002 |
| EP | 1284196 | A2 | 2/2003 |
| EP | 1516739 | | 3/2005 |
| EP | 1700705 | | 9/2006 |
| EP | 1707395 | | 10/2006 |
| EP | 2236304 | A1 | 10/2010 |
| JP | 58-139415 | | 8/1983 |
| JP | 58220783 | | 12/1983 |
| JP | 62-173944 | | 11/1987 |
| JP | 63-166557 | A | 7/1988 |
| JP | 63-203348 | A | 8/1988 |
| JP | 63-254085 | A | 10/1988 |
| JP | 11-78188 | | 7/1989 |
| JP | 3-093584 | A | 4/1991 |
| JP | 3-118672 | | 5/1991 |
| JP | 3-120680 | | 5/1991 |
| JP | 03151261 | | 6/1991 |
| JP | 3063155 | | 9/1991 |
| JP | 4003068 | | 1/1992 |
| JP | 4-37575 | | 2/1992 |
| JP | 4-133756 | | 5/1992 |
| JP | H4133756 | | 5/1992 |
| JP | 5-16342 | | 3/1993 |
| JP | 5-63067 | | 3/1993 |
| JP | 5-155067 | | 6/1993 |
| JP | 5-54225 | | 7/1993 |
| JP | 5-78565 | | 10/1993 |
| JP | 5-80765 | U | 11/1993 |
| JP | 5-294051 | | 11/1993 |
| JP | 6-12053 | | 2/1994 |
| JP | 6-21953 | U | 3/1994 |
| JP | 60-99692 | | 4/1994 |
| JP | 6-124406 | | 5/1994 |
| JP | 6-152907 | A | 5/1994 |
| JP | 6-53560 | U | 7/1994 |
| JP | 6-183117 | | 7/1994 |
| JP | 6-191081 | A | 7/1994 |
| JP | 6-210889 | A | 8/1994 |
| JP | H06-74348 | | 10/1994 |
| JP | 6-328800 | | 11/1994 |
| JP | 7-1805 | | 1/1995 |
| JP | 7-9743 | | 1/1995 |
| JP | 7-25123 | | 1/1995 |
| JP | 7-47737 | | 2/1995 |
| JP | 7-61009 | | 3/1995 |
| JP | 07-068814 | | 3/1995 |
| JP | 7-69497 | | 3/1995 |
| JP | 7020725 | | 3/1995 |
| JP | 7-89196 | | 4/1995 |
| JP | 7-101133 | | 4/1995 |
| JP | 7-108702 | A | 4/1995 |
| JP | 7089115 | | 4/1995 |
| JP | 7137327 | | 5/1995 |
| JP | 7-40456 | | 7/1995 |
| JP | 7-237314 | A | 9/1995 |
| JP | 7-251539 | | 10/1995 |
| JP | 7-276695 | A | 10/1995 |
| JP | 7276695 | | 10/1995 |
| JP | 7-290803 | | 11/1995 |
| JP | 7-314864 | | 12/1995 |
| JP | 7-314866 | | 12/1995 |
| JP | 07314862 | | 12/1995 |
| JP | H07-314865 | | 12/1995 |
| JP | 8-25768 | | 1/1996 |
| JP | 8-39909 | | 2/1996 |

(56) References Cited

FOREIGN PATENT DOCUMENTS

| | | | |
|---|---|---|---|
| JP | 8-58211 | A | 3/1996 |
| JP | 8-118738 | | 5/1996 |
| JP | 08216461 | | 8/1996 |
| JP | 8-252964 | A | 10/1996 |
| JP | 8-267839 | A | 10/1996 |
| JP | 8-290618 | | 11/1996 |
| JP | 09-039347 | | 2/1997 |
| JP | 2596263 | | 4/1997 |
| JP | 9-134557 | | 5/1997 |
| JP | 9-141986 | A | 6/1997 |
| JP | 9-188049 | | 7/1997 |
| JP | 9-188050 | | 7/1997 |
| JP | 10-056604 | A | 2/1998 |
| JP | 10-181063 | A | 7/1998 |
| JP | 11-105351 | | 4/1999 |
| JP | 11-129563 | | 5/1999 |
| JP | 11-263055 | | 9/1999 |
| JP | 11263056 | | 9/1999 |
| JP | 11263056 | A | 9/1999 |
| JP | 2000-25251 | | 1/2000 |
| JP | 2998617 | | 1/2000 |
| JP | 2000-43336 | | 2/2000 |
| JP | 2000-85224 | | 3/2000 |
| JP | 2000-103129 | | 4/2000 |
| JP | 2000-103131 | | 4/2000 |
| JP | 2000-135843 | | 5/2000 |
| JP | 2000-198258 | | 7/2000 |
| JP | 2001-11594 | | 1/2001 |
| JP | 2001-48389 | | 2/2001 |
| JP | 2001-121797 | A | 5/2001 |
| JP | 2001-310540 | | 11/2001 |
| JP | 2001-319447 | | 11/2001 |
| JP | 2002-42441 | | 2/2002 |
| JP | 3266739 | B2 | 3/2002 |
| JP | 2002-104568 | | 4/2002 |
| JP | 2002-179300 | | 6/2002 |
| JP | 2002166605 | | 6/2002 |
| JP | 2002-308481 | | 10/2002 |
| JP | 2002192769 | | 10/2002 |
| JP | 2002-367333 | | 12/2002 |
| JP | 3357128 | | 12/2002 |
| JP | 2003-048337 | A | 2/2003 |
| JP | 3426983 | | 7/2003 |
| JP | 2003-251902 | | 9/2003 |
| JP | 2003-285522 | | 10/2003 |
| JP | 3543659 | | 7/2004 |
| JP | 3567469 | | 9/2004 |
| JP | 2004-291591 | | 10/2004 |
| JP | 2004-323241 | | 11/2004 |
| JP | 2005-088597 | A | 4/2005 |
| JP | 2005-231203 | | 9/2005 |
| JP | 2005-280008 | | 10/2005 |
| JP | 2005297348 | | 10/2005 |
| JP | 4061507 | | 11/2005 |
| JP | 2006096030 | | 4/2006 |
| JP | 2006-142835 | | 6/2006 |
| JP | 2006-182034 | | 7/2006 |
| JP | 2006-240310 | A | 9/2006 |
| JP | 2006-248059 | | 9/2006 |
| JP | 2006-272895 | | 10/2006 |
| JP | 2006-272977 | | 10/2006 |
| JP | 2006-289991 | | 10/2006 |
| JP | 2007-196654 | A | 8/2007 |
| JP | 2007-296863 | | 11/2007 |
| JP | 2008044180 | | 2/2008 |
| JP | 2008-80668 | | 4/2008 |
| JP | 2008-509823 | A | 4/2008 |
| JP | 2008083432 | | 4/2008 |
| JP | 2008094103 | | 4/2008 |
| JP | 2008-229855 | A | 10/2008 |
| JP | 2008265278 | | 11/2008 |
| JP | 2009001020 | | 1/2009 |
| JP | 2009-28976 | | 2/2009 |
| JP | 2009-509812 | A | 3/2009 |
| JP | 2009-184832 | A | 8/2009 |
| JP | 2011-011401 | | 1/2011 |
| JP | 2011011401 | A | 1/2011 |
| JP | 2011-110843 | A | 6/2011 |
| JP | 2011-110845 | A | 6/2011 |
| JP | 2011-110848 | A | 6/2011 |
| WO | 00/32401 | | 6/2000 |
| WO | 0110649 | | 2/2001 |
| WO | 0232680 | | 4/2002 |
| WO | 03/080350 | | 10/2003 |
| WO | 2006/024913 | | 3/2006 |
| WO | 2006/090842 | | 8/2006 |
| WO | 2009/107534 | A1 | 9/2009 |

OTHER PUBLICATIONS

International Preliminary Report on Patentability in PCT/JP2009/071568 on Nov. 15, 2011.

International Preliminary Report on Patentability in PCT/JP2010/055324 on Nov. 15, 2011.

International Preliminary Report on Patentability in PCT/JP2010/055326 on Nov. 15, 2011.

International Preliminary Report on Patentability in PCT/JP2010/050253 on Nov. 15, 2011.

Japanese Office Action in JP 2010-041323 on May 22, 2012.

Japanese Office Action in JP 2010-084499 on Jun. 12, 2012.

Japanese Office Action in JP 2008-331639 on Mar. 27, 2012.

Japanese Office Action in JP 2008-331638 on Mar. 27, 2012.

Japanese Office Action in JP 2009-156405 on Mar. 27, 2012.

Japanese Office Action in JP 2009-156406 on Mar. 27, 2012.

Japanese Office Action in JP 2009-156407 on Mar. 27, 2012.

Japanese Office Action in JP 2009-270221 on Mar. 27, 2012.

Japanese Office Action in JP 2009-086239 on May 8, 2012.

Japanese Office Action in JP 2009-086222 on Jun. 12, 2012.

International Preliminary Report on Patentability in PCT/JP2010/055310 on Apr. 1, 2012.

Japanese Office Action of JP 2010-084500 dated Jul. 3, 2012.

Japanese Office Action of JP 2010-084501 dated Jul. 3, 2012.

Japenese Office Action JP 2010-084502 dated Jul. 3, 2012.

International Preliminary Report on Patentability of PCT/JP2009/071812 dated Aug. 14, 2012.

Japanese Office Action of JP 2009-086172 dated Sep. 11, 2012.

Japanese Office Action of JP 2009-088449 dated Sep. 11, 2012.

European Communication of EP 10711477.9 dated Sep. 6, 2012.

NZ Examination Report of NZ 596044 dated Sep. 28, 2012.

Japanese Office Action of JP 2009-270056 dated Nov. 13, 2012.

Japenese Office Action of JP 2009-297502 dated Nov. 13, 2012.

Japanese Office Action issued in JP Application No. 2011-506968 on Jan. 29, 2013.

Japanese Office Action issued in Japanese Application No. 2009-156398 on Apr. 2, 2013.

Japanese Office Action issued in Japanese Application No. 2009-156403 on Apr. 2, 2013.

Japanese Office Action issued in Japanese Application No. 2009-156281 on Apr. 2, 2013.

Japanese Office Action issued in Japanese Application No. 2009-156355 on Apr. 2, 2013.

Japenese Office Action issued in Japanese Application No. 2009-156399 on Apr. 2, 2013.

Japanese Office Action issued in Japanese Application No. 2009-156404 on Apr. 2, 2013.

Japanese Office Action issued on Japanese Application No. 2009-156350 on Apr. 2, 2013.

Japanese Office Action issued in Japanese Application No. 2009-156357 on Apr. 2, 2013.

Japenese Office Action issued in Japenese Application No. 2009-156371 on on Apr. 2, 2013.

Japanese Office Action issued Japanese Application No. 2009-270325 on Apr. 2, 2013.

Chinese Office Action issued in Chinese Application No. 200980158165.9 on Mar. 8, 2013.

(56) References Cited

OTHER PUBLICATIONS

European Search Report issued in Application No. 09852278.2 on Apr. 8, 2013.
Japanese Office Action issued in Japanese Application No. 2009-154698 on May 21, 2013.
Japanese Office Action issued in Japanese Application No. 2009-154699 on May 21, 2013.
Chinese Office Action issued in Chinese Application No. 200910262676.7 on Apr. 26, 2013.
Japanese Office Action issued in Japanese Application No. 2009-154688 on May 21, 2013.

* cited by examiner

TAPE PRINTER

CROSS-REFERENCE TO RELATED APPLICATION

This application claims priority to Japanese Patent Application Nos. 2008-331634, 2008-331635, 2008-331638, 2008-331639, 2008-331641, 2008-331642, 2008-331643, respectively filed on Dec. 25, 2008, and also claims priority to Japanese Patent Application Nos. 2009-088440, 2009-088441, 2009-088456, 2009-088460, and 2009-088468, respectively filed on Mar. 31, 2009. The disclosure of the foregoing applications is herein incorporated by reference in its entirety.

BACKGROUND

The present invention relates to a tape printer that is configured to removably house a tape cassette therein and that performs printing on a tape included in the tape cassette.

A tape printer is known that performs printing characters such as letters and the like with a print head on a tape that is pulled out from a tape cassette that is installed in a cassette housing portion of the tape printer. The tape printer can use a plurality of tape types of differing widths and structure, and a plurality of tape cassettes are therefore prepared for the tape printer that house the plurality of tape types.

A known printer, for example, detects a type of the tape cassette that is installed in the cassette housing portion with detecting switches that are provided in the cassette housing portion, in accordance with a cassette detection portion that is formed corresponding to the type of the tape. The tape cassette has the cassette detection portion on a section of the bottom surface, where through-holes and non-through-holes are formed in a pattern corresponding to the type of the tape. When the tape cassette is installed in the cassette housing portion, each of the detecting switches, which are constantly urged in an upward direction, opposes the through-hole or the non-through-hole in the cassette detection portion. The tape printer identifies the type of the tape cassette by detecting which of the detecting switches are pressed and which of the detecting switches are not pressed.

SUMMARY

When the tape cassette is installed in the cassette housing portion, in some cases the tape cassette may be slightly inclined inside the cassette housing portion, and is thus not installed at a proper position (the tape cassette is in a so-called raised state). When the tape cassette is in the raised state, the part of the tape on which printing is performed by a print head is also raised in the upward direction. In such cases, an accurate positional relationship between the print head and the tape may not be obtained, and thus the print position on the tape may be misaligned. Consequently, print quality may be deteriorated, and a tape feed failure may occur during printing.

Although the known tape printer described above identifies the type of the tape cassette installed in the cassette housing portion, the tape printer does not determine whether or not the tape cassette is installed at the proper position in the cassette housing portion.

Moreover, the tape printer described above employs, as the detecting switches, mechanical switches that detect whether pins are pressed or not. Accordingly, in a case where all of the detecting switches are in an off state, the tape printer can determine that the tape cassette is not installed. For the mechanical switches, however, an operational range in which it is determined that the switches are in an on state, in other words, in which it is determined that the pins are pressed, are set to a fixed range, depending on a length of the switch pins. As a result, even if the tape cassette is in the raised position inside the cassette housing portion, if the length by which the tape cassette is raised is within the operational range of the mechanical switches, in other words, the tape cassette is raised by such a degree that the pins remain pressed, not all of the switches are turned off. Therefore, in some cases, the tape printer can not detect that the tape cassette is in the raised position.

It is an object of the present invention to provide a tape printer that can recognize whether or not the tape cassette is installed at a proper position in the cassette housing portion.

Exemplary embodiments of the present disclosure provide a tape printer that includes a tape cassette, a cassette housing portion, a feeding device, a printing device, a plurality of detecting switches, a first determining device, and a second determining device. The tape cassette includes a tape roll that is a wound tape as a print medium, and a box-like housing that supports the tape roll therein. In the cassette housing portion, the tape cassette is removably installed. The feeding device pulls out and feeds the tape along a feed path from the housing of the tape cassette installed in the cassette housing portion. The printing device performs printing on the tape fed by the feeding device. The plurality of detecting switches protrudes toward a side surface of the housing of the tape cassette installed in the cassette housing portion. In a case where a part of the plurality of detecting switches is pressed, the first determining device determines that the tape cassette is installed in the cassette housing portion. In a case where a specific detecting switch among the plurality of detecting switches is pressed, the second determining device determines that the tape cassette is not installed at a proper position in the cassette housing portion. The tape cassette also includes a first pressing portion and a second pressing portion. The first pressing portion is provided on the side surface of the housing, and, in a case where the tape cassette is installed at the proper position in the cassette housing portion, presses a part of the plurality of detecting switches. The second pressing portion is provided on the side surface of the housing, and, in a case where the tape cassette is not installed at the proper position in the cassette housing portion, presses the specific detecting switch.

BRIEF DESCRIPTION OF THE DRAWINGS

Exemplary embodiments of the present disclosure will be described below in detail with reference to the accompanying drawings in which.

DETAILED DESCRIPTION OF EXEMPLARY EMBODIMENTS

Figure 1:
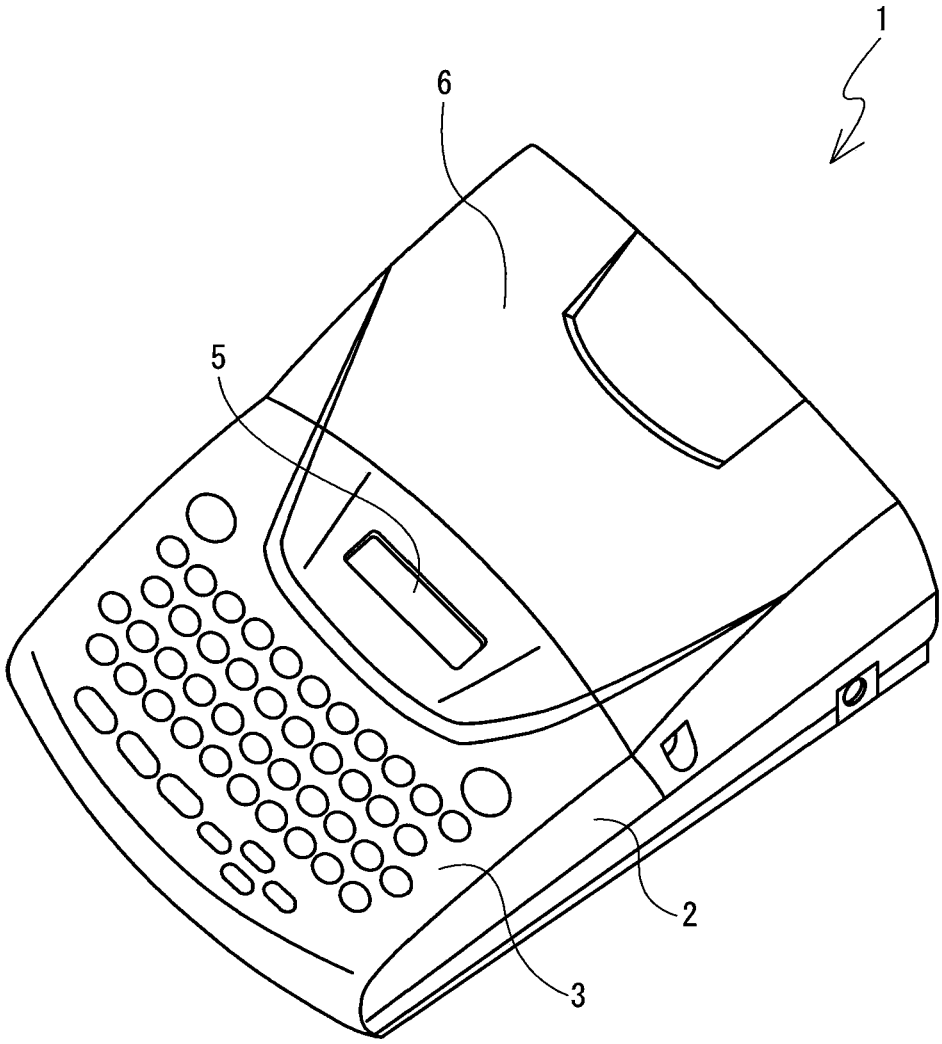
FIG. 1 is a perspective view of a tape printer 1 when a cassette cover 6 is in a closed state.
Figure 2:
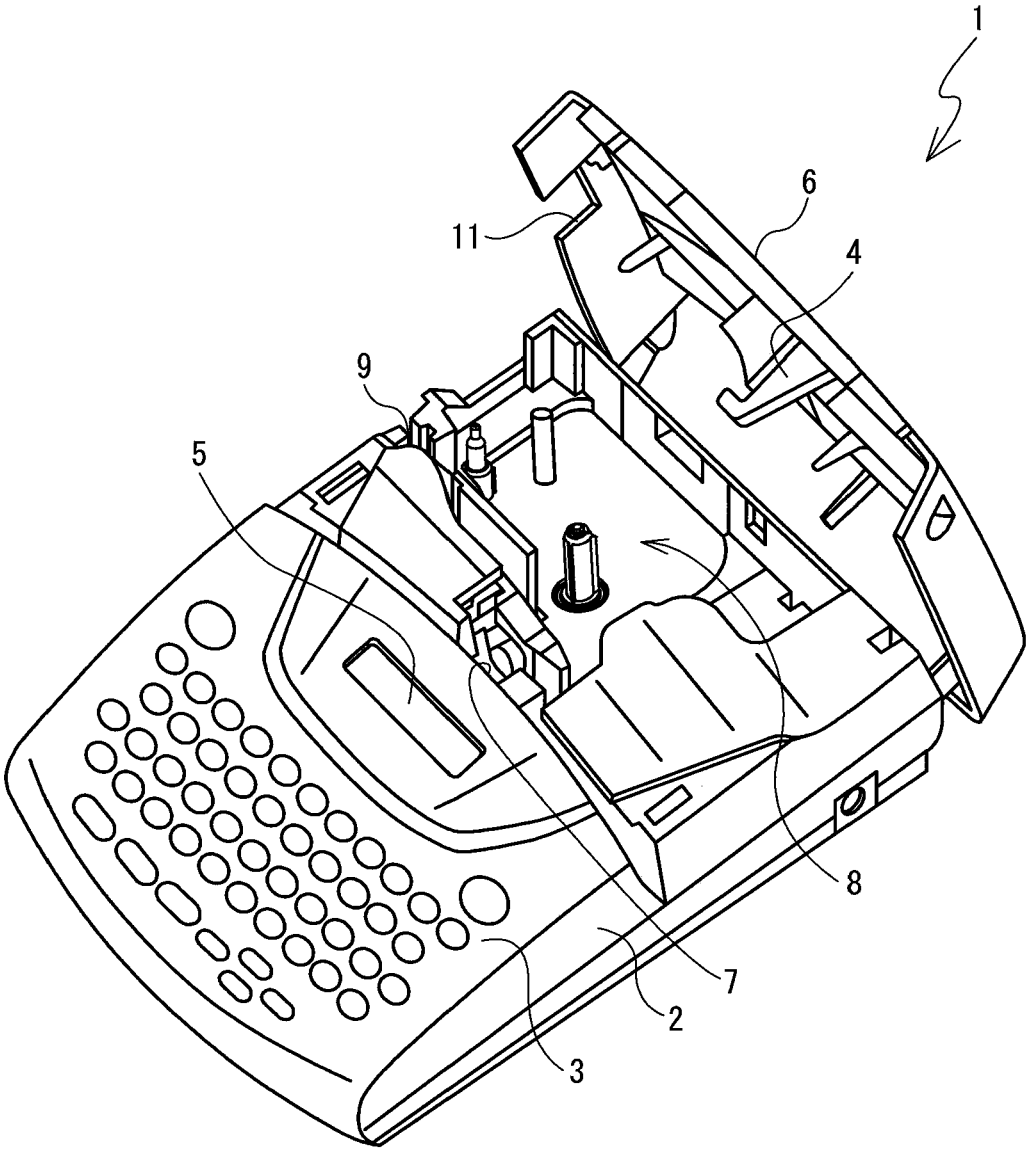
FIG. 2 is a perspective view illustrating the tape printer 1 according to a first embodiment when the cassette cover 6 is in an opened state.
Figure 3:
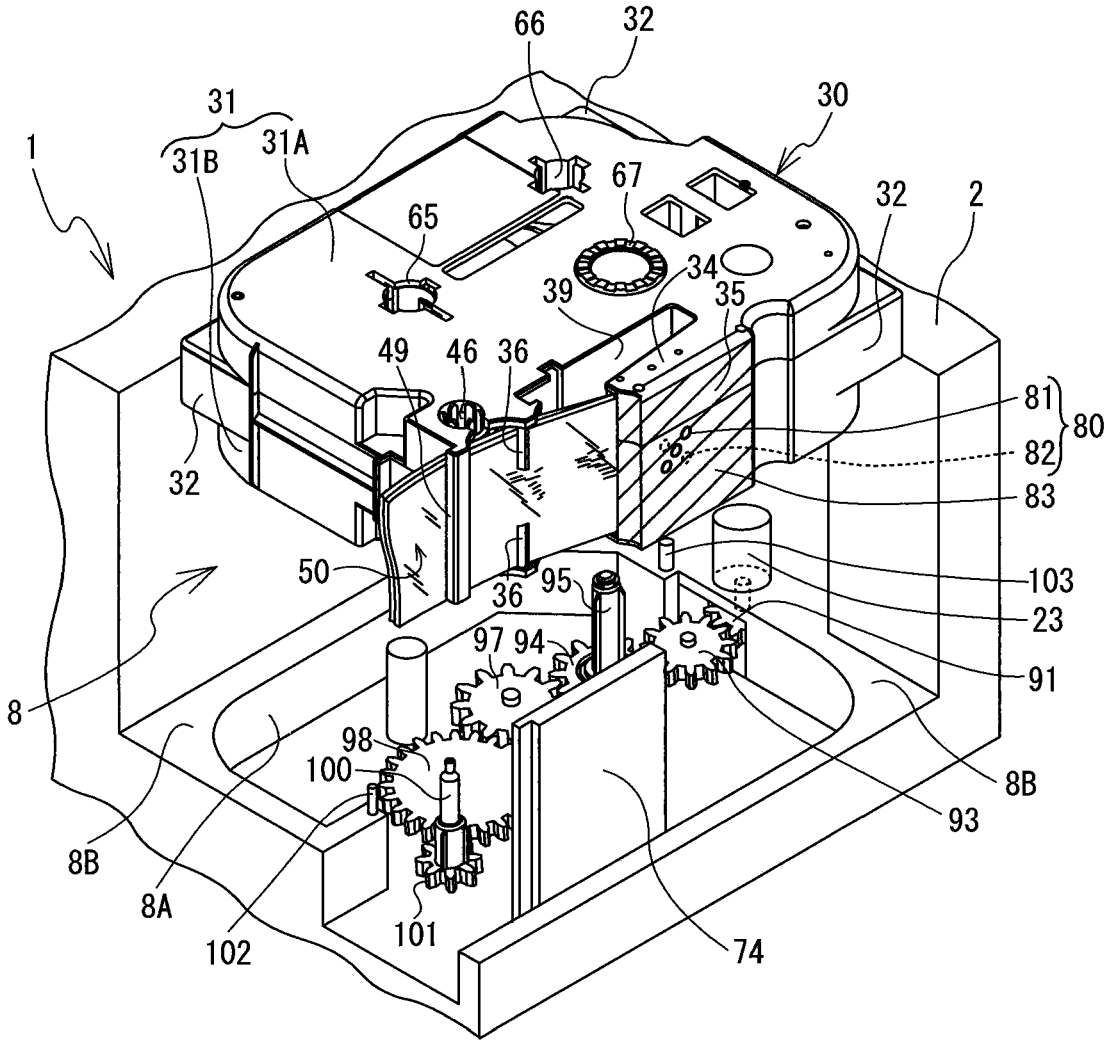
FIG. 3 is a perspective view illustrating a tape cassette 30 and a cassette housing portion 8 according to the first embodiment.

A tape printer 1 and a tape cassette 30 according to a first embodiment of the present invention will be explained below with reference to FIG. 1 to FIG. 16. In the explanation of the present embodiment, the lower left side, the upper right side, the lower right side, and the upper left side in FIG. 1 are respectively defined as the front side, the rear side, the right side, and the left side of the tape printer 1. In addition, the lower right side, the upper left side, upper right side, and the lower left side in FIG. 3 are respectively defined as the front side, the rear side, the right side, and the left side of the tape cassette 30.

In the first embodiment, a first pressing portion 80 is provided on the front surface of the tape cassette 30, and a plurality of detecting switches 20 are provided on a platen holder 12 of the tape printer 1. Further, the tape printer 1 recognizes various types of information relating to the tape cassette 30 installed in the cassette housing portion 8, based on detection results of the detecting switches 20.

First, an outline configuration of the tape printer 1 according to the first embodiment will be explained. As shown in FIG. 1 and FIG. 2, the tape printer 1 is provided with a main unit cover 2 that has a rectangular shape in a plan view. A keyboard 3 is provided on the front side of the main unit cover 2. The keyboard 3 includes character keys for characters (letters, symbols, numerals, and so on), a variety of function keys, and so on. A liquid crystal display 5 is provided on the rear side of the keyboard 3. The liquid crystal display 5 displays input characters. A cassette cover 6 is provided on the rear side of the liquid crystal display 5. The cassette cover 6 may be opened and closed when the tape cassette 30 is replaced.

A cassette housing portion 8 is provided in the interior of the main unit cover 2 below the cassette cover 6. The cassette housing portion 8 is an area in which the tape cassette 30 can be installed or removed. The cassette housing portion 8 is equipped with a feed mechanism that pulls out a tape from the tape cassette 30 and feed the tape, a print mechanism that prints characters on a surface of the tape, of which will be described later.

Further, a discharge slit 9 is provided to the rear of the left side of the main unit cover 2, from which the printed tape is discharged to the outside. Also, a discharge window 11 is formed on the left side of the cassette cover 6, such that, when the cassette cover 6 is in a closed state, the discharge slit 9 is exposed to the outside. A hook-shaped latching lock 4 is provided generally in the center of the front surface of the cassette cover 6. The latching lock 4 protrudes downward s from the bottom surface of the cassette cover 6. A lock hole 7 is provided in the main unit cover 2 at a position corresponding to the latching lock 4. When the cassette cover 6 is closed, the latching lock 4 is fitted into and engages with the lock hole 7, thus preventing the cassette cover 6 from spontaneously opening.

Figure 4:
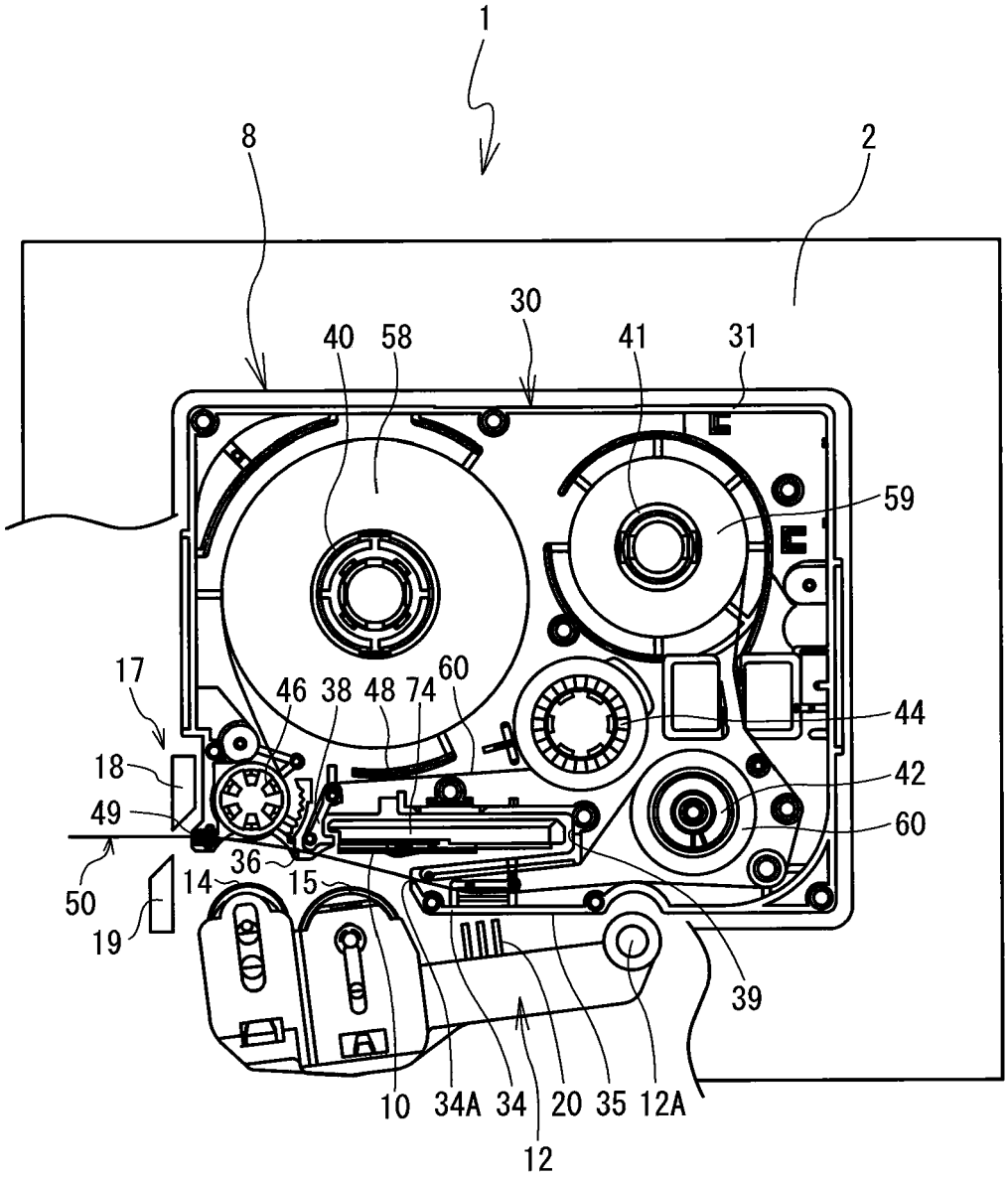
FIG. 4 is a plan view of the cassette housing portion 8 according to the first embodiment with the tape cassette 30 installed, when a platen holder 12 is at a standby position.
Figure 5:
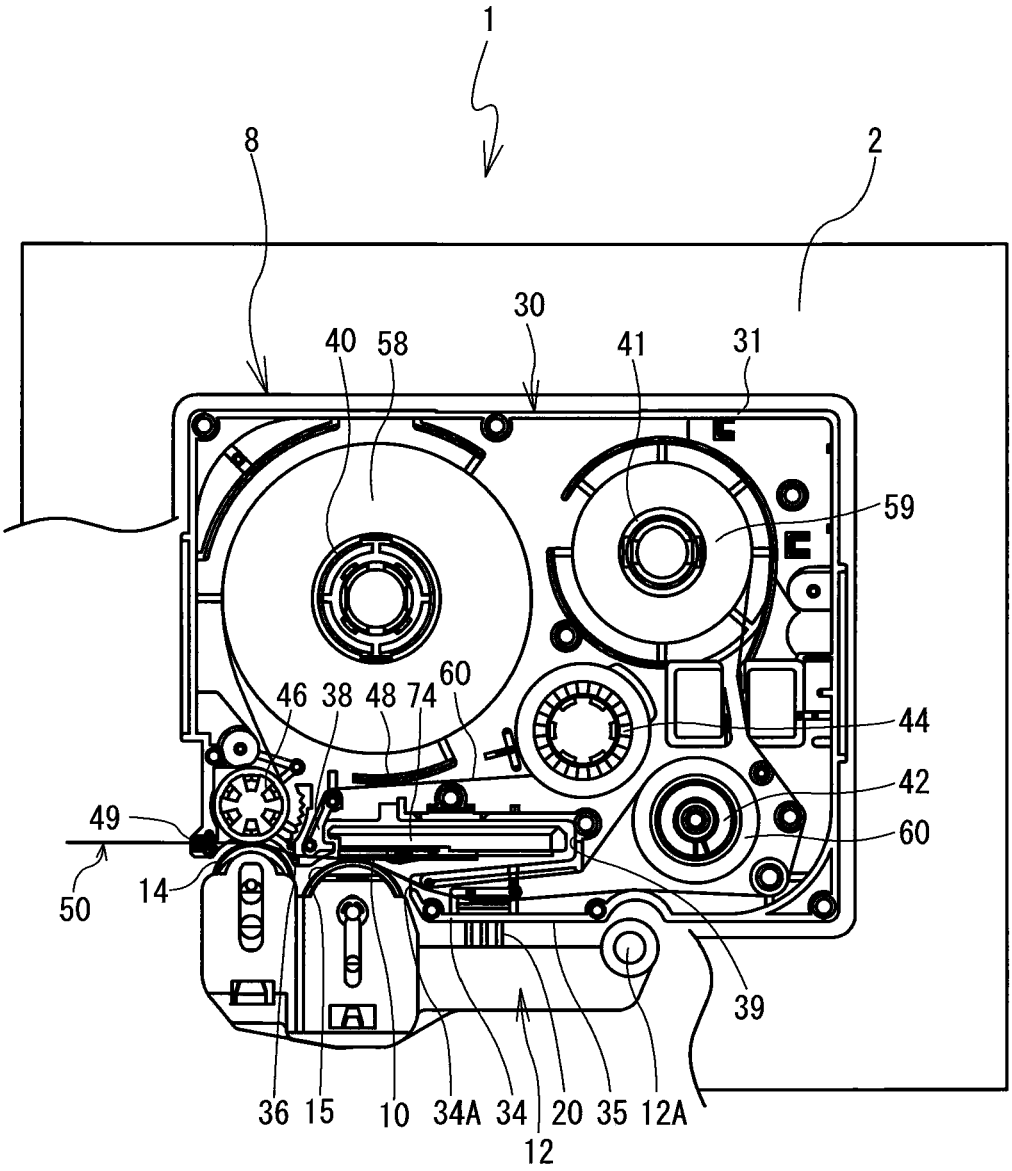
FIG. 5 is a plan view of the cassette housing portion 8 according to the first embodiment with the tape cassette 30 installed, when the platen holder 12 is at a print position.

Next, an internal configuration of the main unit cover 2 will be explained, centering on the cassette housing portion 8. As shown in FIG. 3 to FIG. 5, a head holder 74 is fixed in the front part of the cassette housing portion 8, and a thermal head 10 that includes a heating element (not shown in the figures) is mounted on the head holder 74. A tape feed motor 23 that is a stepping motor is provided outside of the cassette housing portion 8 (the upper right side in FIG. 2). A drive gear 91 is anchored to the lower end of a drive shaft of the tape feed motor 23.

The drive gear 91 is meshed with a gear 93 through an opening, and the gear 93 is meshed with a gear 94. A ribbon take-up shaft 95 is standing upward on the upper surface of the gear 94. The ribbon take-up shaft 95 drives the rotation of a ribbon take-up spool 44, which will be described later. In addition, the gear 94 is meshed with a gear 97, the gear 97 is meshed with a gear 98, and the gear 98 is meshed with a gear 101. A tape drive shaft 100 is standing upward on the upper surface of the gear 101. The tape drive shaft 100 drives the rotation of a tape drive roller 46, which will be described later.

If the tape feed motor 23 is driven to rotate in the counterclockwise direction in a state where the tape cassette 30 is installed in the cassette housing portion 8, the ribbon take-up shaft 95 is driven to rotate in the counterclockwise direction via the drive gear 91, the gear 93 and the gear 94. The ribbon take-up shaft 95 causes the ribbon take-up spool 44, which is fitted with the ribbon take-up shaft 95, to rotate. Furthermore, the rotation of the gear 94 is transmitted to the tape drive shaft 100 via the gear 97, the gear 98 and the gear 101, to thereby drive the tape drive shaft 100 to rotate in the clockwise direction. The tape drive shaft 100 causes the tape drive roller 46, which is fitted with the tape drive shaft 100 by insertion, to rotate.

Two positioning pins 102 and 103 are provided at two positions on the periphery of the cassette housing portion 8. The positioning pins 102 and 103 are provided at locations such that, when the tape cassette 30 is installed in the cassette housing portion 8, the positioning pins 102 and 103 respectively oppose two pin holes (not shown in the figures) formed in the bottom surface of the tape cassette 30. The positioning pins 102 and 103 serve to position the tape cassette 30 installed in the cassette housing portion 8 at a proper position inside the cassette housing portion 8.

On the front side of the head holder 74, an arm shaped platen holder 12 is pivotably supported around a support shaft 12A. A platen roller 15 and a movable feed roller 14 are both rotatably supported on the leading end of the platen holder 12. The platen roller 15 faces the thermal head 10, and may be moved close to and apart from the thermal head 10. The movable feed roller 14 faces the tape drive roller 46 that may be fitted with the tape drive shaft 100, and may be moved close to and apart from the tape drive roller 46.

A release lever (not shown in the figures), which moves in the right-and-left direction in response to the opening and closing of the cassette cover 6, is coupled to the platen holder 12. When the cassette cover 6 is opened, the release lever moves in the right direction, and the platen holder 12 moves toward the stand-by position shown in FIG. 4. At the stand-by position shown in FIG. 4, the platen holder 12 is positioned at an interval from the cassette housing portion 8. Therefore, the tape cassette 30 can be installed into or removed from the cassette housing portion 8 when the platen holder 12 is at the stand-by position. The platen holder 12 is constantly elastically urged to remain in the stand-by position by a spiral spring that is not shown in the figures.

On the other hand, when the cassette cover 6 is closed, the release lever moves in the left direction and the platen holder 12 moves toward the print position shown in FIG. 5. At the print position shown in FIG. 5, the platen holder 12 is positioned in proximity to the cassette housing portion 8. At the print position, when the tape cassette 30 is installed in the cassette housing portion 8, the platen roller 15 presses the thermal head 10 via a film tape 59 and an ink ribbon 60. At the same time, the movable feed roller 14 presses the tape drive roller 46 via a double-sided adhesive tape 58 and the film tape 59. Thus, at the print position shown in FIG. 5, printing can be performed using the tape cassette 30 installed in the cassette housing portion 8. The double-sided adhesive tape 58, the film tape 59 and the ink ribbon 60 will be explained in more detail later.

A feed path along which a printed tape 50 is fed extends from a tape discharge aperture 49 to a discharge slit 9. A cutting mechanism 17 that cuts the printed tape 50 at a predetermined position is provided on the feed path. The cutting mechanism 17 includes a fixed blade 18 and a movable blade 19 that opposes the fixed blade 18 and that is supported such that it can move in the back-and-forth direction (in the up-and-down direction in FIG. 4 and FIG. 5). The movable blade 19 is moved in the back-and-forth direction by a cutter motor 24 (refer to FIG. 6).

The cassette housing portion 8 includes a concave portion 8A and a cassette support portion 8B. The concave portion 8A has a generally rectangular shape with rounded corners in a plan view, so that the concave portion 8A corresponds generally to the plan view shape of a cassette case 31, which will be described later, when the tape cassette 30 is installed. The cassette support portion 8B is a flat surface extending from the concave portion 8A. When the tape cassette 30 is installed in the cassette housing portion 8, the cassette support portion 8B supports a common portion 32 (to be described later) of the tape cassette 30 from underneath.

Five detecting switches 20 are provided on the rear side surface of the platen holder 12, namely, the surface on the side opposing the thermal head 10. The detecting switches 20 are provided generally in a central position in the longitudinal direction of the rear side surface of the platen holder 12 and protrude toward the cassette housing portion 8 in a generally horizontal manner. In other words, the detecting switches 20 protrude in a direction that is generally perpendicular to a direction of insertion and removal (the up-and-down direction in FIG. 3) of the tape cassette 30 with respect to the cassette housing portion 8, such that the detecting switches 20 oppose the front surface (more specifically, an arm side surface 35 which will be described later) of the tape cassette 30 installed in the cassette housing portion 8. When the tape cassette 30 is installed in the cassette housing portion 8 at a proper position, the detecting switches 20 are respectively positioned at a height facing the common portion 32, which will be described later.

Figure 7:
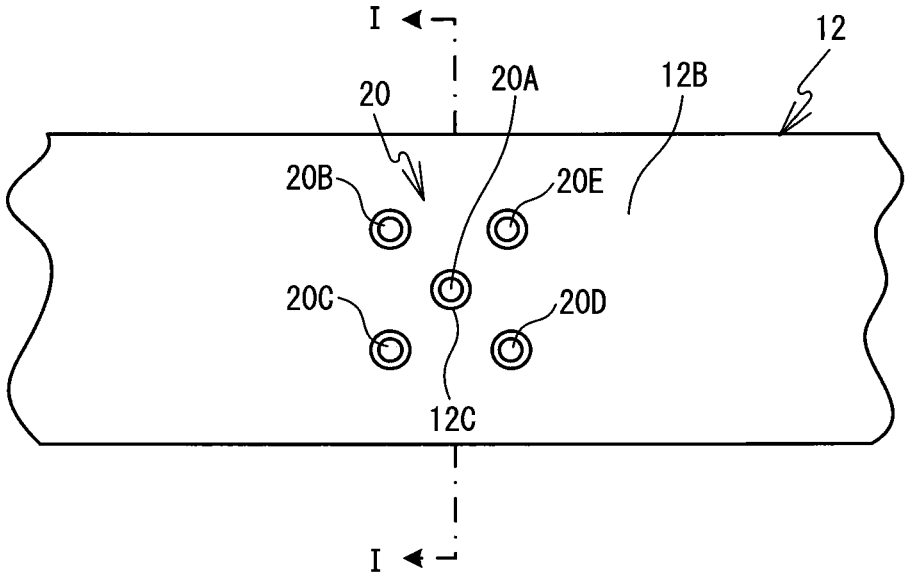
FIG. 7 is a rear view of a section of a platen holder 12 on which are provided a plurality of detecting switches 20.
Figure 8:
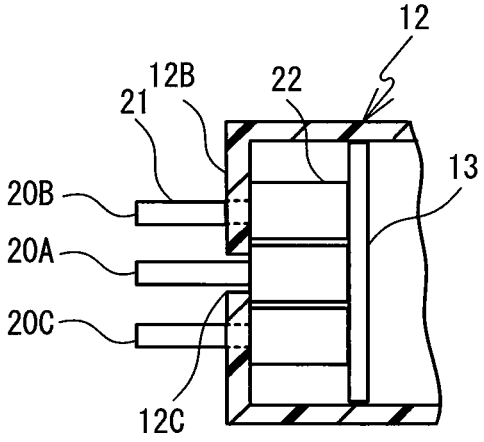
FIG. 8 is a cross-sectional view along a I-I line shown in FIG. 7 as seen in the direction of the arrows.

The arrangement and structure of the detecting switches 20 will be explained in more detail with reference to FIG. 7 and FIG. 8. As shown in FIG. 7 and FIG. 8, each of the detecting switches 20 includes a generally cylindrically shaped main unit 22 and a switch terminal 21. The main unit 22 is positioned inside the platen holder 12. The bar-shaped switch terminal 21 can extend and retract in the direction of an axis line from one end of the main unit 22. The other end of the main unit 22 of the detecting switch 20 is attached to a switch support plate 13 and positioned inside the platen holder 12. The switch terminals 21 can extend and retract through the through-holes 12C formed in the rear side surface 12B of the platen holder 12 (hereinafter referred to as a cassette-facing surface 12B).

Each of the switch terminals 21 is constantly maintained in a state in which the switch terminal 21 extends from the main unit 22 due to a spring member provided inside the main unit 22 (not shown in the figures). When the switch terminal 21 is not pressed, the switch terminal 21 remains extended from the main unit 22 to be in an off state. On the other hand, when the switch terminal 21 is pressed, the switch terminal 21 is pushed back into the main unit 22 to be in an on state.

In the present embodiment, five detecting switches 20A to 20E are provided on the cassette-facing surface 12B of the platen holder 12. More specifically, the four detecting switches 20B to 20E are arranged peripherally around the center detecting switch 20A at generally uniform intervals. In other words, when seen from the back (refer to FIG. 7), the four detecting switches 20B to 20E are each arranged to form each corner point of a square shape. The detecting switch 20A is arranged at an intersection of a line that connects the detecting switches 20B and 20D and a line that connects the detecting switches 20C and 20E.

If the platen holder 12 moves toward the stand-by position (refer to FIG. 4) in a state where the tape cassette 30 is installed in the cassette housing portion 8, all the detecting switches 20A to 20E are separated from the tape cassette 30. Consequently, all the detecting switches 20A to 20E are therefore in the off state. On the other hand, if the platen holder 12 moves toward the print position (refer to FIG. 5), the detecting switches 20A to 20E oppose the front surface (more specifically, the arm side surface 35 that will be described later) of the tape cassette 30 and the detecting switches 20A to 20E are selectively pressed. Consequently, a part of or all of the detecting switches 20A to 20E are changed to the on state, as described later.

The configuration of the tape cassette 30 according to the first embodiment will be explained below. As shown in FIG. 3 to FIG. 5, the tape cassette 30 of the present embodiment includes a cassette case 31 that is a housing having a generally rectangular parallelepiped shape. The cassette case 31 includes a bottom case 31B and the top case 31A that is fixed to an upper portion of the bottom case 31B.

In a rear left portion of the cassette case 31, an adhesive tape spool 40, on which the double-sided adhesive tape 58 is wound with its release paper facing outward, is rotatably supported by support holes 65. In a rear right portion of the cassette case 31, a film tape spool 41, on which the film tape 59 is wound, is rotatably supported by the support holes 66. In a front right portion of the cassette case 31, a ribbon spool 42, on which the ink ribbon 60 is wound, is rotatably provided.

Between the adhesive tape spool 40 and the ribbon spool 42 in the cassette case 31, the ribbon take-up spool 44 is rotatably supported by the support holes 67. The ribbon take-up spool 44 pulls out the ink ribbon 60 from the ribbon spool 42 and takes up the ink ribbon 60 that has been used to print the characters. A clutch spring (not shown in the figures) is attached to a lower portion of the ribbon take-up spool 44 to prevent loosening of the taken up ink ribbon 60 due to a reverse rotation of the ribbon take-up spool 44.

An arm portion 34 is provided on the front right side of the tape cassette 30. The arm portion 34 is folded back at the right side at a right angle and extends toward the center of the tape cassette 30. The film tape 59 that has been pulled out from the film tape spool 41 and the ink ribbon 60 that has been pulled out from the ribbon spool 42 are both guided inside the arm portion 34. Then, a space that is defined by an internal wall of the arm portion 34 and a wall that opposes the internal wall is a head insertion portion 39. The thermal head 10 of the tape printer 1 is inserted into the head insertion portion 39. Further, an exit 34A is provided at the leading end of the arm portion 34. The film tape 59 and the ink ribbon 60 that have been joined are discharged from the exit 34A toward the head insertion portion 39.

The structure that guides the film tape 59 and the ink ribbon 60 in the arm portion 34 will be explained with reference to FIG. 9. A part of the bottom case 31B that forms the arm portion 34 includes an external wall 34B, an internal wall 34C, and a separating wall 34D. The internal wall 34C is higher than the external wall 34B and has approximately the same height as a width of the ink ribbon 60 (hereinafter referred to as a ribbon width). The separating wall 34D stands between the external wall 34B and the internal wall 34C, and has the same height as the internal wall 34C. A pair of guide regulating pieces 34E are formed on the lower edges of both sides of the separating wall 34D.

A guide pin 34G is provided at the upstream side (the right side in FIG. 9) of the separating wall 34D in the arm portion 34 of the bottom case 31B. A guide regulating piece 34F is provided on the lower edge of the guide pin 34G. A matching pair of guide regulating pieces 34H are provided in a part of the top case 31A that forms the arm portion 34, respectively corresponding to the pair of guide regulating pieces 34E provided on the lower edges of both sides of the separating wall 34D.

When the top case 31A and the bottom case 31B are joined to form the cassette case 31, a tape feed path and a ribbon feed path are formed inside the arm portion 34. The tape feed path guides the film tape 59 with the external wall 34B, the separating wall 34D, and the guide pin 34G. The ribbon feed path guides the ink ribbon 60 with the internal wall 34C and the separating wall 34D.

While the lower edge of the film tape 59 is regulated by the guide regulating piece 34F, the direction of the film tape 59 is changed by the guide pin 34G. The film tape 59 is fed further while regulated in the tape width direction by each of the guide regulating pieces 34E on the lower edges of the separating wall 34D working in concert with each of the guide regulating pieces 34H of the top case 31A. In such a way, the film tape 59 is guided and fed between the external wall 34B and the separating wall 34D inside the arm portion 34. The ink ribbon 60 is guided by the separating wall 34D and the internal wall 34C that has approximately the same height as the ribbon width, and is thus guided and fed between the internal wall 34C and the separating wall 34D inside the arm portion 34. In the arm portion 34, the ink ribbon 60 is regulated by the bottom surface of the top case 31A and the top surface of the bottom case 31B in the ribbon width direction.

With the structure described above, the tape feed path and the ribbon feed path are formed as different feed paths separated by the separating wall 34D inside the arm portion 34. Therefore, the film tape 59 and the ink ribbon 60 may be reliably and independently guided within each of the feed paths that correspond to the respective tape width and ribbon width.

Because the ink ribbon 60 is guided by the internal wall 34C and the separating wall 34D provided in the arm portion 34 of the bottom case 31B, the ink ribbon 60 may be set in the bottom case 31B alone. In such a case, the ink ribbon 60 may be free from being wrinkled by the top case 31A, or being nipped between the top case 31A and the bottom case 31B when the top case 31A and the bottom case 31B are joined together.

The internal wall 34C and the separating wall 34D may be formed with a greater height than the external wall 34B of the bottom case 31B, in accordance with the ribbon width of the ink ribbon 60. Therefore, only the height of the necessary portions may be increased in the bottom case 31B. As a consequence, other portions may be formed in accordance with the height of the external wall 34B and a balance with respect to a wall height of the top case 31A. Therefore, it may not be necessary to increase the height of the bottom case 31B as a whole in line with the height of the internal wall 34C and the separating wall 34D. Thus, the bottom case 31B may be formed easily, without having any particular trouble in molding.

As explained above, the arm portion 34 is a final guiding portion for discharging the film tape 59 and the ink ribbon 60 toward the head insertion portion 39 through the exit 34A. For that reason, the positional relationships in the height direction between the thermal head 10 inserted in the head insertion portion 39 and the film tape 59 and the ink ribbon 60 are determined by the arm portion 34. Therefore, if the arm portion 34 is not properly installed in the cassette housing portion 8, an error may occur in the positional relationship between the film tape 59, the ink ribbon 60, and the thermal head 10, and printing may be performed in a misaligned position relative to the tape width direction (the height direction) of the film tape 59.

Considering this situation, in the present embodiment, the first pressing portion 80 that will be described later is provided on the arm side surface 35 of the arm portion 34, which is in the vicinity of the head insertion portion 39 into which the thermal head 10 is inserted. Thus, the arm portion 34 (more specifically, the arm side surface 35) forms the basis for easy detection of an error in the positional relationship with the thermal head 10, and, printing accuracy with respect to the film tape 59 may be improved by determining whether or not the tape cassette 30 is installed in the cassette housing portion 8 at the proper position.

As shown in FIG. 3 to FIG. 5, along the feed paths of the film tape 59 and the ink ribbon 60 from the exit 34A of the arm portion 34 to the tape discharge aperture 49, the support holes are provided on the downstream side of the head insertion portion 39 in the feed direction. The tape drive roller 46 is rotatably supported inside the support holes. The tape drive roller 46, by moving in concert with the opposing movable feed roller 14, pulls out the film tape 59 from the film tape spool 41. At the same time, the tape drive roller 46, by moving in concert with the opposing movable feed roller 14, pulls out the double-sided adhesive tape 58 from the adhesive tape spool 40, then guides the double-sided adhesive tape 58 to the print surface of the film tape 59 and bond the double-sided adhesive tape 58 and the film tape 59 together.

A pair of regulating members 36 that match in the vertical direction are provided on the upstream side of the tape drive roller 46. The regulating members 36 regulate the printed film tape 59 on the downstream side of the thermal head 10 in the tape width direction, and guide the printed film tape 59 toward the tape discharge aperture 49. The regulating members 36 bond the film tape 59 and the double-sided adhesive tape 58 together appropriately without making any positional displacement.

A guide wall 38 is standing in the vicinity of the regulating members 36. The guide wall 38 separates the used ink ribbon 60 that has been fed via the head insertion portion 39 from the film tape 59, and guides the used ink ribbon 60 toward the ribbon take-up spool 44. A separating wall 48 is standing between the guide wall 38 and the ribbon take-up spool 44. The separating wall 48 prevents mutual contact between the used ink ribbon 60 that is guided along the guide wall 38 and the double-sided adhesive tape 58 that is wound on and supported by the adhesive tape spool 40.

As described above, the cassette case 31 is overall a generally square-shaped housing with rounded corner portions in a plan view. At a predetermined height of specific corners of the cassette case 31 (more specifically, corners on which the tape discharge aperture 49 is not provided), the common portions 32 each protrude in an outward direction to form a right angle when seen in a plan view. When the tape cassette 30 is installed in the cassette housing portion 8, the common portions 32 are supported from below in the cassette housing portion 8 by the above-described cassette support portion 8B.

Figure 10:
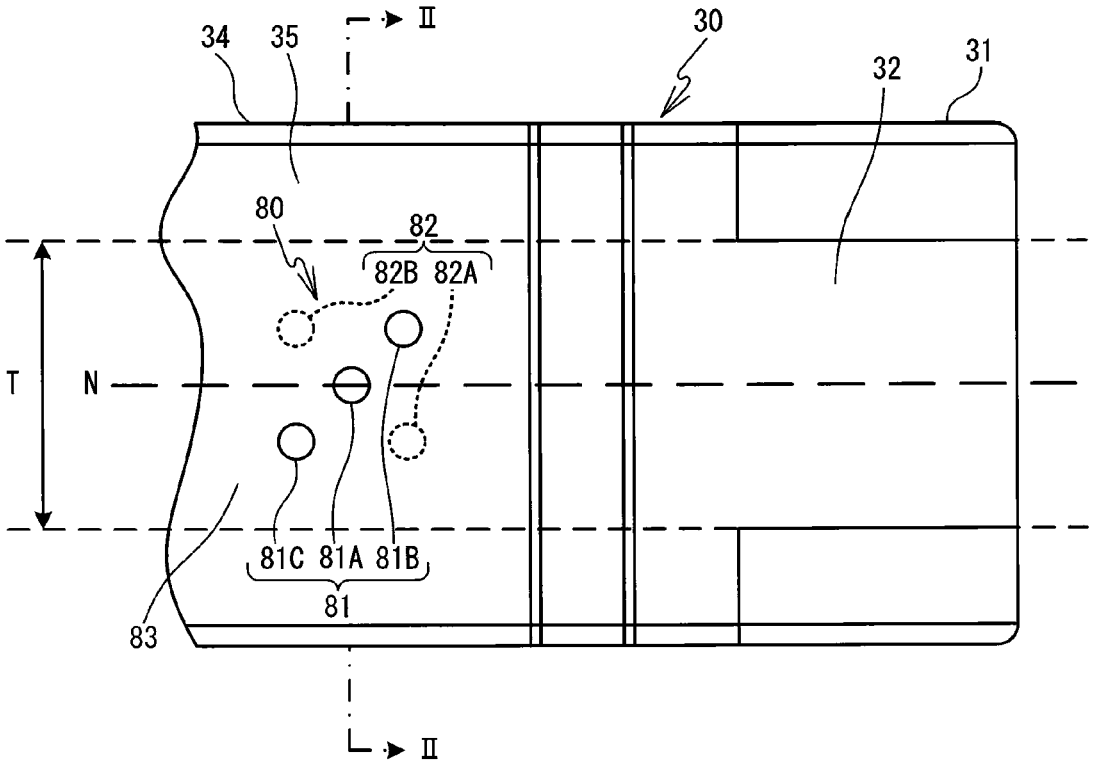
FIG. 10 is a front view of a section of an arm side surface 35 on which is provided a first pressing portion 80.

More specifically, as shown in FIG. 10, the common portion 32 is a portion that has a height T that and is formed symmetrically in the vertical direction with respect to a center line N that indicates the center of the cassette case 31 in the height (width) direction. The height T of the common portion 32 is set to be the same, regardless of the width of the film tape 59 or the double-sided adhesive tape 58 (in other words, the printed tape 50).

For example, when the height T of the common portion 32 is 12 mm, as the width of the printed tape 50 is larger (18 mm, 24 mm, 36 mm, for example), the height (width) of the cassette case 31 becomes accordingly larger, but the height T of the common portion 32 remains constant. If the width of the printed tape 50 is equal to or less than the height T (6 mm, 12 mm, for example), the height of the cassette case 31 is the width T of the common portion 32 (12 mm) plus a predetermined width.

When the platen holder 12 moves toward the print position in a state where the tape cassette 30 is installed in the cassette housing portion 8, the detecting switches 20 oppose the front surface of the cassette case 31 (more specifically, the arm side surface 35 that corresponds to the external wall 34B of the arm portion 34). The first pressing portion 80 is provided on the arm side surface 35. In the first pressing portion 80, switch holes are formed in a pattern corresponding to the type of the tape cassette 30 (a tape width and a tape type, for example).

In the present embodiment, the arm side surface 35 is a shaded portion in FIG. 3. As shown in FIG. 3 and FIG. 9, a semi-circular groove 34K that has a semi-circular shape in a plan view is provided in the front surface (the external wall 34B) of the arm portion, and extends over the height of the arm portion 34 (in other words, extends from the top edge to the bottom edge of the arm portion 34). The semi-circular groove 34K is a recess that serves to prevent an interference between the shaft support 12A and the cassette case 31 when the tape cassette 30 is installed in the cassette housing portion 8. The shaft support 12A is the center of rotation of the platen holder 12. Of the front surface of the arm portion 34, the arm side surface 35 is a section that extends between the exit 34A and the semi-circular groove 34K.

Figure 11:
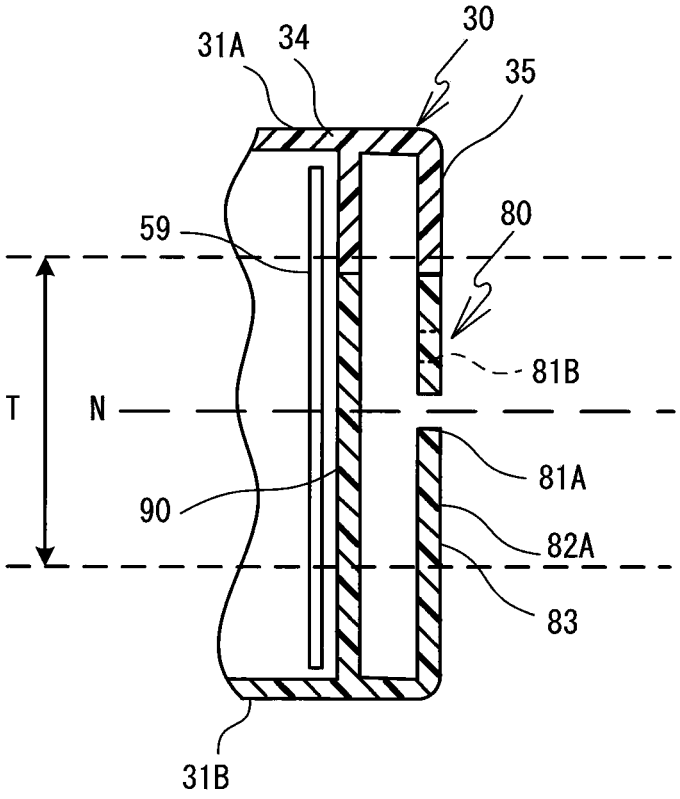
FIG. 11 is a cross-sectional view along a II-II line shown in FIG. 10 as seen in the direction of the arrows.

The structure of the first pressing portion 80 will be explained in detail in relation to the detecting switches 20, with reference to FIG. 10 to FIG. 15. As shown in FIG. 10 and FIG. 11, the first pressing portion 80 includes a plurality of detection portions that respectively correspond to the plurality of detecting switches 20. Each of the detection portions is formed as one of a non-pressing portion 81 and a normal-pressing portion 82. The non-pressing portion 81 is a switch hole through which the switch terminal 21 may be inserted or removed. The normal-pressing portion 82 is a surface portion that does not allow the insertion of the switch terminal 21. In other words, each of the detection portions is a portion that is used in detection by each of the detecting switches 20. On the arm side surface 35, a portion in which no detecting portion (the non-pressing portion 81 or the normal-pressing portion 82) of the first pressing portion 80 is not provided, functions as a second pressing portion 83, which will be explained later.

More specifically, as shown in FIG. 10, each of the detecting portions (the non-pressing portion 81 or the normal-pressing portion 82) of the first pressing portion 80 is provided within a range of the common portion 32 (namely, within the height T) on the arm side surface 35. Preferably, the detecting portions are provided on the center line N that indicates the center of the arm side surface 35 in the height (width) direction of the cassette case 31, or within a range that is symmetrical with respect to the center line N in the vertical direction. In the present embodiment, the detecting portions (the non-pressing portions 81A to 81C and the normal-pressing portions 82A and 82B to be explained later) of the first pressing portion 80 are provided within a specific symmetrical range with respect to the center line N on the arm side surface 35.

As described above, the first pressing portion 80 is provided with the detecting portions (the non-pressing portion(s) 81 and the normal-pressing portion(s) 82) arranged in a pattern that corresponds to the type of the tape cassette 30. However, in the first pressing portion 80 according to the present embodiment, the following two patterns are not adopted. One is a pattern in which all the detection portions corresponding to the detecting switches 20 are the non-pressing portions 81. The other is a pattern in which all the detection portions corresponding to the detecting switches 20 are the normal-pressing portions 82. In other words, the first pressing portion 80 according to the present embodiment includes the detection portions that are arranged in a pattern that includes at least one non-pressing portion 81 and at least one normal-pressing portion 82.

As shown in FIG. 10, the first pressing portion 80 according to the present embodiment has the three non-pressing portions 81A to 81C and the two normal-pressing portions 82A and 82B. The non-pressing portions 81A to 81C and the normal-pressing portions 82A and 82B correspond to the arrangement positions of the five detecting switches 20A to 20E, such that lines connecting each of the detecting portions form an "X" in a front view. The five detecting switches 20A to 20E respectively correspond to the non-pressing portion 81A, the non-pressing portion 81B, the normal-pressing portion 82A, the non-pressing portion 81C and the normal-pressing portion 82B.

Figure 12:
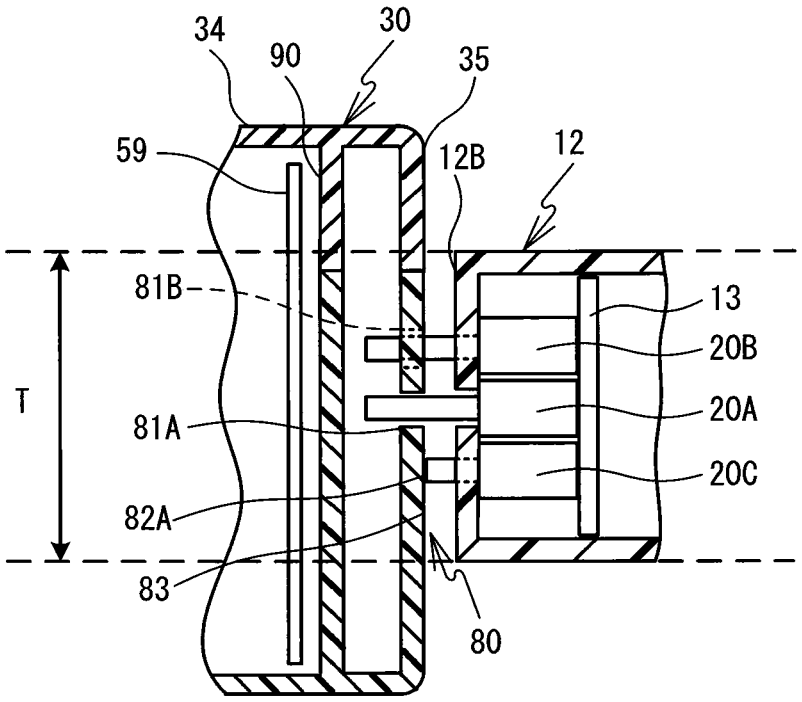
FIG. 12 is a side cross-sectional view illustrating a case in which the tape cassette 30 and the platen holder 12 according to the first embodiment are in an opposing state.

As shown in FIG. 12, if the platen holder 12 moves toward the print position in a state where the tape cassette 30 is properly installed (namely, if the tape cassette 30 is installed in the cassette housing portion 8, and the cassette case 31 is placed at the proper position with respect to the cassette housing portion 8), the detecting switches 20 respectively oppose the detecting portions (the non-pressing portions 81 and the normal-pressing portions 82) in the first pressing portion 80 on the arm side surface 35. At that time, if the detecting switch 20 opposes the non-pressing portion 81, the switch terminal 21 is inserted into the non-pressing portion 81, and the detecting switch 20 remains in the off state. If the detecting switch 20 opposes the normal-pressing portion 82, the switch terminal 21 is pressed by the normal-pressing portion 82 and is thus changed to the on state.

In the example shown in FIG. 12, the switch terminals 21 of the detecting switches 20A and 20B are respectively inserted into the non-pressing portions 81A and 81B, and thus the detecting switches 20A and 20B are in the off state. The switch terminal 21 of the detecting switch 20C is pressed by the normal-pressing portion 82A and the detecting switch 20C is thus in the on state. Although not shown in the figures, The switch terminal 21 of the detecting switch 20D is inserted into the non-pressing portion 81C and the detecting switch 20D is thus in the off state, and the detecting switch 20E is pressed by the normal-pressing portion 82B and is thus in the on state. As a consequence, based on detection results that indicate that the detecting switches 20C and 20E are in the on state, information relating to the tape cassette 30 is obtained in the tape printer 1, as will be explained in more detail later.

Figure 13:
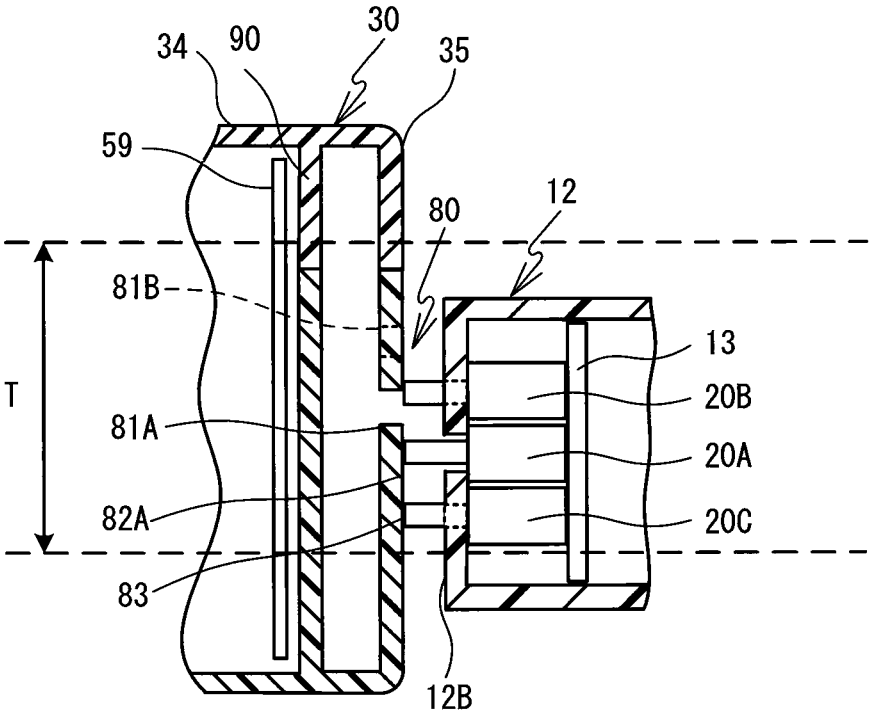
FIG. 13 is a side cross-sectional view illustrating another case in which the tape cassette 30 and the platen holder 12 according to the first embodiment are in the opposing state.

On the other hand, as shown in FIG. 13, in a case where the tape cassette 30 is inserted in the cassette housing portion 8, but is displaced or raised within the cassette housing portion 8, due to one of the common portions 32 not being supported by the cassette support portion 8B, for example, the tape cassette 30 is installed at an improper position (in other words, the cassette case 31 is not placed at the proper position with respect to the cassette housing portion 8). In such a state, if the platen holder 12 moves to the print position, the detecting switches 20 do not oppose the first pressing portion 80, namely, the non-pressing portions 81 and the normal-pressing portions 82, but oppose another section of the arm side surface 35, namely, the second pressing portion 83. At that time, the switch terminals 21 of all of the detecting switches 20 are pressed by the second pressing portion 83, and are thus changed to the on state.

Specifically, in contrast to the example shown in FIG. 12, in the example shown in FIG. 13, the detecting switches 20A to 20E and the first pressing portion 80 in the opposing state are misaligned in the vertical direction. For that reason, the detecting switches 20A to 20C respectively oppose different positions that are different from the first pressing portion 80 on the arm side surface 35 (the second pressing portion 83). As a result, the switch terminals 21 of the detecting switches 20A to 20C are pressed by the second pressing portion 83 and the detecting switches 20A to 20C are thus changed to the on state. Although not shown in the figures, the switch terminals 21 of the detecting switches 20D and 20E are also pressed by the second pressing portion 83 in a similar manner and the detecting switches 20D and 20E are thus changed to the on state. As a consequence, based on detection results that indicate that all of the detecting switches 20A to 20E are in the on state, information relating to the tape cassette 30 is obtained in the tape printer 1, as will be explained in more detail later.

Figure 14:
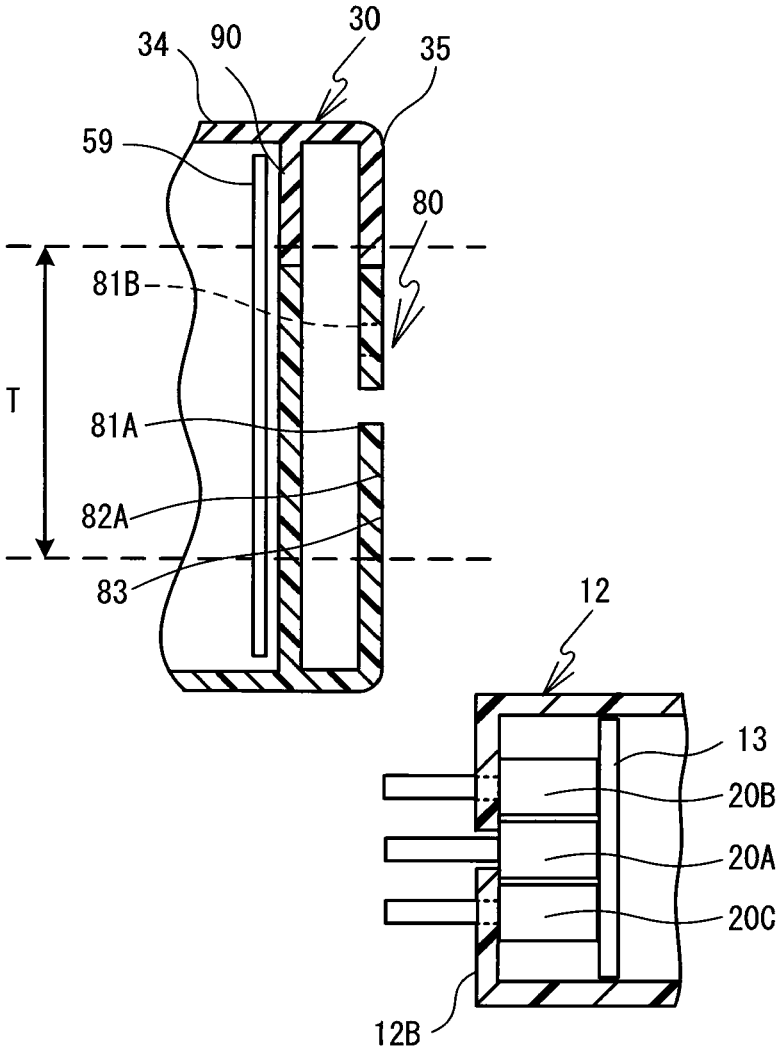
FIG. 14 is a side cross-sectional view illustrating still another case in which the tape cassette 30 and the platen holder 12 according to the first embodiment are in the opposing state.

In the example shown in FIG. 14, the tape cassette 30 is positioned at a height at which the tape cassette 30 does not reach the detecting switches 20A to 20E of the platen holder 12. As a consequence, the detecting switches 20A to 20E do not oppose the arm side surface 35 and are thus all in the off state. Also in this example, based on detection results that indicate that all of the detecting switches 20A to 20E are in the off state, information relating to the tape cassette 30 is obtained in the tape printer 1, as will be explained in more detail later. Note that, usually, when the tape cassette 30 is installed in the cassette housing portion 8, the detecting switches 20A to 20E respectively oppose positions on the arm side surface 35 different to the first pressing portion 80 (namely, the second pressing portion 83) as shown in FIG. 13. Therefore, it may be easy to detect when the tape cassette 30 is not properly installed in the cassette housing portion 8.

Figure 9:
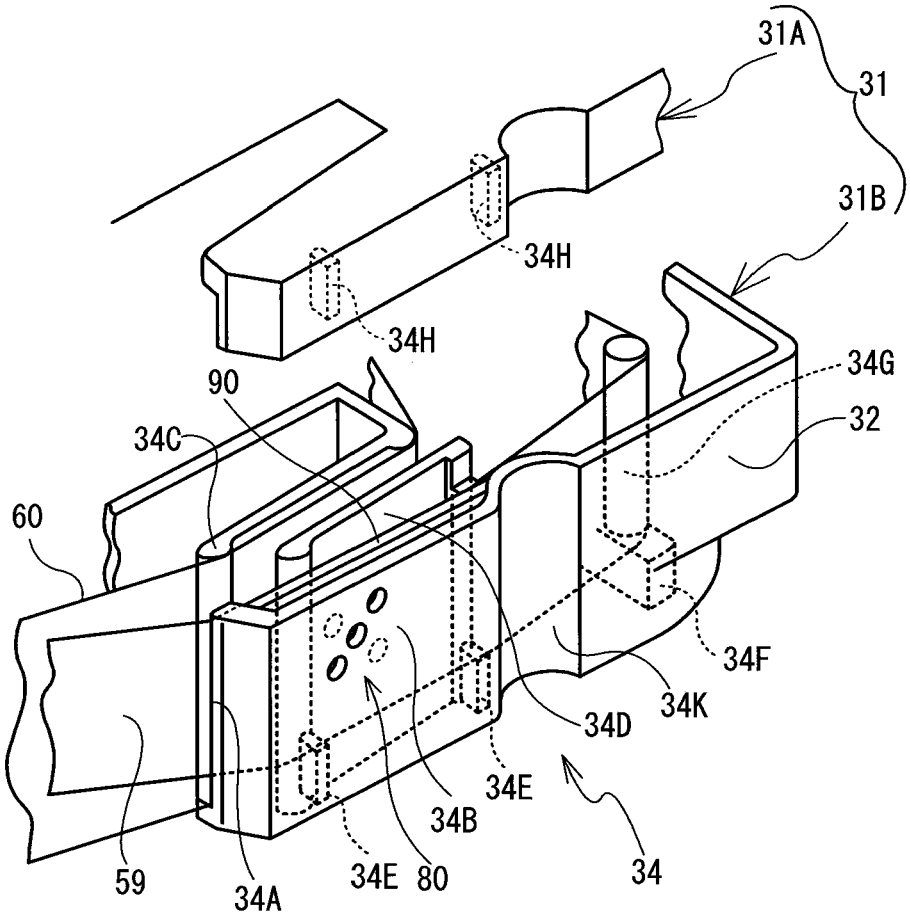
FIG. 9 is an exploded perspective view showing a structure of an arm portion 34.

As shown in FIG. 9 and FIG. 11, inside the tape cassette 30, a thin plate-shaped separating wall 90 is formed between the above-described feed path of the film tape 59 and the arm side surface 35. The separating wall 90 extends from the top surface to the bottom surface of the cassette case 31 and is generally parallel to the print surface of the film tape 59. The separating wall 90 prevents the detecting switch 20, which enters into the arm portion 34 through a non-pressing portion 81 that will be described later, from touching the print surface of the film tape 59. Further, the separating wall 90 guides the film tape 59 smoothly along the feed path inside the arm portion 34.

Figure 15:
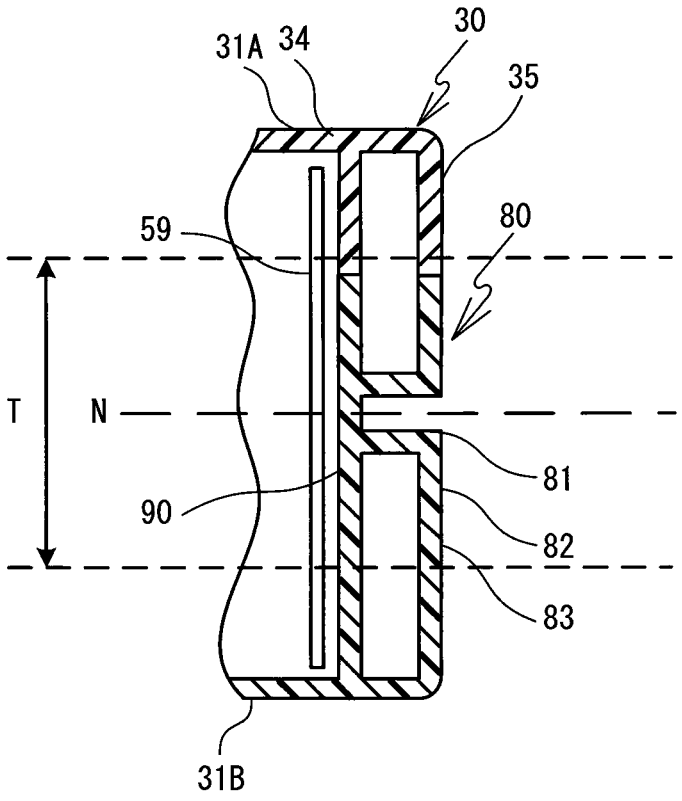
FIG. 15 is a cross-sectional view of another tape cassette 30 along the II-II line shown in FIG. 10 as seen in the direction of the arrows.

In the above-described examples, each of the non-pressing portions 81 (the two non-pressing portions 81A and 81B shown in FIG. 12, and the non-pressing portion 81C not shown in FIG. 12) provided in the first pressing portion 80 is a through-hole formed in the arm side surface 35. However, as shown in FIG. 15, the non-pressing portion 81 in the first pressing portion 80 may be formed as an indentation in the arm side surface 35, for example.

When the tape cassette 30 is installed in the cassette housing portion 8, the common portions 32 provided on the cassette case 31 are supported from underneath by the cassette support portion 8B. Therefore, the tape cassette 30 is supported such that the tape cassette 30 is housed inside the concave section 8A up to a predetermined height position (namely, to the bottom of the common portion 32) from the bottom surface of the cassette case 31. As a consequence, in the cassette housing portion 8, regardless of the thickness of the tape cassette 30 (namely, a height from the bottom surface to the top surface of the cassette case 31), the common portion 32 is maintained at the same height position by the cassette support portion 8B.

When the tape cassette 30 is installed in the cassette housing portion 8, the tape drive shaft 100 is fitted with the tape drive roller 46 by insertion, and the ribbon take-up shaft 95 is fitted with the ribbon take-up spool 44 by insertion. If the cassette cover 6 is then closed, the platen holder 12 moves to the print position and the platen roller 15 faces the thermal head 10. At the same time, the movable feed roller 14 presses the tape drive roller 46. Thus, the tape printer 1 is in a state in which the tape printer 1 can perform printing on the film tape 59.

Furthermore, regardless of the thickness of the tape cassette 30, the height position of the common portion 32 is constant. Therefore, if the tape cassette 30 is installed at the proper position, when the platen holder 12 moves to the print position, the detecting switches 20 respectively oppose the detecting portions (the non-pressing portion(s) 81 and the normal-pressing portion(s) 82) of the first pressing portion 80. On the contrary, if the tape cassette 30 is installed at an improper position, when the platen holder 12 moves to the print position, the detecting switches 20 all face the second pressing portion 83. The tape printer 1 obtains information relating to the tape cassette 30 based on a combination of the on and off states of the detecting switches 20.

The first pressing portion 80 is provided on the arm side surface 35 of the arm portion 34 adjacent to the head insertion portion 39 that faces the thermal head 10. In addition, the detecting switches 20 are provided on the platen holder 12, which can move toward or away from the thermal head 10. For that reason, the tape printer 1 can detect whether the tape cassette 30 is installed at the proper position, using a reference point in the vicinity of the thermal head 10, which has a large impact on print quality. This will be explained in more detail later. In other words, the tape printer 1 detects the tape cassette 30 using the arm portion 34, which regulates the positions of the film tape 59 and the ink ribbon 60 to be used for printing. As a consequence, the tape printer 1 may be able to correctly detect the type and the state of the tape cassette 30 in the vicinity of the thermal head 10, and appropriately perform printing based on the detected information.

When printing is performed in the tape printer 1, the tape drive roller 46, which is driven to rotate via the tape drive shaft 100, pulls out the film tape 59 from the film tape spool 41 by moving in concert with the movable feed roller 14. The ribbon take-up spool 44, which is driven to rotate via the ribbon take-up shaft 95, pulls the unused ink ribbon 60 from the ribbon spool 42 in synchronization with the print speed. The film tape 59 that is pulled out from the film tape spool 41 passes the outer edge of the ribbon spool 42 and is fed along the feed path within the arm portion 34. The film tape 59 is discharged from the exit 34A to the head insertion portion 39 in a state in which the ink ribbon 60 is joined to the surface of the film tape 59 and is then fed between the thermal head 10 and the platen roller 15 of the tape printer 1.

Characters are printed onto the print surface of the film tape 59 by the thermal head 10. Following that, the used ink ribbon 60 is separated from the printed film tape 59 by the guide wall 38 and wound onto the ribbon take-up spool 44.

Meanwhile, the double-sided adhesive tape 58 is pulled out from the adhesive tape spool 40 by the tape drive roller 46 moving in concert with the movable feed roller 14. While being guided and caught between the tape drive roller 46 and the movable feed roller 14, the double-sided adhesive tape 58 is layered onto and affixed to the print surface of the printed film tape 59. The printed film tape 59 to which the double-sided adhesive tape 58 has been affixed (namely, the printed tape 50) is then fed toward the tape discharge aperture 49. After the printed tape 50 is discharged from the tape discharge aperture 49, the printed tape 50 is cut by the cutting mechanism 17.

Figure 6:
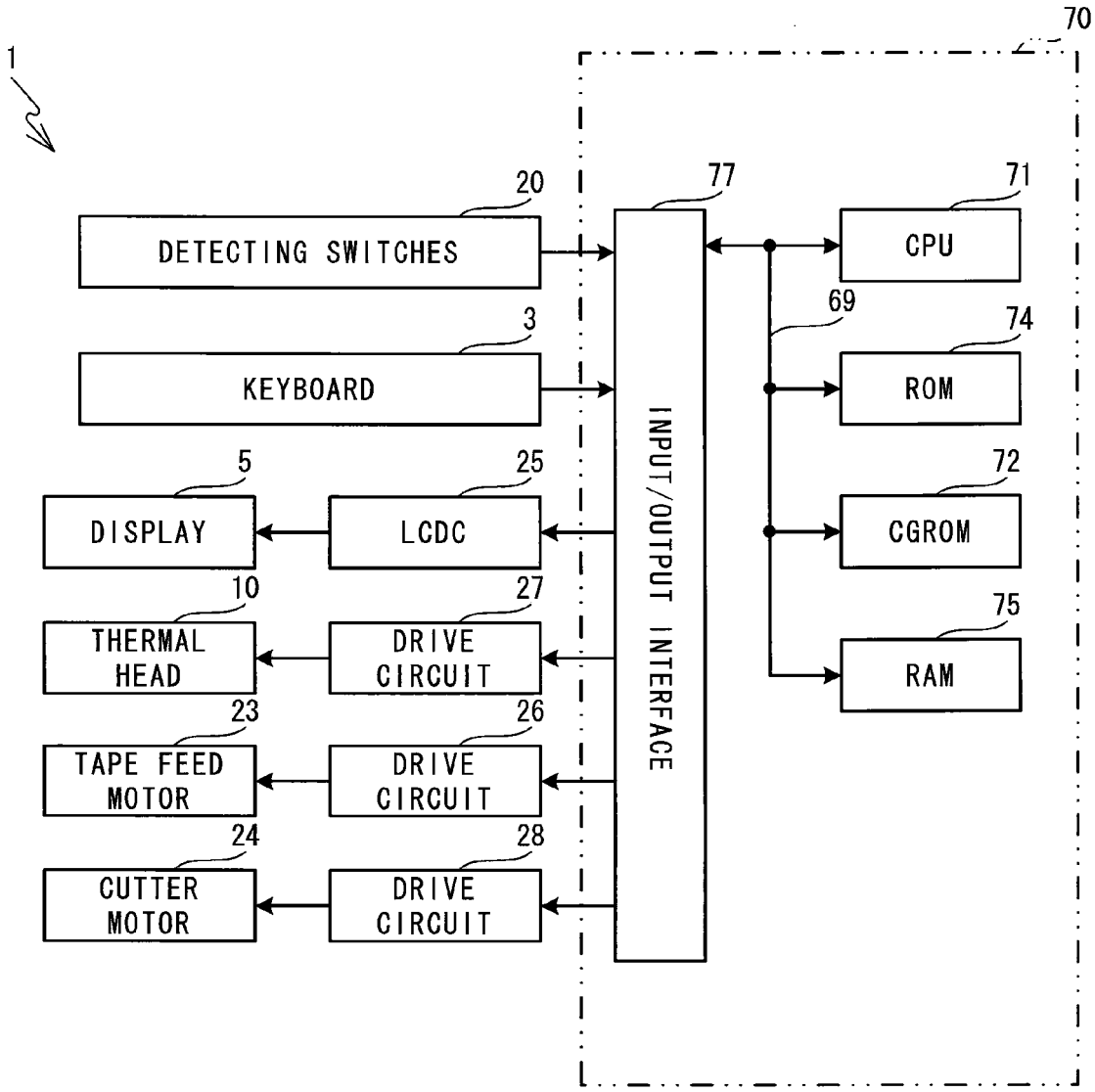
FIG. 6 is a block diagram showing an electrical configuration of the tape printer 1.

Next, the electrical configuration of the tape printer 1 will be explained. As shown in FIG. 6, the tape printer 1 includes a control circuit 70 formed on a control board. The control circuit 70 includes a CPU 71 that controls each instrument, a CGROM 72, a ROM 74, a RAM 75, and an input/output interface 77 that are connected to the CPU 71 via a data bus 69.

The CGROM 72 stores print dot pattern data to be used to print various characters. The print dot pattern data is associated with corresponding code data for the characters. The print dot pattern data is categorized by font (Gothic, Mincho, and so on), and the stored data for each font includes six print character sizes (dot sizes of 16, 24, 32, 48, 64 and 96, for example).

The ROM 74 stores various programs to control the tape printer 1, including a display drive control program, a print drive control program, a pulse number determination program, a cutting drive control program, and so on. The display drive control program controls a liquid crystal drive circuit (LCDC) 405 in association with code data of characters, such as letters, symbols, numerals and so on input from the keyboard 3. The print drive control program drives the thermal head 10 and the tape feed motor 23. The pulse number determination program determines the number of pulses to be applied corresponding to the amount of formation energy for each print dot. The cutting drive control program drives the cutter motor 24 to cut the printed tape 50 at the predetermined cutting position. The CPU 71 performs a variety of computations in accordance with each type of program.

The RAM 75 includes a plurality of storage areas, including a text memory, a print buffer, counter, an total print dot counter, a parameter storage area, and so on. The text memory stores text data input from the keyboard 3. The print buffer stores dot pattern data, including the printing dot patterns for characters and the number of pulses to be applied that is the amount of formation energy for each dot, and so on. The thermal head 10 performs dot printing in accordance with the dot pattern data stored in the print buffer.

The counter stores a count value that is a number of print dots for each line printed by the thermal head 10. The total print dot counter stores a total number of print dots printed by the thermal head 10 from the point of activation. The parameter storage area stores a variety of computation data.

The input/output interface 77 is connected, respectively, to the detecting switches 20, the keyboard 3, the liquid crystal drive circuit (LCDC) 25 that has a video RAM (not shown in the figures) to output display data to the liquid crystal display (LCD) 5, a drive circuit 26 that drives the tape feed motor 23, a drive circuit 27 that drives the thermal head 10, and a drive circuit 28 that drives the cutter motor 24.

In a case where characters are input through the keyboard 3, that text (text data) is stored in the text memory. Then, based on the various programs, a dot patterns corresponding to the characters input through the keyboard 3 are displayed on the liquid crystal display 5. In addition, the thermal head 10 is driven by the drive circuit 27, and performs printing based on the print dot pattern data stored in the print buffer. Further, the tape feed motor 23 performs tape feed control in synchronization with the printing operation by the thermal head 10.

In the thermal head 10, heating elements that are provided on the heating body (not shown in the figures) are selectively heat driven by the drive circuit 27 in correspondence with one line of print dots. Thus, the characters input through the keyboard 3 are printed on the print surface of the film tape 59. The printed tape 50 is fed to a cutting position of the cutting mechanism 17 and is cut by the movable blade 19 and the fixed blade 18 moving in concert with each other.

Figure 16:
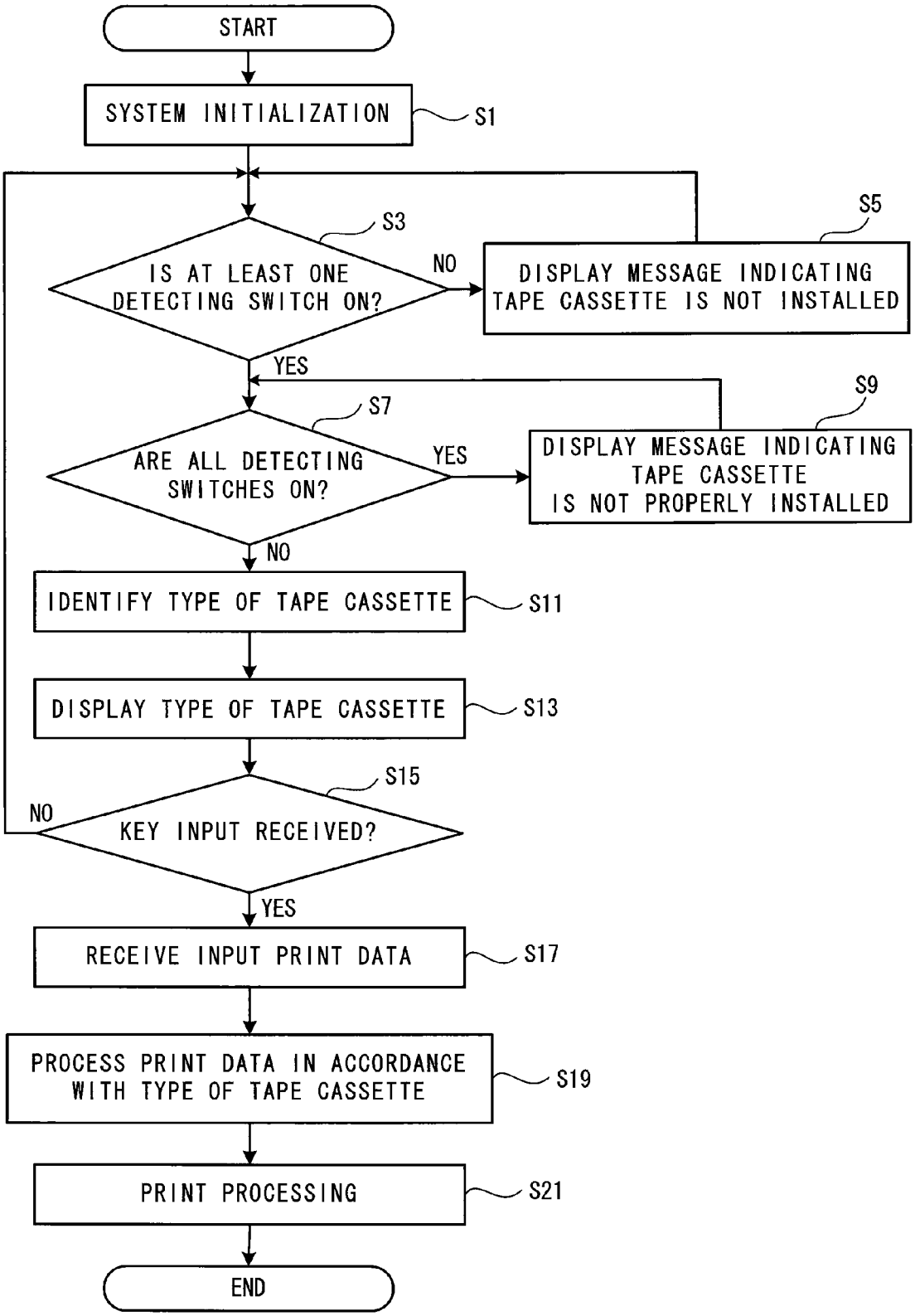
FIG. 16 is a flowchart of main processing according to the first embodiment.

Next, main processing of the tape printer 1 according to the first embodiment will be explained with reference to FIG. 16. The main processing shown in FIG. 16 is performed by the CPU 71 based on programs stored in the ROM 74 when the power source of the tape printer 1 is turned on.

In the main processing, first, the CPU 71 performs system initialization of the tape printer 1 (step S1). For example, in the system initialization performed at step S1, the text memory in the RAM 75 is cleared, the counter is initialized to a default value and so on.

Next, based on signals output by the detecting switches 20, the CPU 71 determines whether at least one of the detecting switches 20 is in the on state (step S3). More specifically, if the CPU 71 detects that any one of the switch terminals 21 of the detecting switches 20 has been pressed, the CPU 71 determines that at least one of the detecting switches 20 is in the on state (yes at step S3).

If the CPU 71 detects that none of the switch terminals 21 of the detecting switches 20 has been pressed (no at step S3), the CPU 71 determines that the tape cassette 30 is not installed in the cassette housing portion 8. Then, the CPU 71 causes the liquid crystal display 5 to display a message indicating that the tape cassette 30 is not installed (step S5). For example, at step S5, a text message is displayed on the liquid crystal display 5 stating that "Tape cassette is not installed." Following step S5, the processing returns to step S3, and the CPU 71 waits until at least one of the detecting switches 20 is in the on state. In other words, the message indicating that the tape cassette 30 is not installed is displayed on the liquid crystal display 5 until the tape cassette 30 is installed in the cassette housing portion 8.

As described above, the platen holder 12 moves to the stand-by position or to the print position in concert with the opening and closing of the cassette cover 6. When the cassette cover 6 is opened, the platen holder 12 moves to the stand-by position and thus all of the detecting switches 20 are in the off state. For that reason, even when the tape cassette 30 is installed in the cassette housing portion 8, if the cassette cover 6 is open, the message indicating that the tape cassette 30 is not installed is displayed on the liquid crystal display 5 (step S5).

Further, if the tape cassette 30 has not reached the height position of the detecting switches 20 of the platen holder 12, as shown in FIG. 14, the CPU 71 detects that none of the switch terminals 21 have been pressed, in a similar way to that described above (no at step S3). Therefore, the message indicating that the tape cassette 30 is not installed is displayed at step S5. On the other hand, if the tape cassette 30 is installed in the cassette housing portion 8 and the cassette cover 6 is closed, the platen holder 12 moves to the print position, and processing is performed in accordance with the on state of each of the detecting switches 20, as described below.

If at least one of the detecting switches 20 is in the on state (yes at step S3), based on the signals output by the detecting switches 20, the CPU 71 determines whether all of the detecting switches 20 are in the on state (step S7). More specifically, if the CPU 71 detects that all of the switch terminals 21 of the detecting switches 20 have been pressed, the CPU 71 determines that all of the detecting switches 20 are in the on state (yes at step S7).

If all of the detecting switches 20 are in the on state (yes at step S7), the CPU 71 determines that the tape cassette 30 is installed at an improper position. As described above, if the tape cassette 30 is displaced or raised within the cassette housing portion 8, the cassette case 31 is not placed at a proper position with respect to the cassette housing portion 8. In such a case, as shown in FIG. 13, the detecting switches 20 oppose the second pressing portion 83 of the arm side surface 35 and all the detecting switches 20 are thus changed to the on state.

Then, the CPU 71 causes the liquid crystal display 5 to display a message indicating that the tape cassette 30 is installed at an improper position (step S9). For example, at step S9, a text message is displayed on the liquid crystal display 5 stating that "Tape cassette is improperly installed." Following step S9, the processing returns to step S7, and the CPU 71 waits until at least one of the detecting switches 20 is in the off state. In other words, the message indicating that the tape cassette 30 is improperly installed is displayed on the liquid crystal display 5 until the tape cassette 30 is properly installed.

If not all of the detecting switches 20 are in the on state (no at step S7), a part of the detecting switches 20 is pressed. In such a case, the CPU 71 determines that the tape cassette 30 is properly installed. As shown in FIG. 12, when the tape cassette 30 is properly installed, the detecting switches 20 oppose the first pressing portion 80 of the arm side surface 35, and thus each of the detecting switches 20 is in the on state or in the off state depending on a pattern in which the non-pressing portion(s) 81 and the normal-pressing portion(s) 82 are arranged.

Based on a combination of the on and off states of the detecting switches 20, the CPU 71 identifies the type of the tape cassette 30 installed in the cassette housing portion 8 (step S11). More specifically, with reference to a cassette identification table, the CPU 71 identifies a tape cassette type corresponding to the combination of the on and off states of the detecting switches 20. In the cassette identification table, combinations of the on and off states of the detecting switches 20 are each associated with a type of a tape cassette. The cassette identification table is stored in the ROM 74 beforehand. The CPU 71 displays the type of the tape cassette 30 identified at step S11 as text information on the liquid crystal display 5 (step S13).

In a case where the tape cassette 30 shown in FIG. 10 is properly installed in the tape printer 1, among the five detecting switches 20A to 20E, the detecting switches 20A, 20D and 20E are changed to the on state. Accordingly, the type of the tape cassette corresponding to this pattern is identified (for example, a white tape with 18 mm width), with reference to the cassette identification table in the ROM 74. A message stating "A white tape with 18 mm width has been installed." is displayed on the liquid crystal display 5. Note that this example given here is different to that of a cassette identification table shown as Table 1, which will be explained later.

Next, the CPU 71 determines whether there is any input from the keyboard 3 (step S15). If there is an input from the keyboard 3 (yes at step S15), the CPU 71 receives the characters input from the keyboard 3 as print data, and stores the print data (text data) in the text memory of the RAM 75 (step S17). If there is no input from the keyboard 3 (no at step S15), the processing returns to step S3.

Then, if there is an instruction to start printing from the keyboard 3, the print data stored in the text memory is processed in accordance with the type of the tape cassette 30 identified at step S11 (step S19). For example, at step S19, the print data is processed to reflect a print character size and print position and the like that are appropriate for the tape width and tape type of the tape cassette 30.

Based on the print data processed at step S19, the CPU 71 performs print processing on the film tape 59 (step S21). In the print processing at step S21, the thermal head 10 and the tape feed motor 23 are driven as described above, and printing based on the dot pattern data stored in the print buffer is performed on the print surface of the fed film tape 59. After that, the printed tape 50, which is the film tape 59 to which the double-sided adhesive tape 58 has been affixed, is cut by the cutting mechanism 17. After step S21, the main processing ends.

Through the above-described main processing (refer to FIG. 16), various information relating to the tape cassette 30 installed in the cassette housing portion 8 is identified in the tape printer 1 depending on the pattern of pressing of each of the detecting switches 20. In other words, the tape printer 1 can not only identify the type of the tape cassette 30 installed in the cassette housing portion 8, but also recognize information indicating whether the tape cassette 30 is installed in the cassette housing portion 8 and whether the cassette case 31 is placed at the proper position with respect to the cassette housing portion 8.

The tape printer 1 and the tape cassette 30 according to a second embodiment of the present invention will be explained with reference to FIG. 17 to FIG. 26. In the second embodiment, some explanations are omitted of elements that have substantially the same structure as the tape printer 1 and the tape cassette 30 of the first embodiment, and these elements are denoted with the same reference numerals as in the first embodiment. The following explanation will concentrate on points that are different from the first embodiment.

In the second embodiment, in addition to the first pressing portion 80, a latching groove 84 is also provided in the front surface of the tape cassette 30. Further, a latching piece 29 is provided on the platen holder 12 of the tape printer 1, in addition to the detecting switches 20. The tape printer 1 recognizes various information relating to the tape cassette 30 installed in the cassette housing portion 8 based on detection results of the detecting switches 20.

Figure 17:
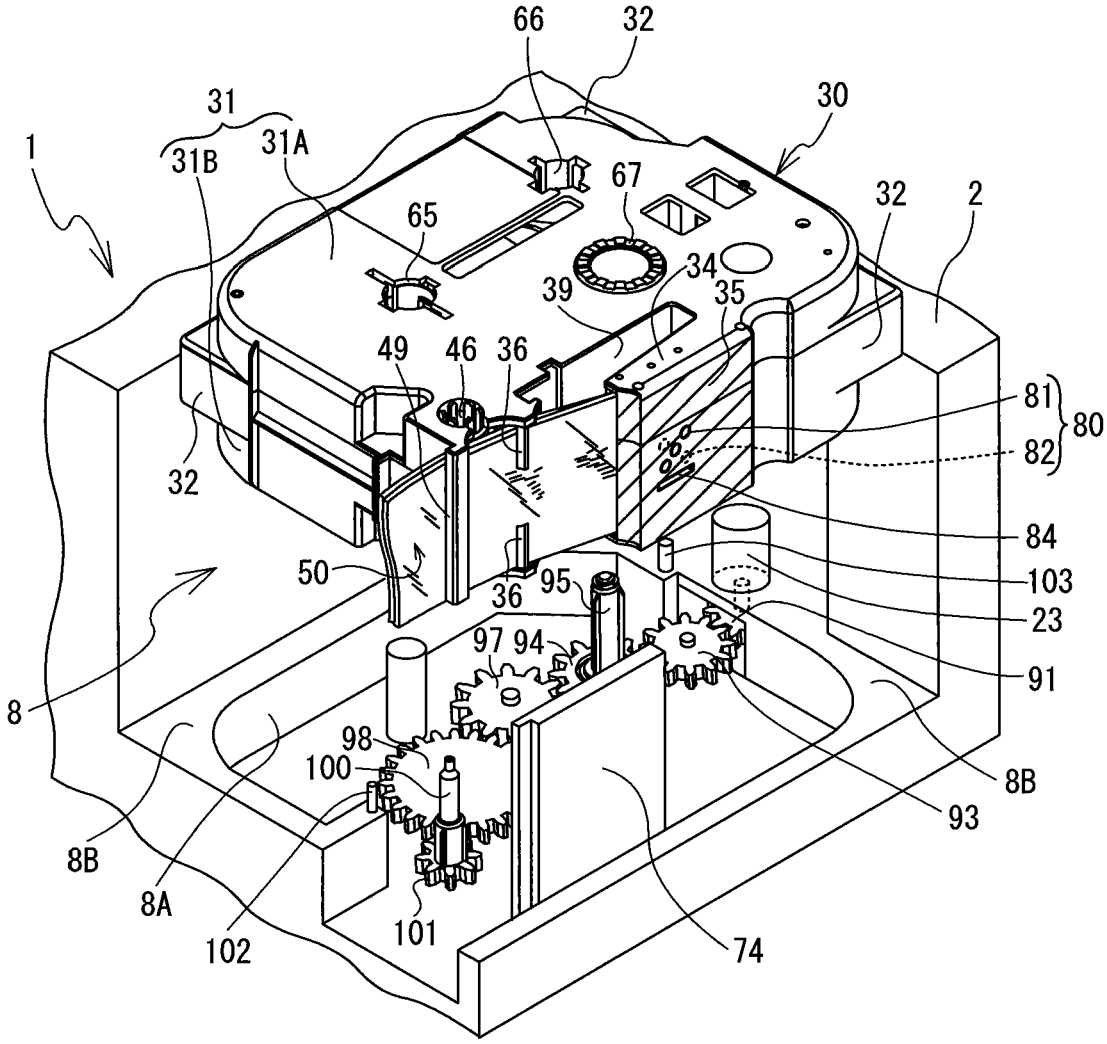
FIG. 17 is a perspective view illustrating the tape cassette 30 and the cassette housing portion 8 according to a second embodiment.
Figure 18:
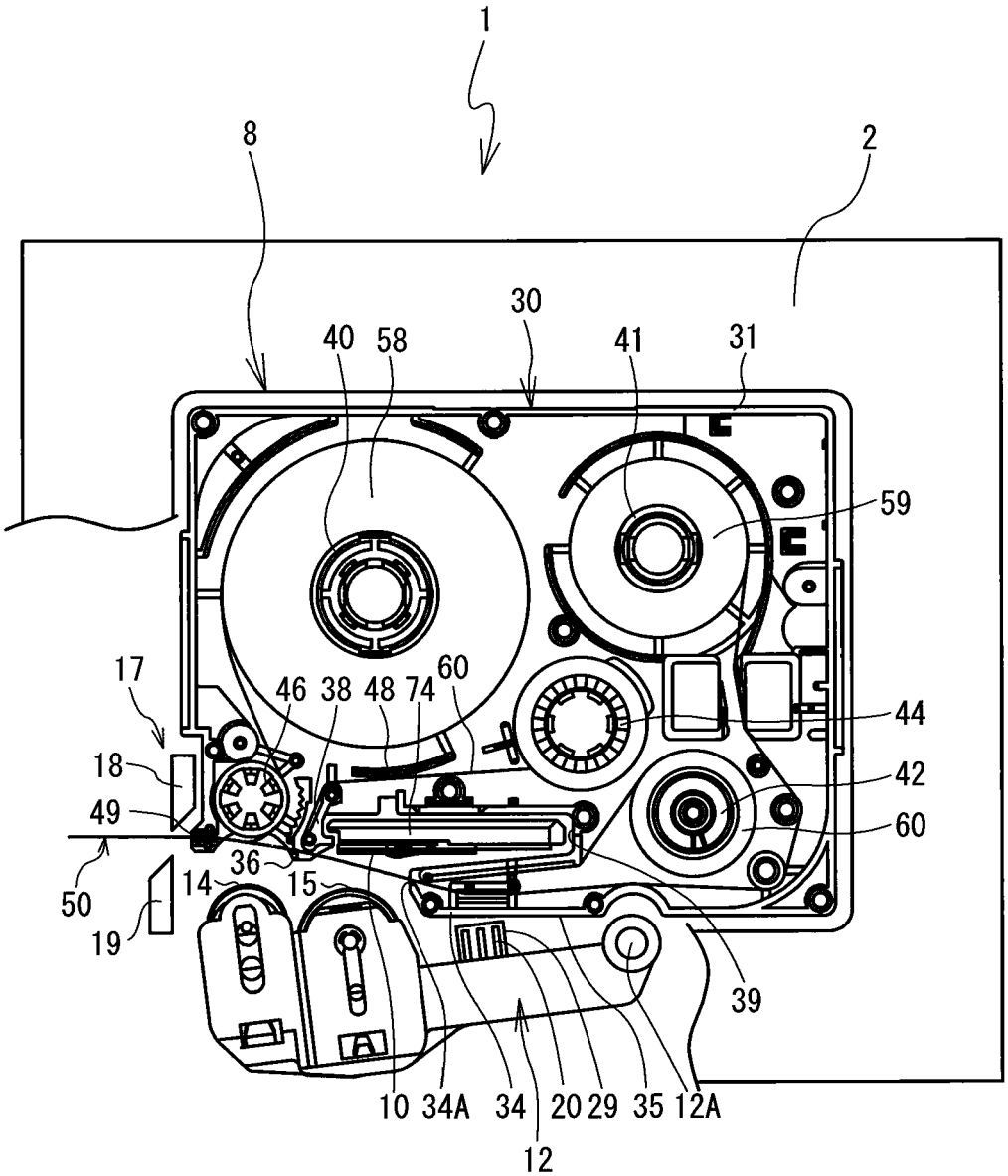
FIG. 18 is a plan view of the cassette housing portion 8 according to the second embodiment, in which the tape cassette 30 is installed.
Figure 19:
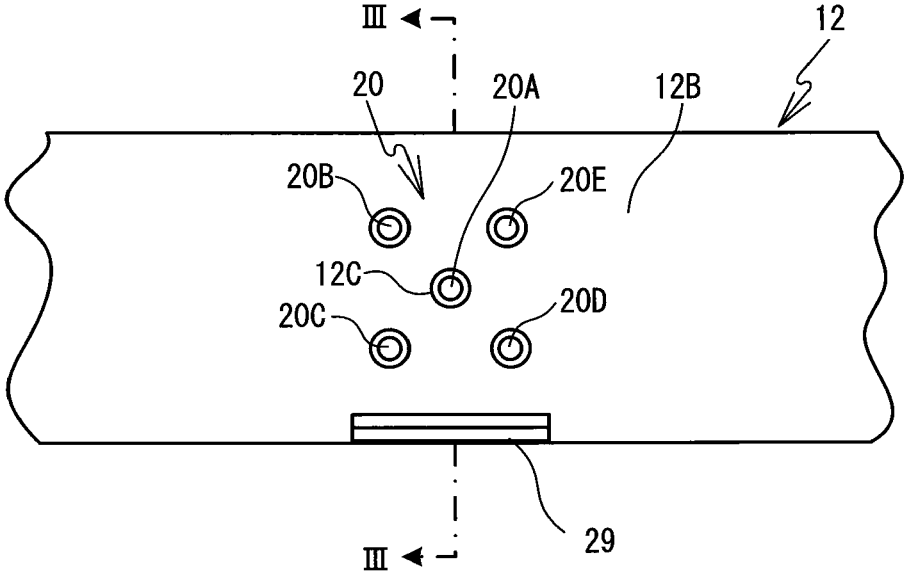
FIG. 19 is a rear view of a section of the platen holder 12 on which are provided the plurality of detecting switches 20 and a latching piece 29.

First, the outline structure of the tape printer 1 according to the second embodiment will be explained. As shown in FIG. 17 to FIG. 19, the tape printer 1 according to the present embodiment has substantially the same structure as the tape printer 1 according to the first embodiment. The point of difference is that the latching piece 29 is provided. The latching piece 29 is provided below the detecting switches 20 on the cassette-facing surface 12B of the platen holder 12.

The latching piece 29 is a plate-shaped protruding portion that extends in the right-and-left direction The latching piece 29 protrudes perpendicularly with respect to the cassette-facing surface 12B, opposes the arm side surface 35 of the tape cassette 30 installed in the cassette housing portion 8, in a similar manner to the detecting switches 20. Furthermore, the latching piece 29 is provided at a height position such that the latching piece 29 faces the latching groove 84 to be explained later when the tape cassette 30 is installed at the proper position in the cassette housing portion 8. The largest range (the width in the vertical direction) in which the detecting switches 20 and the latching piece 29 can be provided on the cassette-facing surface 12B is generally equivalent to the height T of the common portion 32.

Figure 20:
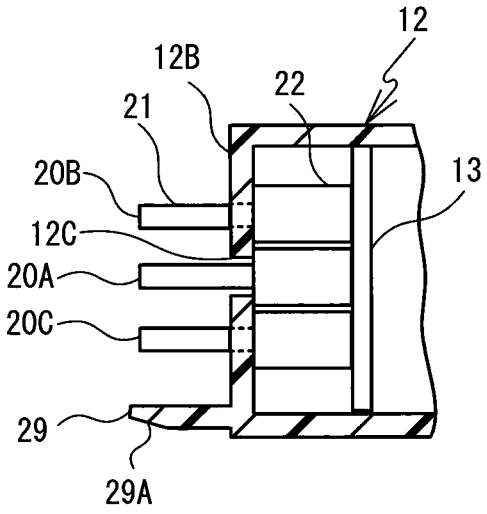
FIG. 20 is a cross-sectional view along a line shown in FIG. 19 as seen in the direction of the arrows.

As shown in FIG. 20, the latching piece 29 extends from the bottom surface of the platen holder 12, such that the latching piece 29 protrudes from the lower edge of the cassette-facing surface 12B rearwards (to the left side in FIG. 20). A length of protrusion of the latching piece 29 from the cassette-facing surface 12B is generally the same as, or slightly greater than, a length of protrusion of each of the detecting switches 20 (more specifically, the switch terminals 21) from the cassette-facing surface 12B. Furthermore, an inclined portion 29A, which is a horizontally inclined part of a lower surface of the latching piece 29, is formed on the latching piece 29 such that the thickness of the latching piece 29 becomes smaller toward the leading end (the left side in FIG. 20).

Figure 21:
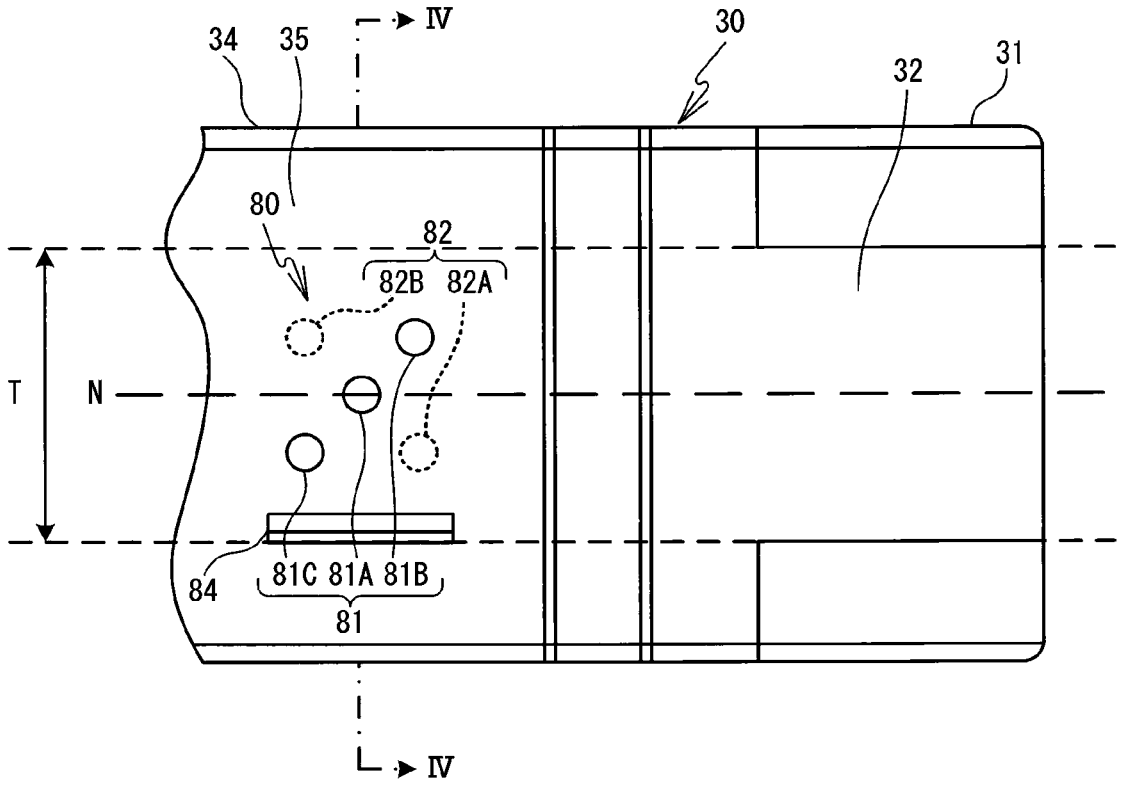
FIG. 21 is a front view of a section the arm side surface 35 on which are provided the first pressing portion 80 and a latching groove 84.
Figure 22:
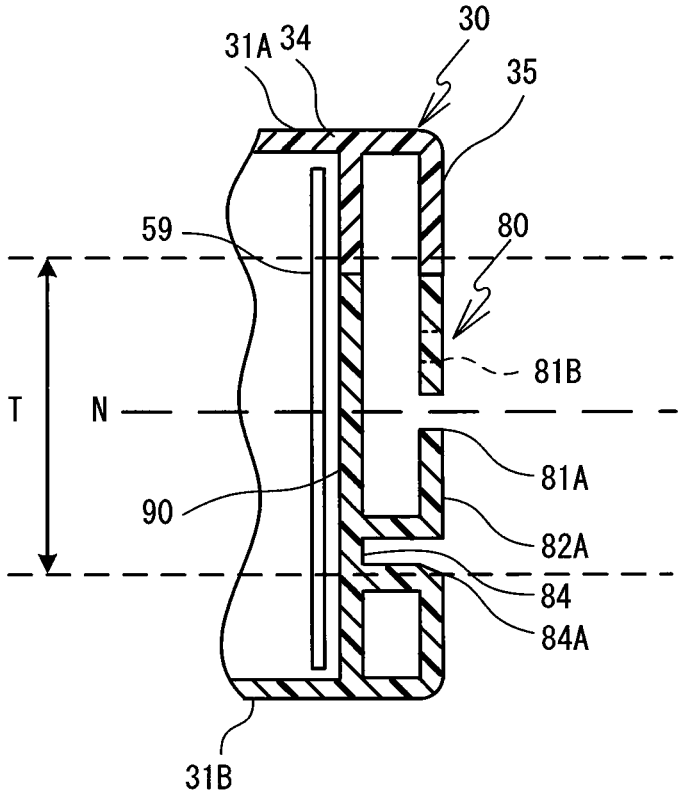
FIG. 22 is a cross-sectional view along a IV-IV line shown in FIG. 21 as seen in the direction of the arrows.

Next, the outline structure of the tape cassette 30 according to the second embodiment will be explained. As shown in FIG. 17, FIG. 21 and FIG. 22, the tape cassette 30 according to the present embodiment has substantially the same structure as the tape cassette 30 according to the first embodiment. The point of difference is that the latching groove 84 is provided. More specifically, the latching groove 84 is provided below the first pressing portion 80 in the arm side surface 35 that corresponds to the front surface of the arm portion 34. The latching groove 84 is a slit-shaped through-hole that extends in the right-and-left direction. The latching groove 84 is also provided within the range of the common portion 32 (namely, within the height T) of the arm side surface 35. The latching groove 84 opposes the latching piece 29 such that the latching piece 29 can be freely inserted into or removed from the latching groove 84 when the tape cassette 30 is properly installed.

As shown in FIG. 22, the latching groove 84 is formed below the first pressing portion 80 in the cassette case 31 (specifically, the bottom case 31B) such that the latching groove 84 forms as an indentation from the arm side surface 35 in the rearward direction. Further, a part of a lower inner wall of the latching groove 84 is formed as an inclined portion 84A that inclines with respect to the horizontal direction such that an opening width (in FIG. 22, the length in the vertical direction) latching groove 84 increases towards the side of insertion (the right side in FIG. 22) of the latching groove 84.

Similarly to the first embodiment, the first pressing portion 80 according to the second embodiment has the three non-pressing portions 81A to 81C and the two normal-pressing portions 82A and 82B that correspond to the arrangement positions of the five detecting switches 20A to 20E (refer to FIG. 19), such that lines connecting the detecting portions form an "X" in a front view (refer to FIG. 21). Furthermore, the latching groove 84 is formed along the lower edge of the common portion 32 (the range of the height T), corresponding to the arrangement position of the latching piece 29.

As described above, the first pressing portion 80 includes the detecting portions (the non-pressing portion(s) 81 and the normal-pressing portion(s) 82) arranged in a pattern corresponding to the type of the tape cassette 30. However, in the first pressing portion 80 according to the present embodiment, the following two patterns are not adopted. One is a pattern in which all of the positions that respectively correspond to the detecting switches 20 are the non-pressing portions 81. The other is a pattern in which all of the positions that respectively correspond to the detecting switches 20 are the normal-pressing portions 82. In other words, the first pressing portion 80 according to the second embodiment, in the same manner as in the first embodiment, includes the detection portions that are arranged in a pattern that includes at least one non-pressing portion 81 and at least one normal-pressing portion 82.

Figure 23:
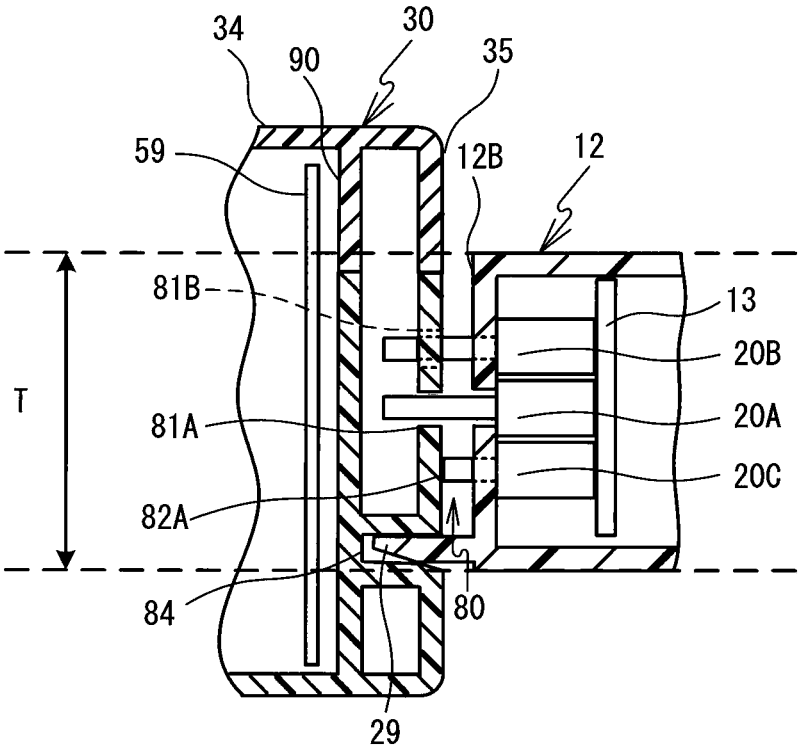
FIG. 23 is a side cross-sectional view illustrating a case in which the tape cassette 30 and the platen holder 12 according to the second embodiment are in an opposing state.

Next, a relationship between the first pressing portion 80 and the detecting switches 20 and a relationship between the latching groove 84 and the latching piece 29 will be explained with reference to FIG. 23 to FIG. 25. As shown in FIG. 23, in a case where the tape cassette 30 is properly installed (in other words, if the tape cassette 30 is installed in the cassette housing portion 8 and the cassette case 31 is placed at the proper position with respect to the cassette housing portion 8), if the platen holder 12 moves to the print position, the latching piece 29 opposes the latching groove 84 in the arm side surface 35 and is inserted into the latching groove 84. In addition, the detecting switches 20 respectively oppose the detecting portions (the non-pressing portion(s) 81 and the normal-pressing portion(s) 82) of the first pressing portion 80 and are thus respectively in either the on state or the off state.

In the example shown in FIG. 23, the latching piece 29 is inserted into the latching groove 84, and, in the same manner as in the first embodiment (refer to FIG. 12), the detecting switches 20A, 20B and 20D are respectively inserted into the non-pressing portions 81A, 81B and 81C and thus remain in the off state. The detecting switches 20C and 20E are respectively pressed by the normal-pressing portions 82A and 82B and are thus changed to the on state. In this way, when the tape cassette 30 is properly installed, as the latching piece 29 is inserted into the latching groove 84, the detecting switches 20A to 20E and the first pressing portion 80 oppose each other at the proper positions. Then, based on the detection results that the detecting switches 20C and 20E are in the on state, the tape printer 1 obtains information relating to the tape cassette 30, as explained later.

Figure 24:
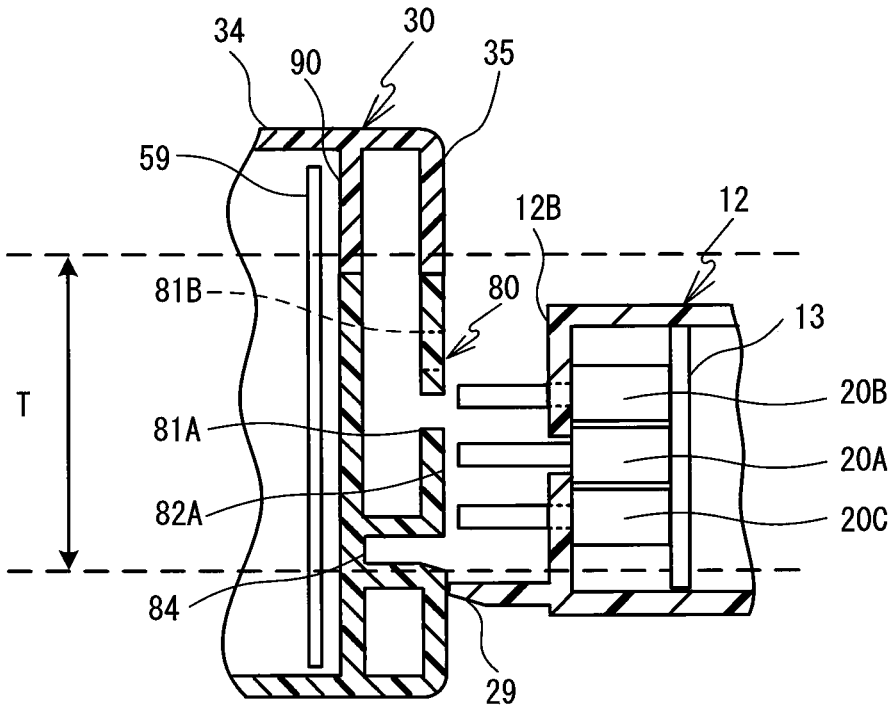
FIG. 24 is a side cross-sectional view illustrating another case in which the tape cassette 30 and the platen holder 12 according to the second embodiment are in the opposing state.

On the other hand, as shown in FIG. 24, in a case where the tape cassette 30 is not installed in the cassette housing portion 8, or in a case where the tape cassette 30 is installed at an improper position (namely, if the cassette case 31 is not placed at the proper position with respect to the cassette housing portion 8), the tape cassette 30 is not properly installed. If the platen holder 12 moves to the print position in such a state, the latching piece 29 does not oppose the latching groove 84, but opposes another section of the arm side surface 35. In such a case, all of the detecting switches 20 are maintained in the off state because the switch terminals 21 do not contact the arm side surface 35.

More specifically, in the example shown in FIG. 24, in contrast to the example shown in FIG. 23, there is a displacement in the vertical direction between the positions of the latching piece 29 and the latching groove 84 (namely, the positions between the detecting switches 20A to 20E and the detection portions of the first pressing portion 80). As a result, the latching piece 29 is not inserted into the latching groove 84, but opposes and contacts another section of the arm side surface 35. When this occurs, because a rotating movement of the platen holder 12 toward the print position is regulated by the latching piece 29, the platen holder 12 cannot move further toward the print position beyond the position at which the latching piece 29 contacts the arm side surface 35.

Further, the length of protrusion of the latching piece 29 is generally the same as, or slightly greater than, the length of protrusion of the switch terminals 21. Consequently, when the latching piece 29 opposes the arm side surface 35, the detecting switches 20 are not turned on by the arm side surface 35. In this way, if the tape cassette 30 is not properly installed, the latching piece 29 is not inserted into the latching groove 84, thus preventing a contact between the detecting switches 20A to 20E and the first pressing portion 80. Then, based on detection results that all the detecting switches 20A to 20E are in the off state, the tape printer 1 obtains information relating to the tape cassette 30, as explained later.

Depending on whether or not the tape cassette 30 is properly installed in the cassette housing portion 8, the latching groove 84 changes a detected state of the first pressing portion 80 (namely, the on or off state of each of the detecting switches 20). Furthermore, the latching groove 84 also functions to maintain all of the detecting switches 20 in the off state, if the tape cassette 30 is not properly installed.

Further, as described above, the thickness of the latching piece 29 decreases toward the leading end of the latching piece 29, due to the inclined portion 29A. The opening width of the latching groove 84 increases toward the side of insertion, due to the inclined portion 84A. As a consequence, if the position of the latching piece 29 is slightly misaligned with respect to the latching groove 84 in the downward direction, when the platen holder 12 moves toward the print position, the inclined portion 29A and the inclined portion 84A interact with each other to guide the latching piece 29 into the latching groove 84. In such a way, even when the cassette case 31 is slightly raised with respect to the proper position in the cassette housing portion 8, the latching piece 29 may be properly inserted into the latching groove 84, and each of the detecting switches 20 may be accurately positioned to oppose the first pressing portion 80.

Figure 25:
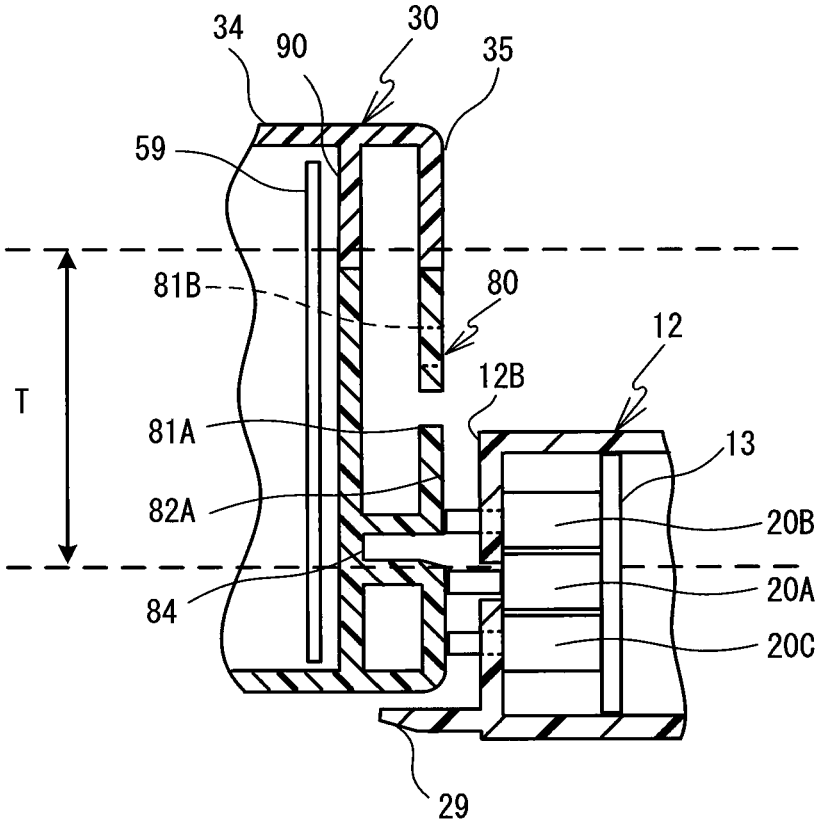
FIG. 25 is a side cross-sectional view illustrating still another case in which the tape cassette 30 and the platen holder 12 according to the second embodiment are in the opposing state.

As shown in FIG. 25, in a case where the bottom surface of the tape cassette 30 is at a height position that does not reach the latching piece 29 of the platen holder 12 (namely, if the bottom surface of the tape cassette 30 is above the latching piece 29), all of the detecting switches 20A to 20E may be pressed by the arm side surface 35 and are thus changed to the on state. In such a case, based on the detection results that all of the detecting switches 20A to 20E are in the on state, the tape printer 1 determines that the tape cassette 30 is not properly installed, as explained in more detail later.

Furthermore, in this state, in a rare case, some of the detecting switches 20A to 20E may be in the on state and erroneous detection results may be obtained. In such a case, the tape cassette 30 may be extremely raised from the proper position in the cassette housing portion 8. When this occurs, the platen holder 12 may interfere with a part of the case (not shown in the figures) of the tape cassette 30, to prevent a contact between the platen roller 15 and the thermal head 10. Therefore, printing is not performed in the tape printer 1 in such a case.

Next, main processing of the tape printer 1 according to the second embodiment will be explained with reference to FIG. 26. Note that the main processing shown in FIG. 26 is also performed by the CPU 71 based on programs stored in the ROM 74 when the power source of the tape printer 1 is turned on.

Figure 26:
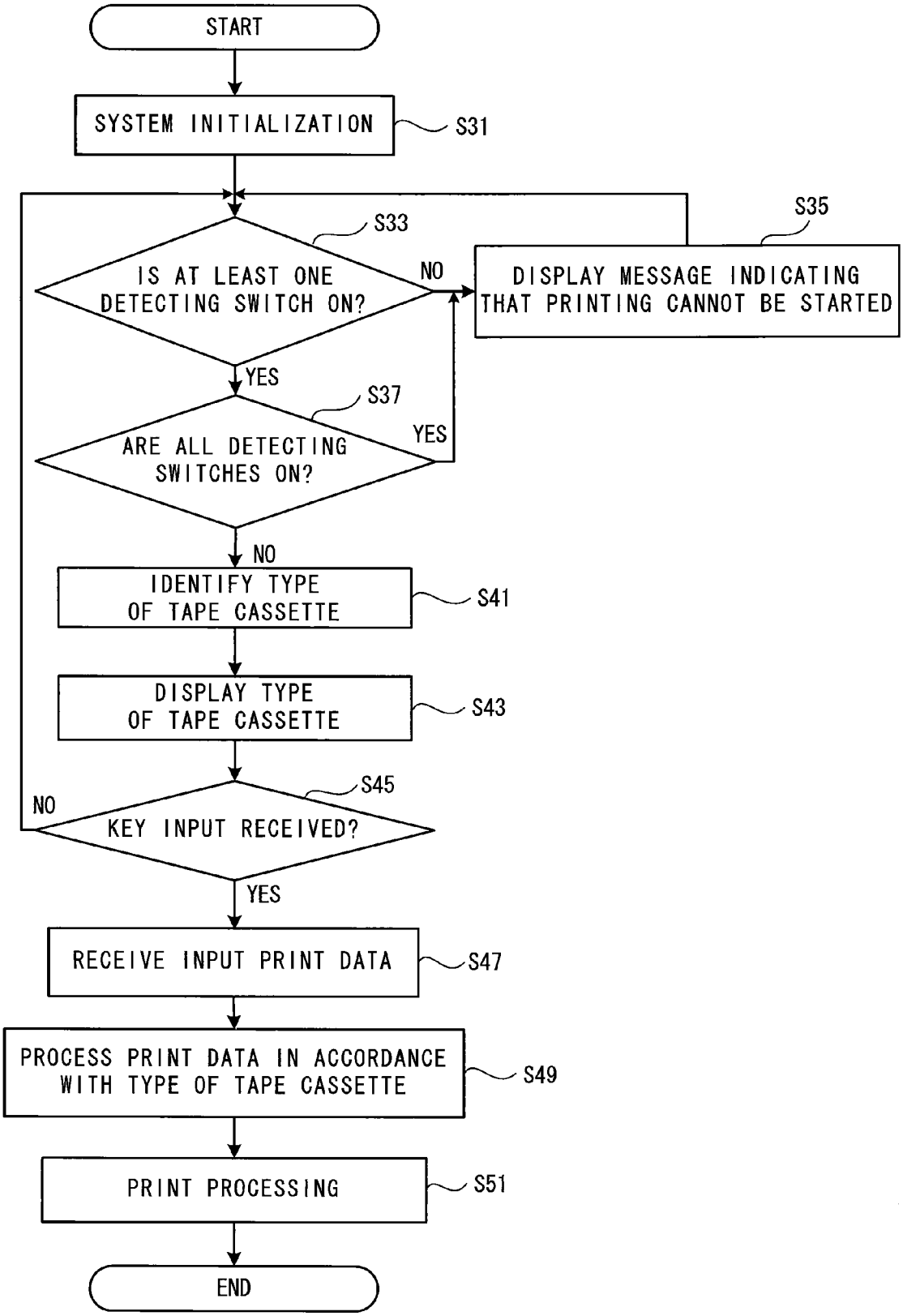
FIG. 26 is a flowchart of main processing according to the second embodiment.

As shown in FIG. 26, in the main processing, first, the CPU 71 performs system initialization of the tape printer 1 (step S31). Then, based on signals output by the detecting switches 20, the CPU 71 determines whether at least one of the detecting switches 20 is in the on state (step S33). If the CPU 71 detects that all of the detecting switches 20 are in the off state (no at step S33), the CPU 71 determines that the tape cassette 30 is not properly installed. The processing at steps S31 and S33 are similar to the processing at S1 and S3 in the main processing (refer to FIG. 16) according to the first embodiment.

As described above, in a case where the tape cassette 30 is not installed in the cassette housing portion 8, or in a case where the cassette case 31 is not placed at the proper position with respect to the cassette housing portion 8, the latching piece 29 is not inserted into the latching groove 84. Then, as shown in FIG. 24, due to interference of the latching piece 29, the detecting switches 20 are not turned on by the arm side surface 35 and are therefore all in the off state (no at step S33).

Then, the CPU 71 displays a message on the liquid crystal display 5 indicating that printing cannot be started (step S35). For example, at step S35, a text message is displayed on the liquid crystal display 5 stating that "Tape cassette is not installed, or tape cassette is not installed at the proper position."

Following step S35, the processing returns to step S33, and the CPU 71 waits until at least one of the detecting switches 20 is changed to the on state. In other words, the message indicating that printing cannot be started (namely, that the tape cassette 30 is not properly installed) is displayed on the liquid crystal display 5 until the tape cassette 30 is installed in the cassette housing portion 8 and the cassette case 31 is placed at the proper position. Even if the tape cassette 30 is properly installed in the cassette housing portion 8, if the cassette cover 6 is open, the message indicating that printing cannot be started is displayed on the liquid crystal display 5 (step S35).

In a case where at least one of the detecting switches 20 is in the on state (yes at step S33), the CPU 71 further determines whether all of the detecting switches 20 are in the on state (step S37). If all the detecting switches 20 are in the on state (yes at step S37), the CPU 71 determines that the tape cassette 30 is not properly installed. As shown in FIG. 25, if the bottom of the tape cassette 30 is at a height position such that the bottom does not reach the latching piece 29 of the platen holder 12, all of the detecting switches 20 are pressed by the arm side surface 35 and are thus changed to the on state (refer to FIG. 25). In this case also, the CPU 71 displays a message indicating that printing cannot be started, in a similar way to that described above (step S35).

If not all the detecting switches 20 are in the on state (no at step S37), a part of the detecting switches 20 is in the on state. Then, the CPU 71 determines that the tape cassette 30 is properly installed. As described above, in a case where the tape cassette 30 is properly installed, the latching piece 29 is inserted into the latching groove 84. When this occurs, as shown in FIG. 23, the detecting switches 20 oppose the first pressing portion 80 of the arm side surface 35 without any interference from the latching piece 29. Accordingly, each of the detecting switches 20 is changed to the on state or remains in the off state, depending on a pattern in which the non-pressing portion(s) 81 and the normal-pressing portion(s) 82 are arranged. As the subsequent processing of step S41 to step S51 is similar to the processing of step S11 to step S21 of the first embodiment (refer to FIG. 16), the explanation thereof will be omitted.

Through the above-described main processing (refer to FIG. 26), various information relating to the tape cassette 30 installed in the cassette housing portion 8 is identified in the tape printer 1 based on the pattern in which the detecting switches 20 are pressed. In other words, in the tape printer 1, by the combination of the on and off states of the detecting switches 20, not only the type of the tape cassette 30 installed in the cassette housing portion 8, but also information indicating whether the tape cassette 30 is properly installed (namely, whether the tape cassette 30 is installed in the cassette housing portion 8 and the cassette case 31 is placed at the proper position) can be recognized.

The present invention is not limited to the above-described embodiments, but various modifications and alterations may of course be made insofar as they are within the scope of the present invention. For example, in the above-described first and second embodiments, the first pressing portion 80 is provided on the arm side surface 35 of the tape cassette 30 such that the plurality of detecting portions (the non-pressing portion(s) 81 and the normal-pressing portion(s) 82) are arranged within a uniform height (width) on both sides of the center line N. This is also the same for the plurality of detecting switches 20 provided on the platen holder 12. The information relating to the tape cassette 30 may be obtained regardless of the tape width and the cassette width. However, the number and the arrangement pattern of the detecting portions of the first pressing portion 80 and the arrangement pattern of the detecting switches 20 may be changed in accordance with the tape width or the cassette width.

In the tape printer 1 that uses only the narrow-width tape cassette 30 with a tape width that is equal to or less than a predetermined value (12 mm, for example), the number of types of the tape cassette 30 that can be installed may be small. Therefore, the number of the detecting switches 20 may be less than five, or the plurality of detecting switches 20 may be provided in a single line in the vertical direction. In contrast, in the tape printer 1 that can also use the wide-width tape cassette 30 with a tape width that is larger than the predetermined value (12 mm, for example), the number of types of the tape cassette 30 that can be installed may be large. Therefore, the number of the detecting switches 20 may be more than five, or the plurality of detecting switches 20 may be provided in a plurality of lines in the vertical direction.

In a similar way, the number of the detecting portions of the first pressing portion 80 and the number of lines in which the detecting portions are arranged may be changed in accordance with the tape width of the tape cassette 30. A single line may include two or more of the detecting portions of the first pressing portion 80 or may include only one of the detecting portions. This also applies to the detecting switches 20.

Figure 27:
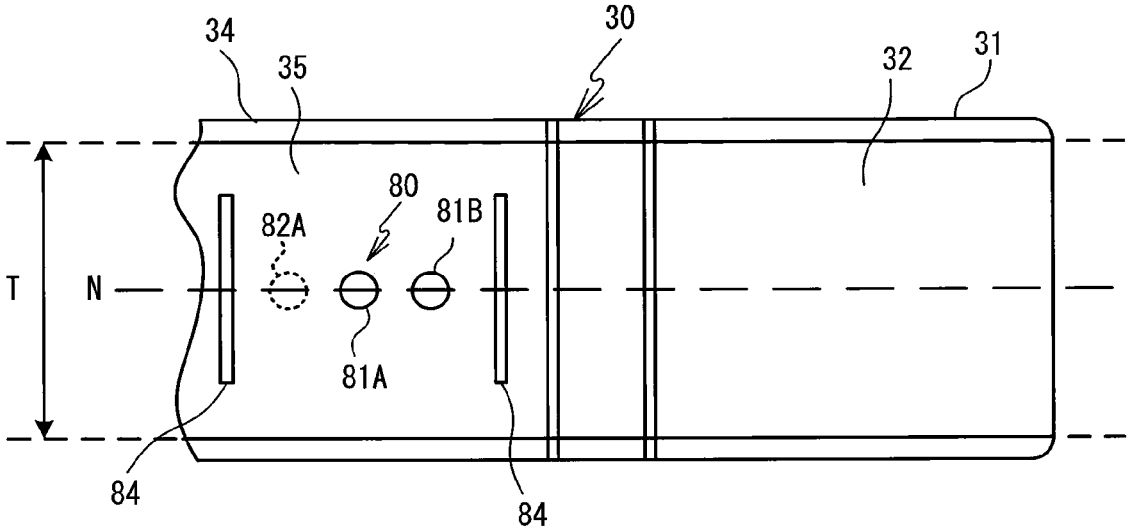
FIG. 27 is a diagram showing a narrow-width tape cassette 30 on which each of detection portions in the first pressing portion 80 are provided in a single line on the arm side surface 35.

For example, as with the narrow-width tape cassette 30 shown in FIG. 27, in a case where the tape width is equal to or less than the predetermined width (12 mm, for example), only three detecting portions of the first pressing portion 80 (the non-pressing portions 81A, 81B, and the normal-pressing portion 82A) may be provided in a single line at a predetermined height within the common portion 32 (the range of the height T) on the arm side surface 35. In correspondence to the arrangement of the detecting portions, three detecting switches 20 may be provided in a single line in the vertical direction on the cassette-facing surface 12B of the platen holder 12. In such a way, the tape type may be appropriately detected even if the height of the side surface (the width in the vertical direction) of the tape cassette 30 is small, such as the tape cassette 30 with the small tape width. At the same time, the number of the detecting switches 20 may be decreased, and thus manufacturing costs of the tape printer 1 may be reduced.

Figure 28:
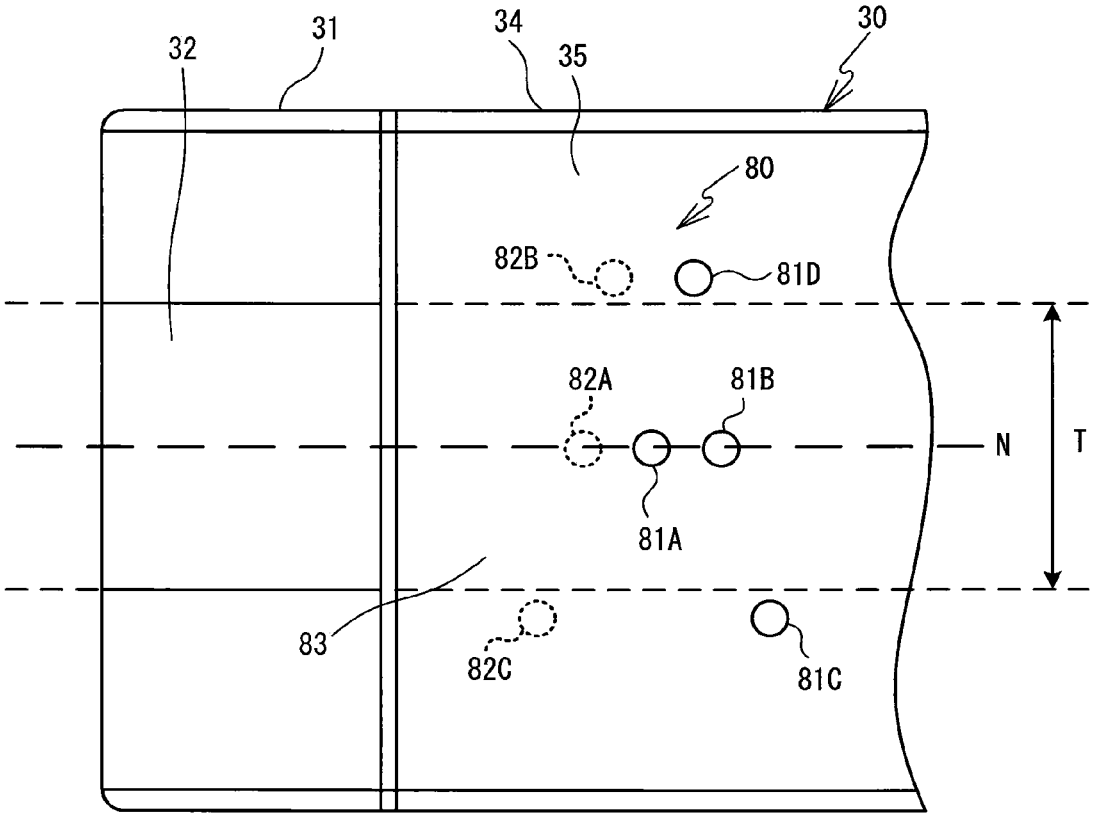
FIG. 28 is a diagram showing a wide-width tape cassette 30 on which each of the detection portions in the first pressing portion 80 are provided in three lines on the arm side surface 35.

As with the wide-width tape cassette 30 shown in FIG. 28, in a case where the tape width is greater than the predetermined width (36 mm, for example), as well as providing the three detecting portions (the non-pressing portions 81A, 81B, and the normal-pressing portion 82A) within the common portion 32 (the range of the height T) on the arm side surface 35, two detecting portions (the non-pressing portion 81D and the normal-pressing portion 82B) may be provided outside and above the range of the common portion 32, and two detecting portions (the non-pressing portion 81C and the normal-pressing portion 82C) may be provided outside and below the range of the common portion 32. In other words, the detecting portions of the first pressing portion 80 may be provided in three lines in the vertical direction within a range of a predetermined height that includes the common portion 32. In correspondence to the arrangement of the detecting portions, seven detecting switches 20 may be arranged in three lines in the vertical direction on the cassette-facing surface 12B of the platen holder 12. In such a way, as the height of the side surface (the width in the vertical direction) is large with the tape cassette 30 that has a large tape width, a large number of the detecting switches 20 may be provided to detect a large number of the tape types.

With the first pressing portion 80 shown in FIG. 27 and FIG. 28, the detecting portions (the non-pressing portions 81A, 81B and the normal-pressing portion 82A) are arranged at uniform intervals on the center line N. The detecting portions, however, may not need to be arranged at uniform intervals, as long as at least a part of the detecting portions is provided within the common portion 32 (the range of the height T). Furthermore, with the first pressing portion 80 shown in FIG. 28, the two detecting portions are provided outside and above the range of the common portion 32 and the other two detecting portions are provided outside and below the range of the common portion 32. However, the detecting portions may be provided either above or below the range of the common portion 32 in any number and at any positions.

In addition, as long as the latching groove 84 is within the arm side surface 35, the position, size, number, shape and the like of the latching groove 84 may be freely selected. Similarly, as long as the latching piece 29 that corresponds to the latching groove 84 is within the cassette-facing surface 12B, the position, size, number, shape and the like of the latching piece 29 may be freely selected. In the example shown in FIG. 27, the arm side surface 35 of the tape cassette 30 is provided with two of the latching grooves 84 such that the longer side of each of the latching groove 84 extends in the vertical direction. In this case, two of the latching pieces 29 respectively corresponding to the latching grooves 84 may also be provided on the cassette-facing surface 12B of the platen holder 12.

In a case where the plurality of types of the tape cassette 30 that have a different number of lines of the detecting portions are used in a single tape printer 1, it may be preferable that common detecting switches can be used to detect each of the different tape cassettes 30. Then, it may be appropriate to provide a structure to the tape cassette 30 such that the number of the detecting switches that are actually used can be varied depending on the tape width and the like. Such examples will be described below.

With the wide-width tape cassette 30 shown in FIG. 29 (with a tape width of 36 mm, for example), four detecting portions (the non-pressing portions 81A, 81B, 81C and the normal-pressing portion 82A) are provided in two lines in the vertical direction within the range of a height T1 of the common portion 32 on the arm side surface 35 (hereinafter referred to as a first area W1). In addition, two detecting portions (the non-pressing portion 81D and the normal-pressing portion 82B) are provided in a single line in the vertical direction within a range of a height T2, excluding the height T1 of the common portion 32, on the arm side surface 35 (hereinafter referred to as second areas W2).

More specifically, the second areas W2 are respectively formed above and below the first area W1, and the non-pressing portion 81D and the normal-pressing portion 82B are provided in the lower second area W2. In other words, the detecting portions of the first pressing portion 80 are provided in three rows in the vertical direction within the range of a predetermined height (the first area W1 and the second area W2) that includes the common portion 32.

Figure 29:
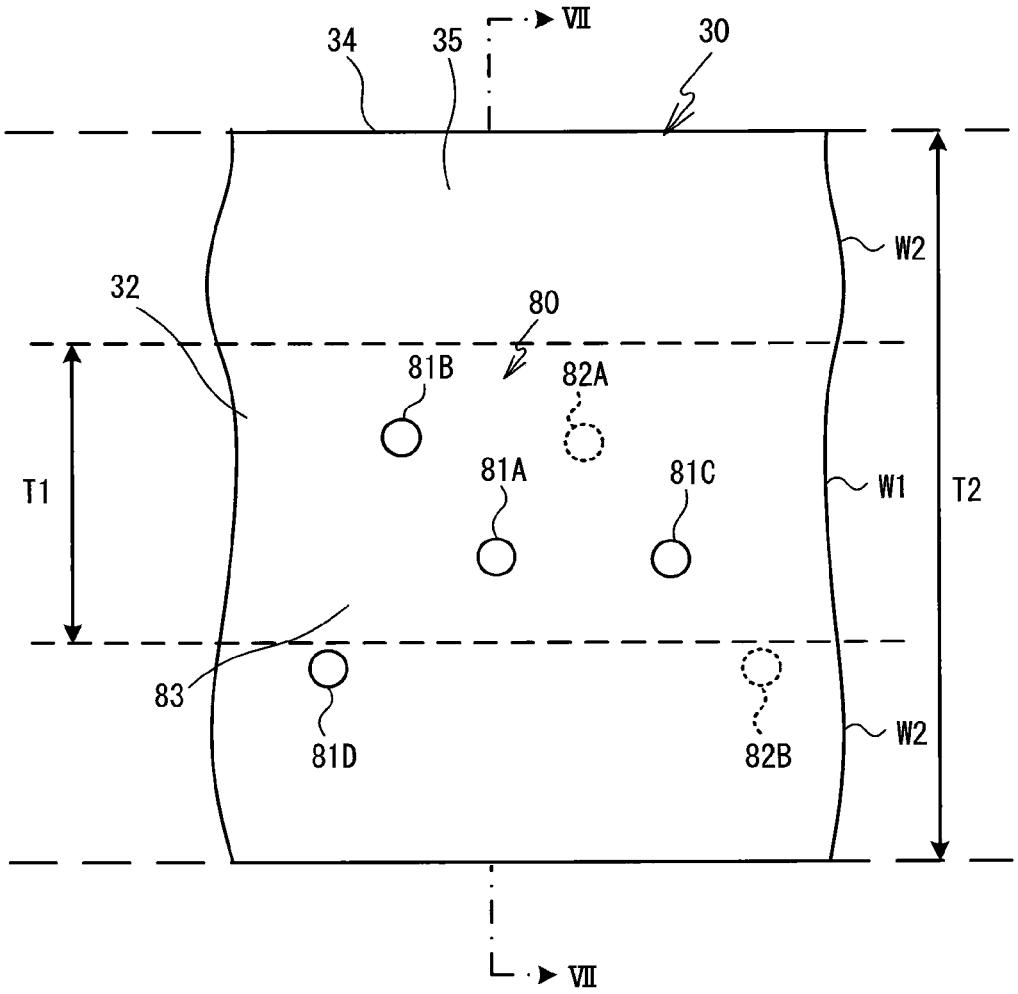
FIG. 29 is a diagram showing the wide-width tape cassette 30 on which the first pressing portion 80 is provided in a first area W1 and a second area W2 of the arm side surface 35.
Figure 30:
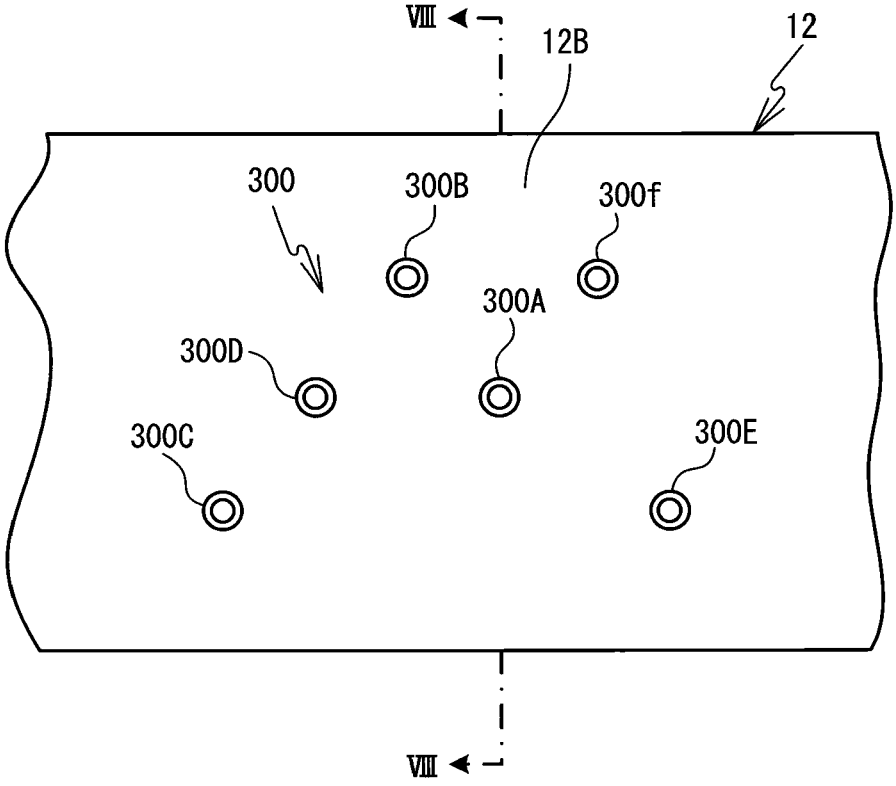
FIG. 30 is a rear view of a section of the platen holder 12 on which is provided a plurality of detecting switches 300, according to a modified embodiment.

Meanwhile, as shown in FIG. 30, in correspondence to the detecting portions of the first pressing portion 80, six detecting switches 300 are provided in three lines (three rows) in the vertical direction on the cassette-facing surface 12B of the platen holder 12. More specifically, each of the detecting switches 300A to 300F correspond, respectively, to the non-pressing portion 81A, the normal-pressing portion 82A, the non-pressing portion 81C, the normal-pressing portion 82B, the non-pressing portion 81B and the non-pressing portion 81D shown in FIG. 29. The maximum range in which the plurality of detecting switches 300A to 300F are provided (the width in the vertical direction) on the cassette-facing surface 12B is generally equivalent to the height T2 of the arm side surface 35.

Figure 31:
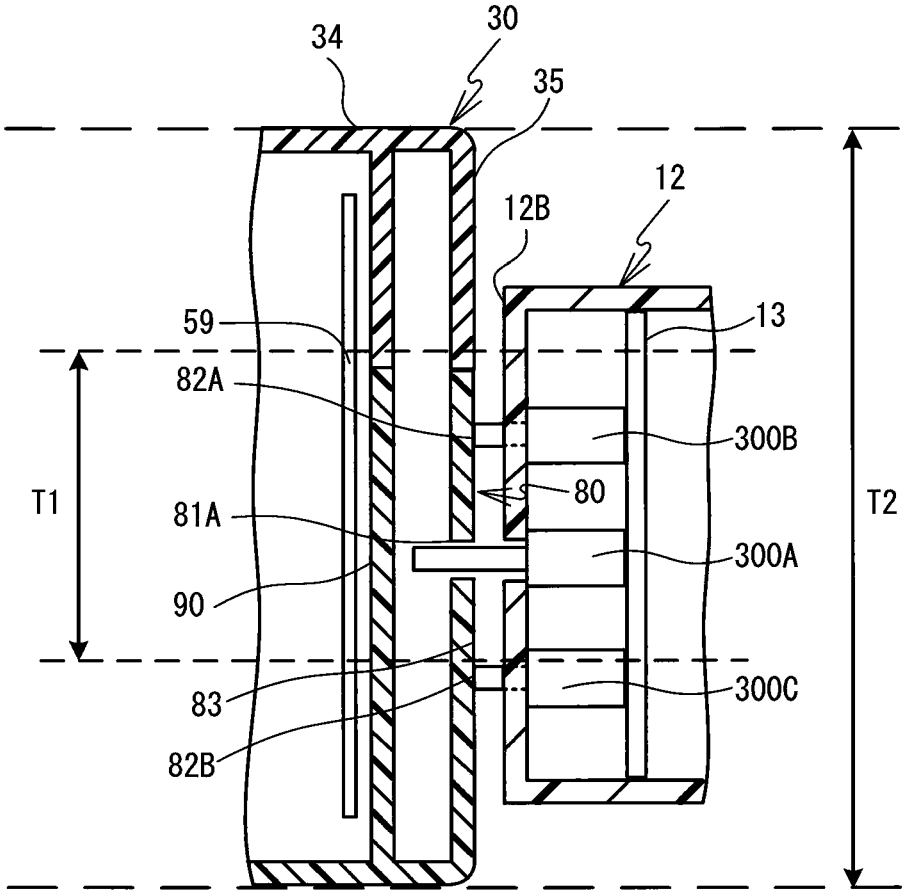
FIG. 31 is a cross-sectional view along a line VII-VII shown in FIG. 29 and a line VIII-VIII shown in FIG. 30 as seen in the direction of the arrows, illustrating a case in which the wide-width tape cassette 30 and the platen holder 12 of the modified embodiment are in the opposing state.

As shown in FIG. 31, in a case where the tape cassette 30 is properly installed, if the platen holder 12 moves to the print position, the detecting switches 300 respectively oppose the detecting portions (the non-pressing portions 81 and the normal-pressing portions 82) of the first pressing portion 80 on the arm side surface 35. Specifically, some of the detecting switches 300 (the detecting switch 300A shown in FIG. 31, and the detecting switches 300F, 300D and 300E that are not shown in the figures) are respectively inserted into the non-pressing portions 81A to 81D and are thus maintained in the off state. The remaining detecting switches 300 (the detecting switches 300B and 300C shown in FIG. 31) are respectively pressed by the normal-pressing portions 82A and 82B and are thus changed to the on state.

Figure 32:
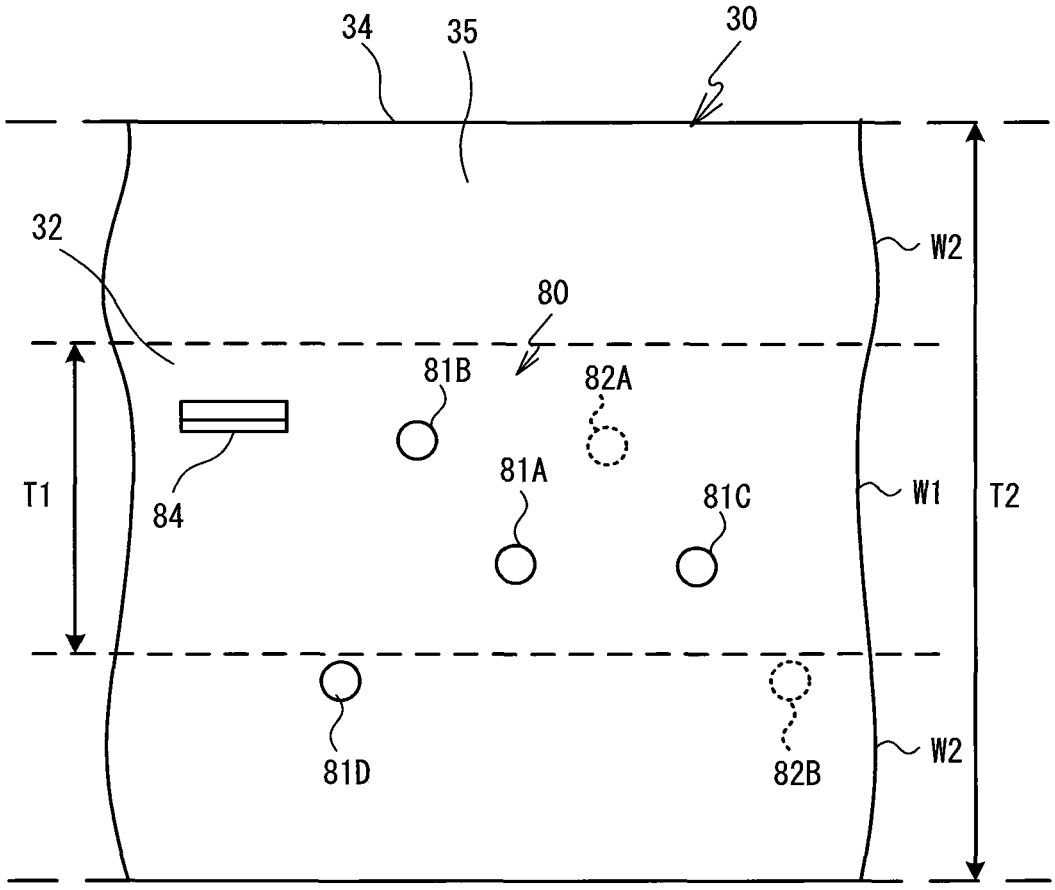
FIG. 32 is a front view showing a case in which the latching groove 84 is provided in the first area W1 of the tape cassette 30 shown in FIG. 29.

As shown in FIG. 32, with respect to the wide-width tape cassette 30 as shown in FIG. 29, the latching groove 84 similar to that in the second embodiment (refer to FIG. 21 etc.) may be provided on the left side or right side of the detecting portions in the first area W1. In such a case, the latching piece 29 similar to that in the second embodiment (refer to FIG. 19 etc.) may be provided on the cassette-facing surface 12B of the platen holder 12 at a position opposing the latching groove 84 shown in FIG. 32. In other words, although not shown in the figures, the latching piece 29 is not provided below the detecting switches 20 but is provided on the left side or right side on the cassette-facing surface 12B of the platen holder 12.

In the example of the tape cassette 30 shown in FIG. 32, the latching groove 84 is provided at a height position that generally corresponds to the non-pressing portion 81B and the normal-pressing portion 82A, which, among the detecting portions (the non-pressing portions 81A to 81C and the normal-pressing portion 82A) of the first pressing portion 80, are in the highest position in the direction of insertion and removal of the tape cassette 30 (namely, in the vertical direction). In this example, similarly to the second embodiment, when the platen holder 12 moves to the print position and the latching piece 29 is inserted into the latching groove 84, each of the detecting switches 300 that opposes each of the detecting portions provided in the first area W1 and the second area W2 is selectively pressed and thus is changed to the on state or maintained in the off state.

Figure 33:
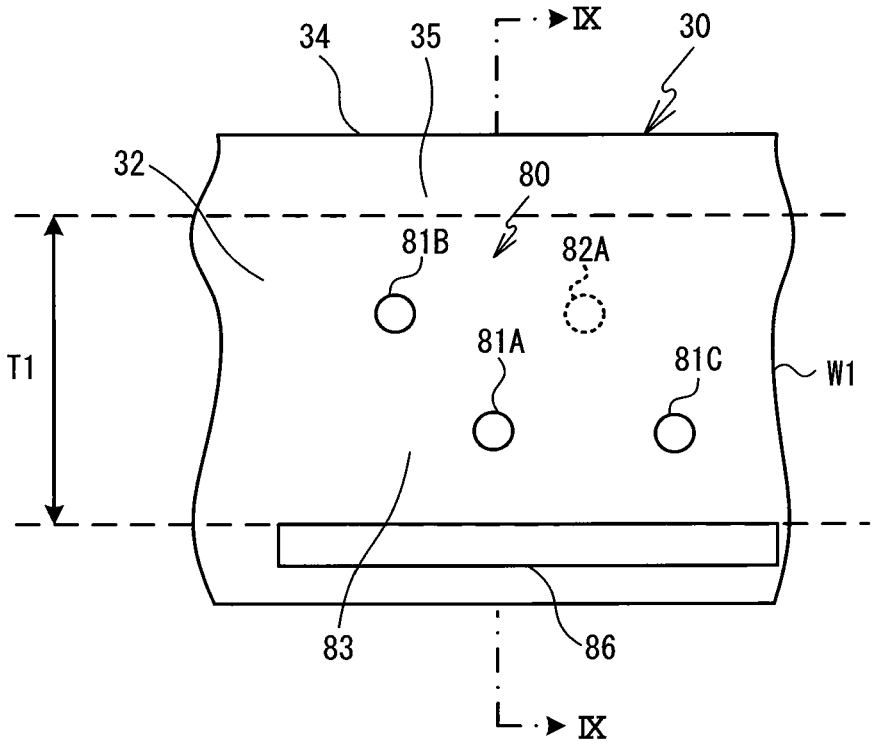
FIG. 33 is a front view showing the narrow-width tape cassette 30 on which the first pressing portion 80 is provided solely in the first area W1 of the arm side surface 35.

With the narrow-width tape cassette 30 shown in FIG. 33 (with a tape width of 9 mm, for example), in a similar way to the narrow-width tape cassette 30 shown in FIG. 29, four detecting portions (the non-pressing portions 81A, 81B, 81C and the normal-pressing portion 82A) are provided in two lines in the vertical direction in the first area W1. The first pressing portion 80 is not included in any area other than the first area W1 on the arm side surface 35. An escape groove 86 into which the detecting switches 300 can be inserted and removed, is formed below the first area W1.

The escape groove 86 is an indented portion formed in a section other than the first area W1 on the arm side surface 35 (in the example of FIG. 33, formed below the first area W1). The escape groove 86 includes at least a position that opposes a detecting switch 300 that may oppose a position other than the first area W1 when the tape cassette 30 is properly installed (in the example of FIG. 33, positions opposing the detecting switches 300C and 300E shown in FIG. 30).

Figure 34:
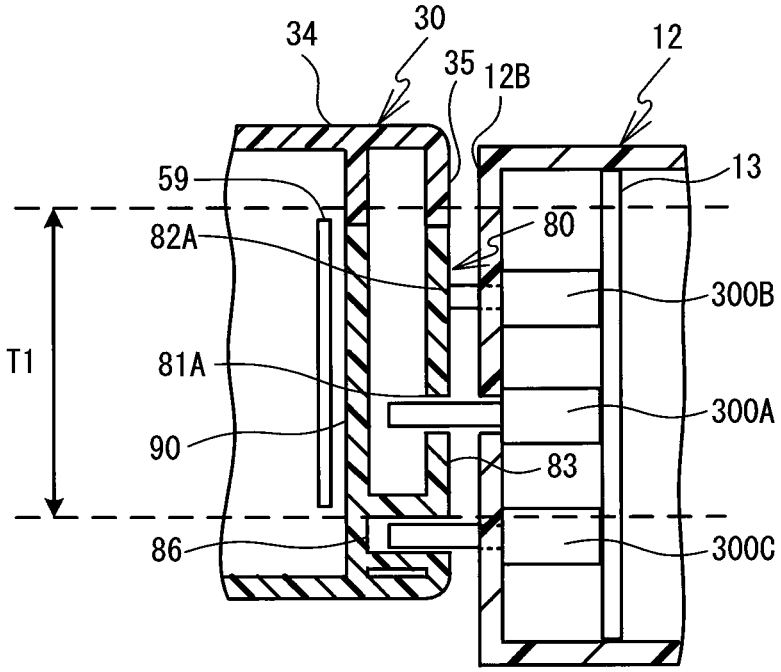
FIG. 34 is a cross-sectional view along the VII-VII line shown in FIG. 29 and a IX-IX line shown in FIG. 33 as seen in the direction of the arrows, illustrating a case in which the narrow-width tape cassette 30 and the platen holder 12 of the modified embodiment are in the opposing state.

For example, a case will be assumed in which, in the tape printer 1, the wide-width tape cassette 30 (refer to FIG. 29) that has been installed in the cassette housing portion 8 is removed and the narrow-width tape cassette 30 shown in FIG. 33 is installed. Then, as shown in FIG. 34, if the platen holder 12 moves to the print position, the detecting switches 300 opposing the first area W1 respectively oppose each of the detecting portions of the first pressing portion 80 on the arm side surface 35. In addition, the detecting switches 300 that do not oppose the first area W1 respectively oppose the escape groove 86 on the arm side surface 35.

Specifically, among all the detecting switches 300, the detecting switches 300 that oppose the first area W1 (the detecting switch 300A shown in FIG. 34 and the detecting switches 300F and 300D not shown in the figures) are respectively inserted into the non-pressing portions 81A to 81C and are thus maintained in the off state. Further, the remaining detecting switch 300 that opposes the first area W1 (the detecting switch 300B shown in FIG. 34) is pressed by the normal-pressing portion 82A and is thus in the on state. Meanwhile, the detecting switches 300 that do not oppose the first area W1 (the detecting switch 300C shown in FIG. 34 and the detecting switch 300E not shown in the figures) are respectively inserted into the escape groove 86 and are thus maintained in the off state.

As described above, in the narrow-width tape cassette 30, with respect to the detecting switches 300 that do not oppose the first area W1, an indentation for escape (the escape groove 86) is provided such that these detecting switches 300 are not pressed (in other words, these detecting switches 300 are not turned on). For that reason, in the tape printer 1, the detecting switches 300 may contact the first area W1 only, and the number of detecting switches 300 that are actually used can be made fewer than that used in a case with the wide-width tape cassette 30. Thus, the tape printer 1 can accurately obtain the information relating to the tape cassette 30 corresponding to the first pressing portion 80. Furthermore, the detecting switches 300 that do not oppose the first pressing portion 80 are not pressed by the side surface of the cassette case 31. Consequently, troubles such as erroneous detection of the type of the tape cassette 30 may be less likely to occur.

Figure 35:
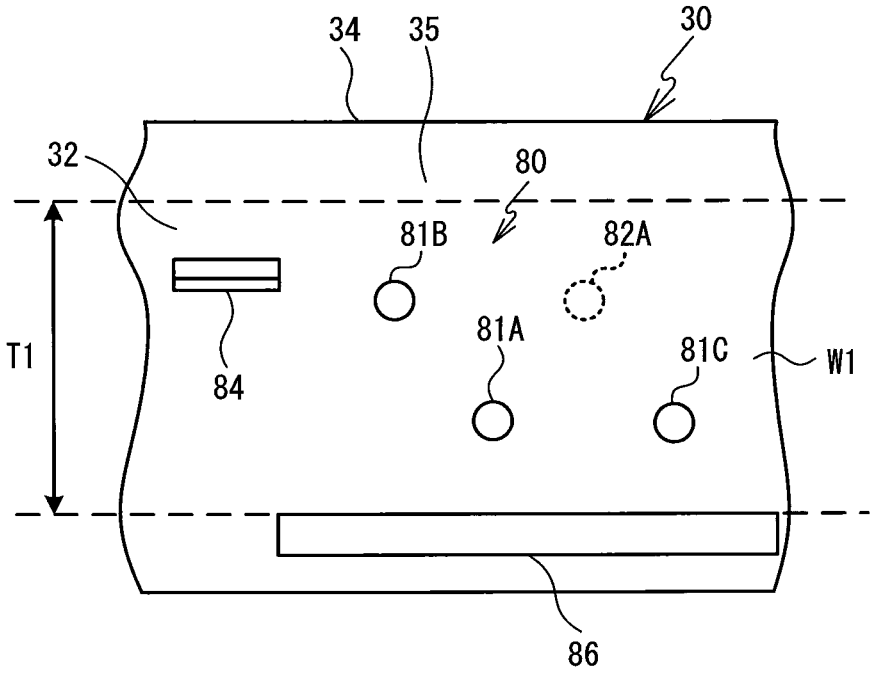
FIG. 35 is a front view showing a case in which the latching groove 84 is provided in the first area W1 of the tape cassette 30 shown in FIG. 33.

As shown in FIG. 35, with respect to the narrow-width tape cassette 30 shown in FIG. 33, in a similar way to the wide-width tape cassette 30 shown in FIG. 32, the latching groove 84 may be formed on the left side or right side of the detecting portions in the first area W1. Then, the latching piece 29 corresponding to the latching groove 84 shown in FIG. 35 may be provided on the cassette-facing surface 12B of the platen holder 12. In this example, if the platen holder 12 moves to the print position, the latching piece 29 is inserted into the latching groove 84, and each of the detecting switches 300 opposing each of the detecting portions in the first area W1 is selectively pressed and is thus changed to the on state or maintained in the off state. Each of the detecting switches 300 opposing each of the detecting portions in the second area W2 is maintained in the off state.

In the above-described examples shown in FIG. 33 and FIG. 34, the indentation (the escape groove 86) is adopted to allow the detecting switches 300 that do not oppose the first area W1 to escape, but the present invention is not limited to this example. In place of an indentation, a hole or a step may be adopted. For example, the narrow-width tape cassette 30 (with a tape width of 9 mm, for example) shown in FIG. 36, has generally the same structure as the tape cassette 30 shown in FIG. 33, except that an escape step 87 is formed in place of the escape groove 86. The escape step 87 is a step that is formed by bending a portion of the arm side surface 35 other than the first area W1 (in the example of FIG. 36, the portion below the first area W1) inward. The escape step 87 at least includes a position opposing the detecting switch 300 that opposes a position other than the first area W1 when the tape cassette 30 is properly installed (in the example of FIG. 36, positions opposing the detecting switches 300C and 300E shown in FIG. 30).

Figure 36:
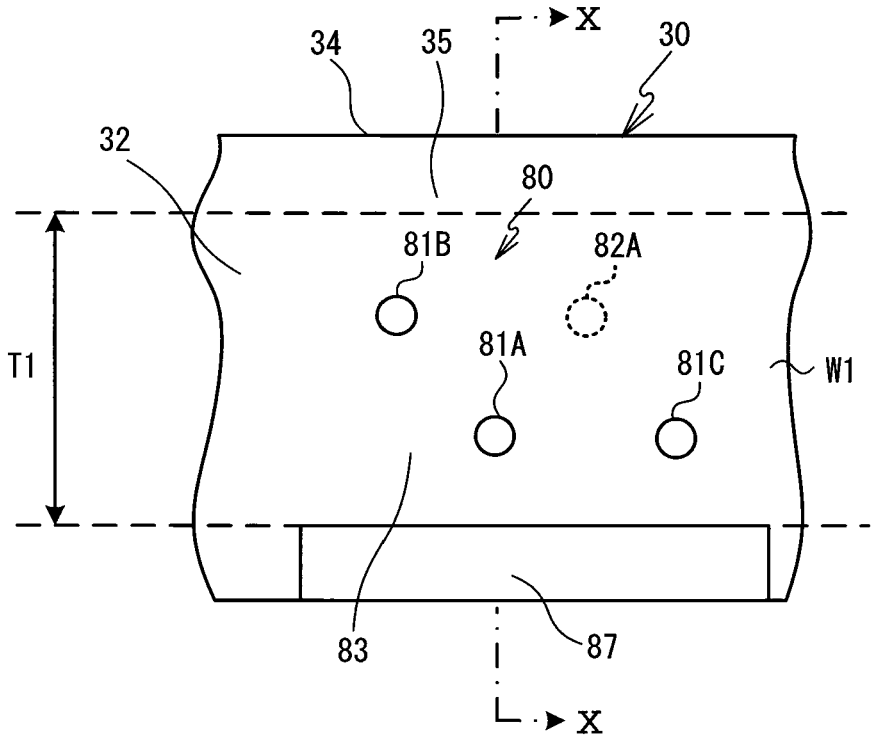
FIG. 36 is a diagram showing a modified example in which, in place of an escape groove 86, an escape step 87 is provided.
Figure 37:
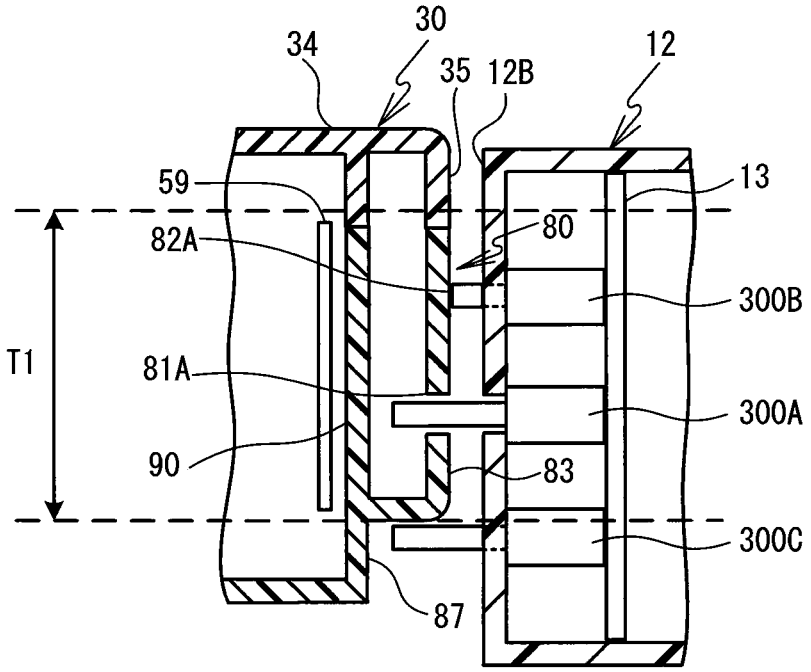
FIG. 37 is a cross-sectional view along the line VII-VII shown in FIG. 29 and a line X-X shown in FIG. 36 as seen in the direction of the arrows, illustrating a case in which the narrow-width tape cassette 30 and the platen holder 12 of the modified example are in the opposing state.
Figure 38:
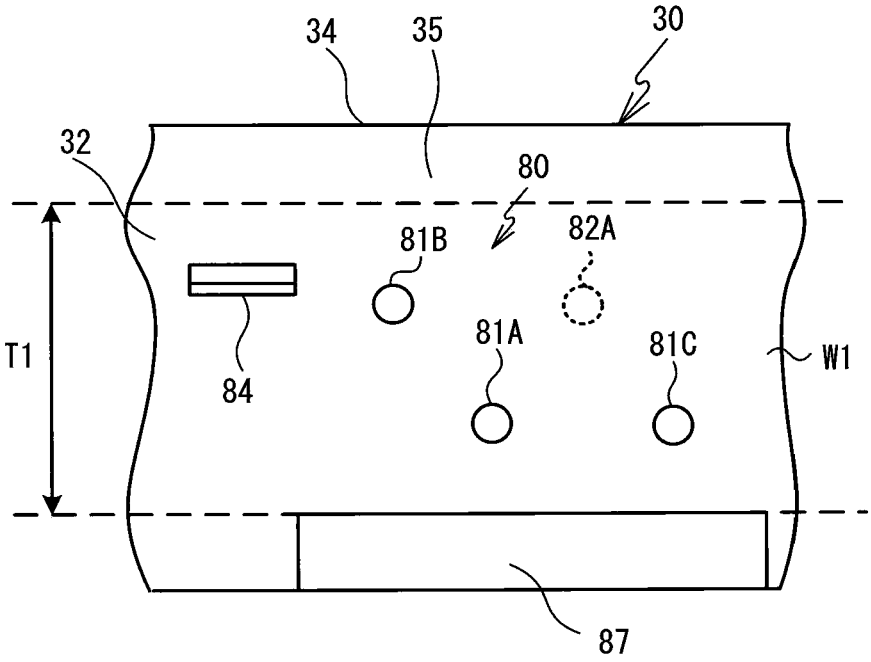
FIG. 38 is a front view of a case in which the latching groove 84 is provided in the first area W1 of the tape cassette 30 shown in FIG. 36.

With the above-described structure, as shown in FIG. 37, if the platen holder 12 moves to the print position, the detecting switches 300 that do not oppose the first area W1 (the detecting switch 300C shown in FIG. 37, and the detecting switch 300E not shown in the figures), oppose the escape step 87 of the arm side surface 35 and are thus maintained in the off state. With the narrow-width tape cassette 30 shown in FIG. 36 also, in a similar way to the narrow-width tape cassette 30 shown in FIG. 35, the latching groove 84 maybe formed on the left or right side of the detecting portions in the first area W1 (refer to FIG. 38).

Figure 39:
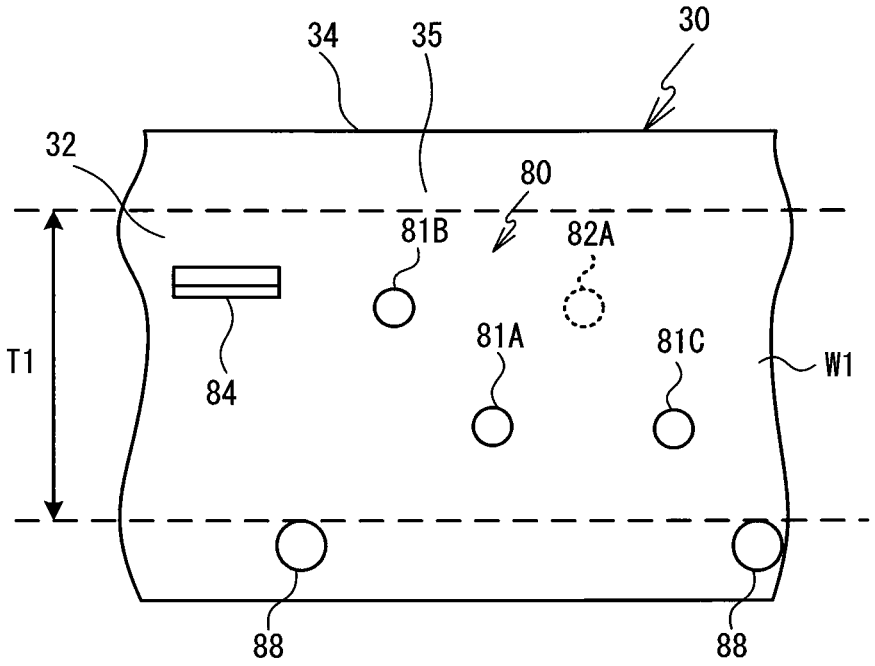
FIG. 39 is a front view showing another modified example in which, in place of the escape groove 86, escape holes 88 are provided on the tape cassette 30 shown in FIG. 35.

In addition, the narrow-width tape cassette 30 (with a tape width of 9 mm, for example) shown in FIG. 39 has generally the same structure as the tape cassette 30 shown in FIG. 35, except that escape holes 88 are formed in place of the escape groove 86. The escape holes 88 are formed as through-holes provided in a portion of the arm side surface 35 other than the first area W1 (in the example of FIG. 38, the portion below the first area W1). The escape holes 88 are formed at positions opposing the detecting switches 300 that oppose positions other than the first area W1 when the tape cassette 30 is properly installed (in the example of FIG. 38, at positions opposing the detecting switches 300C and 300E shown in FIG. 30). In this example also, if the platen holder 12 moves to the print position, the detecting switches 300 that do not oppose the first area W1 (namely, the detecting switches 300C and 300E) are respectively inserted into the escape holes 88 of the arm side surface 35 and are thus maintained in the off state.

Next, the types of the tape cassette 30 (hereinafter, the tape types) that can be detected by the tape printer 1 are explained in more detail. The following explanation exemplifies a case in which the tape types are identified by the tape printer 1 that is equipped with the platen holder 12 shown in FIG. 30, with reference to a cassette identification table shown in Table 1 below.

TABLE 1

| | | First Area | | | | Second Area | |
|---|---|---|---|---|---|---|---|
| No. | Tape Type | 1 | 2 | 3 | 4 | 5 | 6 |
| 1 | 3.5 mm, Laminated, Normal | ON | ON | ON | OFF | OFF | OFF |
| 2 | 3.5 mm, Receptor, Normal | ON | ON | OFF | ON | OFF | OFF |
| 3 | 6 mm, Laminated, Normal | ON | OFF | ON | ON | OFF | OFF |
| 4 | 6 mm, Receptor, Normal | OFF | ON | ON | ON | OFF | OFF |
| 5 | 9 mm, Laminated, Normal | ON | ON | OFF | OFF | OFF | OFF |
| 6 | 9 mm, Receptor, Normal | ON | OFF | OFF | ON | OFF | OFF |
| 7 | 12 mm, Laminated, Normal | OFF | OFF | ON | ON | OFF | OFF |
| 8 | 12 mm, Receptor, Normal | ON | OFF | ON | OFF | OFF | OFF |
| 9 | 3.5 mm, Laminated, High Speed | OFF | ON | OFF | ON | OFF | OFF |
| 10 | 6 mm, Laminated, High Speed | OFF | ON | ON | OFF | OFF | OFF |
| 11 | 9 mm, Laminated, High Speed | ON | OFF | OFF | OFF | OFF | OFF |
| 12 | 12 mm, Laminated, High Speed | OFF | ON | OFF | OFF | OFF | OFF |
| ... | ... | ... | ... | ... | ... | ... | ... |
| 15 | Error 1 | ON | ON | ON | ON | OFF | OFF |
| 16 | Error 2 | OFF | OFF | OFF | OFF | OFF | OFF |
| 17 | 18 mm, Laminated, Normal | ON | ON | ON | OFF | ON | OFF |
| 18 | 18 mm, Receptor, Normal | ON | ON | OFF | ON | ON | OFF |
| 19 | 24 mm, Laminated, Normal | ON | OFF | ON | ON | ON | OFF |
| 20 | 24 mm, Receptor, Normal | OFF | ON | ON | ON | ON | OFF |
| 21 | 36 mm, Laminated, Normal | ON | ON | OFF | OFF | ON | OFF |
| 22 | 36 mm, Receptor, Normal | ON | OFF | OFF | ON | ON | OFF |
| 23 | 18 mm, Laminated, Normal | OFF | OFF | ON | ON | ON | OFF |
| 24 | 18 mm, Receptor, Normal | ON | OFF | ON | OFF | ON | OFF |
| 25 | 24 mm, Laminated, Normal | OFF | ON | OFF | ON | ON | OFF |
| 26 | 24 mm, Receptor, Normal | OFF | ON | ON | OFF | ON | OFF |
| 27 | 36 mm, Laminated, Normal | ON | OFF | OFF | OFF | ON | OFF |
| 28 | 36 mm, Receptor, Normal | OFF | ON | OFF | OFF | ON | OFF |
| ... | ... | ... | ... | ... | ... | ... | ... |
| 64 | Error 3 | ON | ON | ON | ON | ON | ON |

In the cassette identification table shown in Table 1, a type of the tape cassette 30 is defined in association with a combination of the detecting portions (the non-pressing portion(s) 81 and the normal-pressing portion(s) 82) of the first pressing portion 80 provided on the tape cassette 30. The "tape type" indicates a tape width of the tape cassette 30 (seven sizes from 3.5 mm to 36 mm, for example), a tape type (a laminated type or a receptor type, for example), a print speed (normal or high speed, for example) and, additionally, improper cassette installed states (Error 1 to Error 3, for example) in which the tape type can not be identified correctly.

More specifically, in the cassette identification table shown in Table 1, the tape type is associated with a combination of on state (ON) or a off state (OFF) of each of the four detecting switches that oppose the first area W1 and the two detecting switches that oppose the second area W2. Of the plurality of detecting switches 300 shown in FIG. 30, the detecting switches 300B, 300F, 300D and 300A correspond, respectively, to the detecting switches 1 to 4 of the first area W1 shown in Table 1. The detecting switches 300C and 300E correspond, respectively, to the detecting switches 5 and 6 of the second area W2 shown in Table 1.

In the cassette identification table of Table 1, in correspondence to the maximum sixty-four detection patterns that is the number of combinations of the on and off states of the total of the six detecting switches 300, a maximum sixty-four tape types can be defined. In the example of Table 1, of the maximum sixty-four detection patterns, tape types are associated with twenty-seven detection patterns. Therefore, any selected tape types may be freely associated with each of the remaining thirty-seven combinations of the detection patterns of the detecting switches 300 and added to the cassette identification table. In addition, each tape type recorded in the cassette identification table may be deleted, the correspondence between each detection pattern and the tape type may be changed, and the content of the tape type corresponding to each detection pattern may be changed.

In the tape printer 1 equipped with the platen holder 12 shown in FIG. 30, if the wide-width tape cassette 30 shown in FIG. 29 is properly installed, the detecting switches 300B and 300C are changed to the on state (refer to FIG. 31). In other words, the detecting switches 1 and 5 are ON, and the other detecting switches 2 to 4 and 6 are OFF. For that reason, at step S11 in the main processing (refer to FIG. 16), with reference to the cassette identification table of Table 1, the tape type is identified as "36 mm, Laminated, Normal."

If the narrow-width tape cassette 30 shown in FIG. 33 and FIG. 36 is properly installed, only the detecting switch 300B is in the on state (refer to FIG. 34 and FIG. 37). In other words, the detecting switch 1 is ON and the other detecting switches 2 to 6 are OFF. For that reason, at step S11 in the main processing (refer to FIG. 16), with reference to the cassette identification table of Table 1, the tape type is identified as "9 mm, Laminated, High speed."

On the other hand, if the tape cassette 30 is not installed in the cassette housing portion 8, or if the tape cassette 30 does not reach the height position at which the tape cassette 30 contacts with the detecting switches 300, all of the detecting switches 300 are in the off state (in other words, the detecting switches 1 to 6 are all OFF). For that reason, at step S5 in the main processing (refer to FIG. 16), with reference to the cassette identification table of Table 1, the tape type "Error 2" is identified, and an error alert is output.

If the tape cassette 30 is not properly installed, the detecting switches 1 to 4 of the first area W1 are all ON. Meanwhile, the detecting switches 5 and 6 of the second area W2 are all ON, or all OFF, as will be explained later. In either case, specific detecting switches 300 (namely, the detecting switches 1 to 4 of the first area W1) are all ON. At step S9 in the main processing (refer to FIG. 16), with reference to the cassette identification table of Table 1, the tape type "Error 1" or "Error 3" is identified, and an error alert is output.

Figure 40:
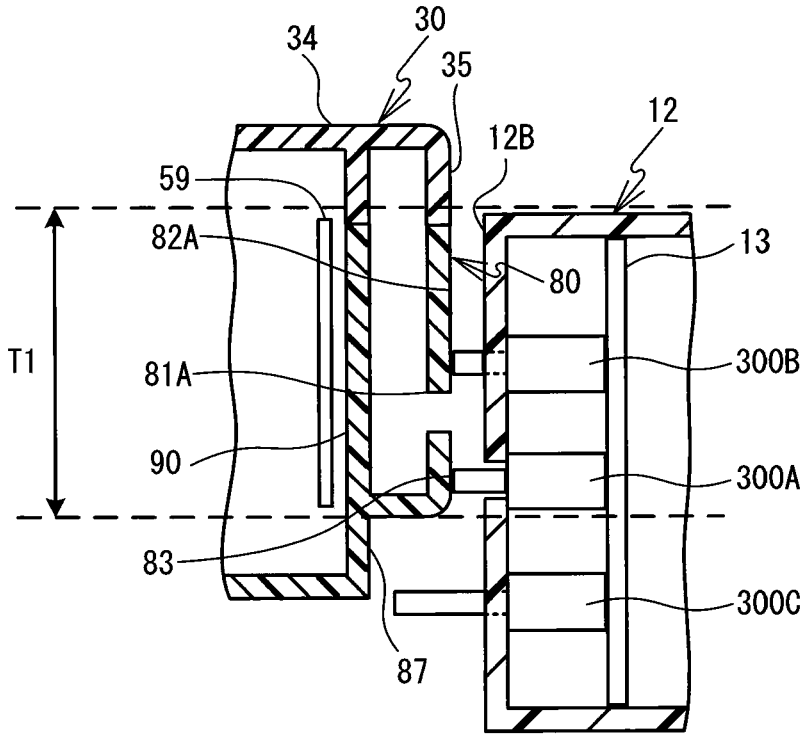
FIG. 40 is a side cross-sectional view illustrating a case in which the improperly installed narrow-width tape cassette 30 and the platen holder 12 of the modified example are in the opposing state.

More specifically, in the example shown in FIG. 40, the narrow-width tape cassette 30 is installed in a raised state with respect to the proper position in the cassette housing portion 8, and the second pressing portion 83 of the arm side surface 35 presses the detecting switches 300A, 300B, 300D and 300F. On the other hand, the detecting switches 300C and 300E oppose the escape step 87, and remain in the off state. In other words, the detecting switches 1 to 4 of the first area W1 are all ON and the detecting switches 5 and 6 of the second area W2 are both OFF. As a result, at step S9 in the main processing, with reference to the cassette identification table of Table 1, the tape type "Error 1" is identified.

Figure 41:
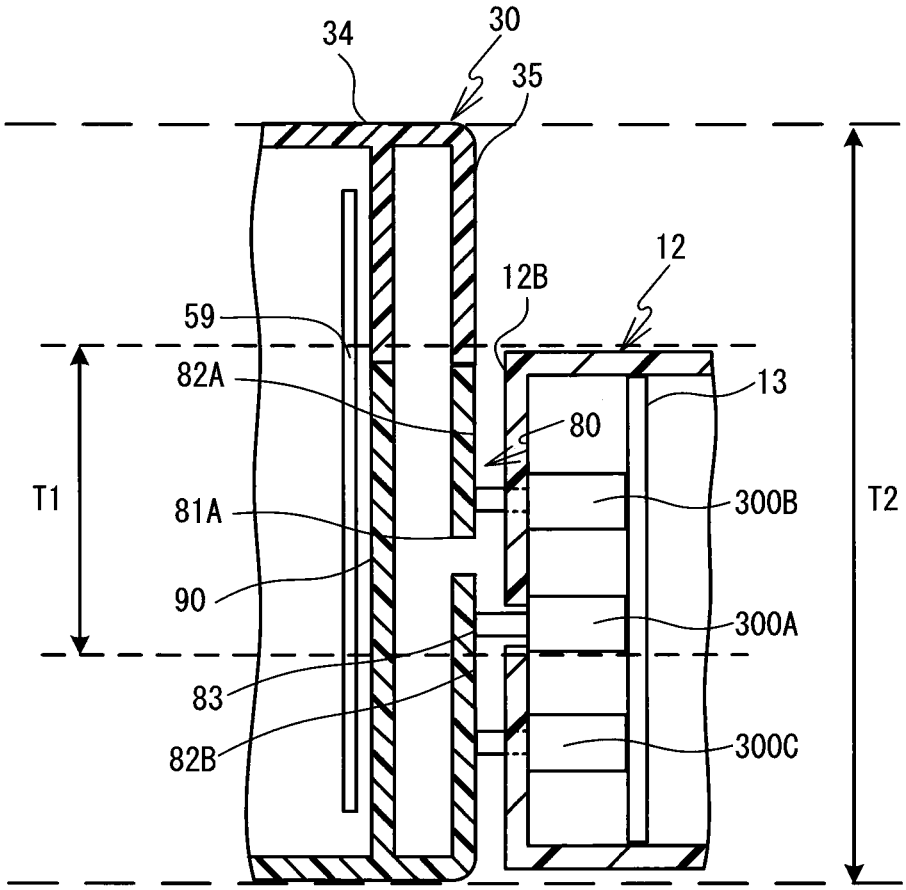
FIG. 41 is a side cross-sectional view illustrating a case in which the improperly installed wide-width tape cassette 30 and the platen holder 12 of the modified example are in the opposing state.

In the example shown in FIG. 41, the wide-width tape cassette 30 is installed in a raised state with respect to the proper position in the cassette housing portion 8, and the second pressing portion 83 of the arm side surface 35 presses all the detecting switches 300A to 300F. In other words, not only the detecting switches 1 to 4 of the first area W1, but also the detecting switches 5 and 6 of the second area W2 are ON. As a result, at step S9 in the main processing, with reference to the cassette identification table of Table 1, the tape type "Error 3" is identified.

Depending on applications, a price and a performance and the like of the tape printer 1, there may be dedicated models and multi-purpose models. In the dedicated models, only the narrow-width tape cassette 30 can be installed. In the multi-purpose models, both the narrow-width tape cassette 30 and the wide-width tape cassette 30 can be installed. In the above-described examples, identification modes of the tape type by the tape printer 1 as a multi-purpose model that is equipped with the platen holder 12 shown in FIG. 30 are explained. Hereinafter, identification modes of the tape type by the tape printer 1 as a dedicated model will be explained.

The dedicated model tape printer 1 has the platen holder 12 that has the detecting switches 300 such that the detecting switches 300 only oppose the detecting portions provided in the first area W1 when the narrow-width tape cassette 30 is properly installed. More specifically, in a case where the dedicated model tape printer 1 is equipped with the platen holder 12 shown in FIG. 30, the detecting switches 300C and 300E that may oppose the second area W2 will not be provided.

Consequently, if the tape type is identified with reference to the cassette identification table of Table 1, the detecting switches 5 and 6 of the second area W2 are constantly OFF and no detection pattern is identified in which either one of the second area W2 detecting switches 5 and 6 is ON. As a result, if the narrow-width tape cassette 30 is properly installed, at step S11 in the main processing (refer to FIG. 16), with reference to the cassette identification table of Table 1, the tape type corresponding to a detection pattern of the first area W1 detecting switches 1 to 4 (in Table 1, the tape types from No. 1 to 16) is identified (this is also the same for the above-described FIG. 12).

If the tape cassette 30 is not installed in the cassette housing portion 8, or if the tape cassette 30 has not reached the height position at which the tape cassette 30 contacts with the detecting switches 300, all of the detecting switches 300 are in the off state, in a similar way to the multi-purpose model tape printer 1. For that reason, at step S5 in the main processing (refer to FIG. 16), with reference to the cassette identification table of Table 1, the tape type "Error 2" is identified, and an error alert is output (this is also the same for the above-described FIG. 14).

Figure 42:
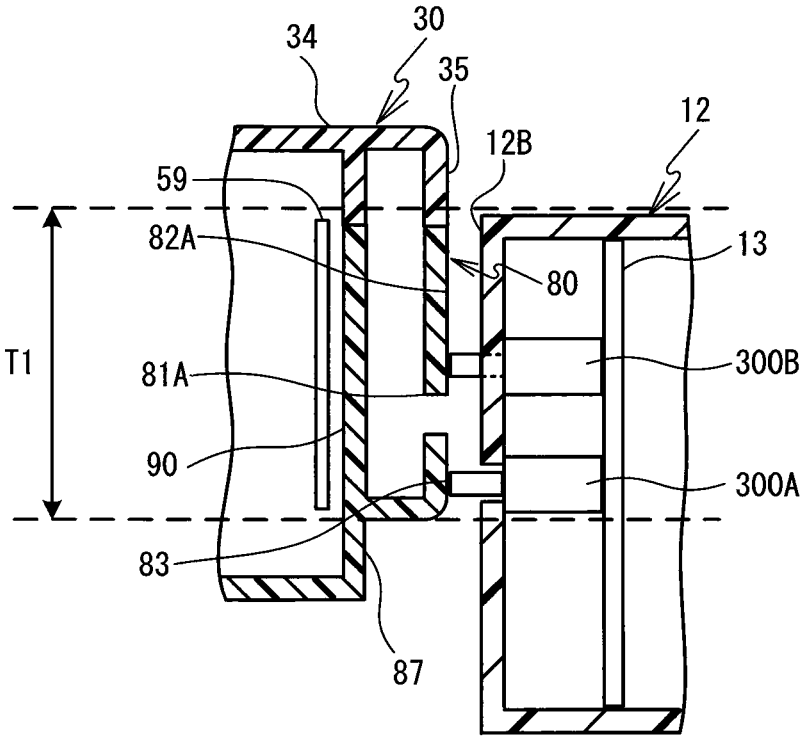
FIG. 42 is a side cross-sectional view illustrating a case in which the improperly installed narrow-width tape cassette 30 and the platen holder 12 of another modified example are in the opposing state.

If the tape cassette 30 is not properly installed, the detecting switches 1 to 4 of the first area W1 are all ON. More specifically, in the example shown in FIG. 42, the narrow-width tape cassette 30 is installed at a raised position with respect to the proper position in the cassette housing portion 8. Consequently, the second pressing portion 83 on the arm side surface 35 presses the detecting switches 300A, 300B, 300D and 300F.

On the other hand, as the detecting switches 300C and 300E that may oppose the second area W2 are not provided, the detecting switches 5 and 6 of the second area W2 are both detected as being OFF. In other words, the specific detecting switches 300 (namely, the detecting switches 1 to 4 of the first area W1) are all ON and thus, at step S9 in the main processing, with reference to the cassette identification table of Table 1, the tape type "Error 1" is identified, and an error alert is output (this is also the same for the above-described FIG. 13).

In a case where the tape printer 1 and the tape cassette 30 are provided with a pair of fitting portions that have a male/female relationship (a concavo-convex relationship), such as the latching groove 84 and the latching piece 29, for example, the identification modes of the tape type are still the same as described above. More specifically, if the narrow-width tape cassette 30 is properly installed (refer to FIG. 23), at step S41 in the main processing (refer to FIG. 26), with reference to the cassette identification table of Table 1, the tape type corresponding to a detection pattern of the first area W1 detecting switches 1 to 4 is identified.

In addition, if the tape cassette 30 is not installed in the cassette housing portion 8, or if the tape cassette 30 is not properly installed (refer to FIG. 24 and FIG. 25), at step S35 in the main processing (refer to FIG. 26), with reference to the cassette identification table of Table 1, the tape type "Error 1" or "Error 2" is identified and an error alert is output.

After the tape printer 1 is designed and manufactured based on a presumption that a tape having a tape width that is not wider than a predetermined maximum tape width (36 mm, for example) will be used, it may become necessary to provide a tape having a tape width wider than the predetermined maximum tape width (a tape with a 48 mm tape width, for example). In such a case, corresponding to the tape cassette 30 of the newly added tape width (here, 48 mm), the number of the detecting switches 20 and the number of lines of the detecting switches 20 provided on the tape printer 1 may be increased. Then, the on and off state detection patterns of the detecting switches 20 corresponding to the newly added tape cassette 30 may be registered in the cassette identification table stored in the ROM 74.

Additionally, an escape structure (the escape groove 86, for example) may be provided in advance on the narrow-width tape cassette 30, to allow the detecting switches 20 that do not oppose the first area W1 to escape, as described above. In such a way, with the tape printer 1, the tape cassette 30 having a 48 mm width, which was not originally posited, may be used, without affecting the tape cassettes 30 having a tape width of 36 mm or less that have already been shipped.

As described above, by structuring the first pressing portion 80 with the plurality of detecting portions (the non-pressing portion(s) 81 and the normal-pressing portion(s) 82) that correspond to the cassette width or the tape width, and that are arranged in an optimum number of lines, the degree of freedom may be increased in terms of patterns of the first pressing portion 80 (namely, the number and the positions and the like of the plurality of detecting portions). Then, the number of types of the tape cassette 30 that can be detected by the tape printer 1 can be efficiently set.

In a case where the cassette width or the tape width of the tape cassette 30 is equal to or less than a predetermined value, it may be preferable that the first pressing portion 80 is provided in the first area W1. In such a case, in the tape cassette 30 with a small cassette width or tape width, corresponding to the narrow side surface of the case of the tape cassette 30, the first pressing portion 80 may be efficiently structured on a small surface area. In addition, it may be preferable for the escape groove 86 to be formed on at least one of the sides above and below the first area W1. The detecting switches 300 are more likely to be displaced in the width direction of the tape cassette 30 (namely, the direction of insertion and removal of the tape cassette 30) in particular. Therefore, by causing the detecting switches 300 positioned on either side of the first area W1, which may easily cause erroneous detection, to be in the off state, erroneous detection may be efficiently prevented.

In addition, in a case where the cassette width or the tape width of the tape cassette 30 is larger than the predetermined value, it may be preferable that the first pressing portion 80 is provided in the first area W1 and the second area W2. In such a case, in the tape cassette 30 with a large cassette width or tape width, corresponding to the wide side surface of the case of the tape cassette 30, the first pressing portion 80 may be structured over a large surface area. As a result, the number of types of the tape cassette 30 that can be detected by the tape printer 1 may be increased.

In addition, in this case, it may be preferable that the second area W2 is provided on at least one of the sides above and below the first area W1. In such a case, by efficiently utilizing an area extended from the first area W1 in the direction of the width of the tape cassette 30 (namely, the second area W2), the number of types of the tape cassette 30 that can be detected by the tape printer 1 may be increased. Further, even when the wide-width tape cassette 30 that was not originally posited are put on the market at a later stage, the first pressing portion 80 may be expanded (in other words, the number of the detecting portions and the number of lines of the detecting portions may be increased) in accordance with the cassette width or the tape width. As a result, with the tape printer 1, the number of the types of the tape cassette 30 that can be detected may be increased without affecting the narrow-width tape cassettes 30 that have already been shipped (namely, there is no need to change the structure of the first pressing portion 80).

With the tape printer 1, a movement of the tape cassette 30 installed in the cassette housing portion 8 is regulated in the horizontal direction (in the front-and-rear direction and the right-and-left direction) by side walls of the concave section 8A and by the positioning pins 102 and 103. In addition, if the tape printer 1 and the tape cassette 30 are provided with a pair of fitting portions that have a male/female relationship (a concavo-convex relationship), such as the latching groove 84 and the latching piece 29 in the second embodiment, the movement of the tape cassette 30 installed in the cassette housing portion 8 is also regulated in the vertical direction.

However, in a case where the tape printer 1 and the tape cassette 30 are not provided with a pair of fitting portions that have a male/female relationship (a concavo-convex relationship), as in the first embodiment, a positional displacement of the tape cassette 30 in the cassette housing portion 8 may occur in the vertical direction (in other words, the tape cassette 30 may be in the raised state). If the tape cassette 30 is in the raised state, the detecting switch(es) 20 may not properly oppose the non-pressing portion(s) 81 and may improperly oppose the non-pressing portion(s) 81 aligned in the vertical direction or oppose the normal-pressing portion(s) 82. As a result, the tape printer 1 may erroneously recognize the tape type.

For that reason, it may be preferable that the detecting portions of the first pressing portion 80 (and the corresponding detecting switches 20 and 300) be arranged such that each of lines respectively connecting any one of the detecting portions with another intersects with the direction of insertion and removal of the tape cassette 30 (namely, the vertical direction) (refer to FIG. 27, FIG. 28, FIG. 29, FIG. 30, FIG. 33 and FIG. 36, for example). In other words, it may be preferable that the detecting portions of the first pressing portion 80 are respectively arranged at different positions in the right-and-left direction on the side surface of the tape cassette 30. Expressed differently, it may be preferable that the detecting portions are not aligned in the vertical direction. In such a case, even if the tape cassette 30 is in the raised state, the detecting switches 20 and 300 reliably contact with the second pressing portion 83 and are thus changed to the on state. As a result, it may be accurately detected that the tape cassette 30 is not properly installed.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A tape printer comprising:

a tape cassette that includes:

a tape roll that is a wound tape as a print medium; and a box-like housing that supports the tape roll therein;

a cassette housing portion in which the tape cassette is removably installed;

a feeding device that pulls out and feeds the tape along a feed path from the housing of the tape cassette installed in the cassette housing portion;

a printing device that performs printing on the tape fed by the feeding device;

a plurality of detecting switches that protrude toward a side surface of the housing of the tape cassette installed in the cassette housing portion;

a first determining device that, in a case where a part of the plurality of detecting switches is pressed, determines that the tape cassette is installed in the cassette housing portion; and a second determining device that, in a case where a specific detecting switch among the plurality of detecting switches is pressed, determines that the tape cassette is not installed at a proper position in the cassette housing portion, the tape cassette including:

a first pressing portion that is provided on the side surface of the housing and that, in a case where the tape cassette is installed at the proper position in the cassette housing portion, presses a part of the plurality of detecting switches; and a second pressing portion that is provided on the side surface of the housing and that, in a case where the tape cassette is not installed at the proper position in the cassette housing portion, presses the specific detecting switch.

2. The tape printer according to claim 1, further comprising:

a movable member that includes the plurality of detecting switches, and that can be moved between a first position and a second position, the first position being in proximity to the side surface of the tape cassette installed in the cassette housing portion, and the second position being at an interval from the side surface of the tape cassette installed in the cassette housing portion, wherein:

in a case where the movable member is at the second position, the tape cassette can be installed in and removed from the cassette housing portion, and in a case where the movable member is at the first position, the plurality of detecting switches oppose the side surface of the housing such that the detecting switches can be pressed.

3. The tape printer according to claim 2, wherein:

the printing device includes a print head that performs printing on the tape;

the movable member includes a platen roller that is rotatable along the feed path and that is located at a position corresponding to the print head; and in a case where the movable member is at the first position, the platen roller is pressed against the print head.

4. The tape printer according to claim 3, further comprising:

a head holder on which the print head is mounted and that, in a case where the tape cassette is installed in the cassette housing portion, is inserted into a print head insertion portion provided in the housing, wherein, in a case where the tape cassette is installed at the proper position and the movable member is at the first position, the plurality of detecting switches oppose the first pressing portion that is provided on the side surface adjacent to the print head insertion portion such that the detecting switches can be pressed.

5. The tape printer according to claim 2, wherein:

the movable member includes a latching piece that prevents the tape cassette installed in the cassette housing portion from moving in a direction of insertion and removal of the tape cassette, the latching piece being located at a position corresponding to a receiving portion provided in the tape cassette installed in the cassette housing portion; and in a case where the movable member is at the first position, the latching piece engages with the receiving portion.

6. The tape printer according to claim 1, wherein the specific detecting switch is a combination of some of the plurality of detecting switches that is different from a combination of some of the detecting switches pressed by the first pressing portion.

7. The tape printer according to claim 1, wherein the plurality of detecting switches are arranged in such a manner that a line connecting any one of the plurality of detecting switches to another of the plurality of detecting switches intersects with a direction of insertion and removal of the tape cassette.

8. The tape printer according to claim 1, further comprising:

a third determining device that, in a case where the first determining device determines that the tape cassette is installed in the cassette housing portion, determines a type of the tape cassette installed in the cassette housing portion, based on which detecting switch is pressed among the plurality of detecting switches.

9. The tape printer according to claim 1, further comprising:

an alert output device that, in a case where the second determining device determines that the tape cassette is not installed at the proper position in the cassette housing portion, outputs a predetermined alert.

* * * * *